US008075380B2

(12) United States Patent
Yokota et al.

(10) Patent No.: US 8,075,380 B2
(45) Date of Patent: Dec. 13, 2011

(54) ROULETTE APPARATUS AND ROULETTE GAMING MACHINE

(75) Inventors: Tetsuya Yokota, Tokyo (JP); Katsuhiro Kido, Tokyo (JP); Yoshitomo Sasaki, Tokyo (JP)

(73) Assignee: Universal Entertainment Corporation, Koto-ku, Tokyo (JP)

( * ) Notice: Subject to any disclaimer, the term of this patent is extended or adjusted under 35 U.S.C. 154(b) by 671 days.

(21) Appl. No.: 12/149,245

(22) Filed: Apr. 29, 2008

(65) Prior Publication Data

US 2008/0220844 A1 Sep. 11, 2008

Related U.S. Application Data

(62) Division of application No. 11/202,355, filed on Aug. 12, 2005, now abandoned.

(30) Foreign Application Priority Data

Aug. 16, 2004 (JP) ..... 2004-236595
Aug. 23, 2004 (JP) ..... 2004-242750
Aug. 23, 2004 (JP) ..... 2004-242761

(51) Int. Cl.
*A63F 13/00* (2006.01)

(52) U.S. Cl. ..... 463/13

(58) Field of Classification Search ..... 273/143 R; 463/17

See application file for complete search history.

(56) References Cited

U.S. PATENT DOCUMENTS 2,011,995 A 8/1935 Baltzley
4,337,945 A 7/1982 Levy
4,396,193 A * 8/1983 Reinhardt et al. ..... 463/22
4,662,636 A * 5/1987 Crompton ..... 273/138.2
4,735,416 A 4/1988 McNally
4,792,137 A 12/1988 McKechnie
4,906,005 A 3/1990 Manabe
4,984,796 A 1/1991 Peacock
5,283,422 A 2/1994 Storch et al.
5,553,851 A 9/1996 Malavazos et al.
5,588,650 A 12/1996 Eman et al.
5,634,639 A 6/1997 Tokito et al.
5,755,440 A 5/1998 Sher
5,827,119 A 10/1998 Bromley
5,836,583 A * 11/1998 Towers ..... 273/142 B (Continued)

FOREIGN PATENT DOCUMENTS

CN 1278743 A 1/2001

(Continued)

OTHER PUBLICATIONS

Chinese Office Action/Search Report dated May 30, 2008 with an English translation.

(Continued)

*Primary Examiner* — Masud Ahmed

(74) *Attorney, Agent, or Firm* — McGinn IP Law Group PLLC

(57) ABSTRACT

A roulette apparatus includes: a roulette wheel having a rolling region where a ball rolls; and a ball reception member provided contiguously to the rolling region to receive the ball. The ball reception member includes: a plurality of reception portions that receives the ball in one of the reception portions; and a plurality of separation walls that separates the reception portions from one another, wherein the ball reception member is formed separately from the roulette wheel and removably attached to the roulette wheel.

14 Claims, 47 Drawing Sheets

U.S. PATENT DOCUMENTS

| | | | | |
|---|---|---|---|---|
| 5,934,999 | A * | 8/1999 | Valdez | 463/17 |
| 6,047,965 | A | 4/2000 | Mollo et al. | |
| 6,083,105 | A | 7/2000 | Romin et al. | |
| 6,520,854 | B1 | 2/2003 | McNally | |
| 6,554,454 | B1 * | 4/2003 | Kitano | 362/293 |
| 6,601,979 | B1 * | 8/2003 | Byrd et al. | 362/500 |
| 7,118,247 | B2 * | 10/2006 | Zavbi et al. | 362/234 |
| 7,144,321 | B2 | 12/2006 | Mayeroff | |
| 2002/0090988 | A1 * | 7/2002 | Frost et al. | 463/17 |
| 2004/0116177 | A1 * | 6/2004 | Frost et al. | 463/17 |
| 2004/0150992 | A1 | 8/2004 | Zavbi et al. | |
| 2004/0198484 | A1 * | 10/2004 | Johnson | 463/17 |
| 2005/0148383 | A1 * | 7/2005 | Mayeroff | 463/20 |
| 2006/0025200 | A1 * | 2/2006 | Van Asdale | 463/20 |
| 2006/0055109 | A1 | 3/2006 | Yokota et al. | |
| 2006/0267274 | A1 | 11/2006 | Cammegh | |
| 2006/0287053 | A1 | 12/2006 | Yokota | |
| 2007/0010312 | A1 | 1/2007 | Ike et al. | |
| 2007/0078016 | A1 | 4/2007 | Henry et al. | |
| 2007/0265056 | A1 | 11/2007 | Yoshizawa | |

FOREIGN PATENT DOCUMENTS

| | | | |
|---|---|---|---|
| DE | 199 17 678 | A1 | 11/2000 |
| EP | 0 046 306 | | 8/1981 |
| EP | 0 914 849 | | 5/1999 |
| EP | 1 360 978 | A1 | 11/2003 |
| GB | 211283 | A | 2/1924 |
| GB | 995431 | A | 6/1965 |
| GB | 2344540 | A | 6/2000 |
| GB | 2 356 576 | A | 5/2001 |
| JP | 8-229191 | | 9/1996 |
| WO | WO 95/05877 | A1 | 3/1995 |
| WO | WO 97/18870 | A1 | 5/1997 |
| WO | WO 97/38766 | | 10/1997 |
| WO | WO 03/024548 | A1 | 3/2003 |
| WO | WO 03/051476 | A1 | 6/2003 |
| WO | WO 2004/011112 | A1 | 2/2004 |
| WO | WO 2004/094013 | | 11/2004 |

OTHER PUBLICATIONS

Macau Office Action dated Aug. 12, 2005 with an English translation.
Eurasian Search Report dated Feb. 26, 2006.
European Search Report dated May 8, 2007.
Macau Search Report/Office Action dated Jun. 16, 2008 with an English translation.
United States Office Action dated Aug. 25, 2011 in U.S. Appl. No. 12/149,246.

* cited by examiner

FIG. 44

569

| BONUS WIN SCALE FACTOR | RANDOM NUMBER VALUE RANGE |
|---|---|
| x 1 | 0-199 |
| x 2 | 200-249 |
| x 3 | 250-279 |
| x 4 | 280-299 |
| x 10 | 300-314 |
| x 20 | 315-324 |
| x 30 | 325-329 |
| x 50 | 330-333 |
| x 100 | 334-335 |

(RANDOM NUMBER SAMPLING RANGE: 0-335)

(FIG. 50 CONTINUED)
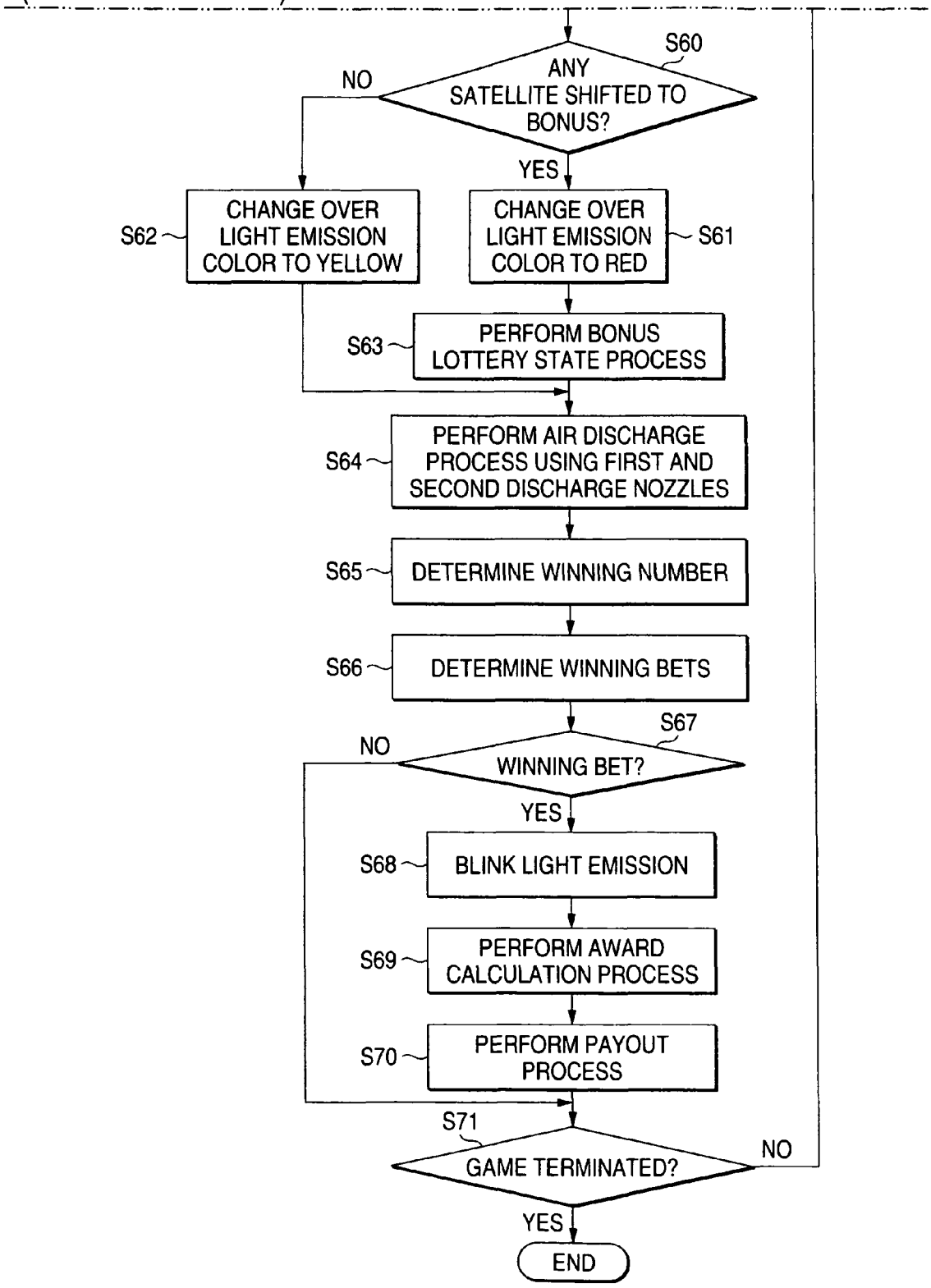

ROULETTE APPARATUS AND ROULETTE GAMING MACHINE

RELATED APPLICATIONS

The present application is a Divisional application of U.S. patent application Ser. No. 11/202,355 filed Aug. 12, 2005 now abandoned.

CROSS-REFERENCE TO THE RELATED APPLICATION(S)

The present application is based upon and claims a priority from a prior Japanese Patent Applications of: 1) No. 2004-236595 filed on Aug. 16, 2004; 2) No. 2004-242750 filed on Aug. 23, 2004; and 3) No. 2004-242761 filed on Aug. 23, 2004, the entire contents of which are incorporated herein by reference.

BACKGROUND OF THE INVENTION

1. Field of the Invention

The present invention relates to a roulette apparatus allowing a ball to roll thereon and having a plurality of ball reception members separated from one another and for receiving the rolling ball at predetermined timing, and relates to a roulette gaming machine that performs a game in which a ball is rolled on the roulette wheel.

2. Description of the Related Art

In a so-called medal game such as a roulette gaming machine using a roulette wheel, medals are used as game media. The medal game is a game in which a player purchases or borrows a plurality of medals in a medal borrowing machine, and the medals are inserted into a medal insertion slot of the game machine to start a game. When a player wins the game, a predetermined number of medals are paid out. Thus, a player who has acquired a large number of medals can enjoy games continuously without purchasing or borrowing new medals.

Here, particularly in the roulette gaming machine, the player selects one of symbols (or numbers) disposed on the roulette wheel. Then, the roulette wheel rotates, and a ball thrown therein rolls on the roulette wheel. When the rotation of the roulette wheel becomes so weak that the ball is received and held in one of ball reception members (grooves) in the roulette wheel, it is determined whether the symbol (number) selected by the player matches (is placed on) the symbol (number) where the ball is received, or not. When it is concluded that the ball is received and held in the reception portion with the same symbol (win), medals are paid out to the player at a predetermined payout rate.

In the related art, a roulette wheel for use in such a roulette gaming machine is required to have a rolling region where a ball rolls, and ball reception members which are separated in accordance with symbols (numbers) and in one of which the ball rolling in the rolling region will be finally received. For example, JP-A-8-229191 discloses a roulette wheel formed out of a fixed wheel which is not rotatable relatively to a body, and a rotatable wheel which is rotatable relatively to the fixed wheel. The rotatable wheel to be rotated by a motor provided in the body is provided with a large number of concave ball reception members. Numbers "1" to "8" corresponding to prize numbers and numbers "0" different from the prize numbers are provided equally on the ball reception members respectively.

In the related art, the roulette gaming machine has a ball recovery mechanism for once recovering the ball from the roulette wheel. The ball used in the last game and recovered thus is launched onto the roulette wheel. The ball once recovered by the ball recovery mechanism is always thrown in one and the same state with respect to the roulette wheel. For example, JP-A-8-229191 discloses a roulette gaming machine as follows. That is, ball pass holes are formed in ball reception members on a rotatable wheel respectively, while a flange for closing the ball pass holes is formed on a fixed wheel. A notch portion is formed in a part of the flange. An opening/closing plate for opening/closing the notch portion in accordance with drive of a solenoid is provided in the notch portion. The notch portion is opened to recover the ball. Thus, the ball is dropped from the wheel without providing any mechanism to lift up the rotatable wheel, so that a bucket can be miniaturized.

In the related art, only one gaming mode is provided in a roulette apparatus for performing a lottery in the aforementioned roulette gaming machine. That is, as disclosed in JP-A-8-229191, an operation in which a ball rotates on a roulette wheel for a predetermined time and is received in one of ball reception members is merely repeated. Further, in recent years, there is a tendency to reduce movable portions as much as possible for the sake of saving of the cost, easiness of maintenance, and so on. For example, there is a roulette apparatus in which gaming is performed without rotating a roulette wheel but with rotating only a ball.

SUMMARY OF THE INVENTION

In the roulette wheel disclosed in JP-A-8-229191, however, the rotatable wheel and the ball reception members are formed integrally. The ball reception members have to be separated in accordance with the symbols (numbers) so that the rolling ball is received in one of the ball reception members. It is therefore necessary to form a large number of partition walls for partitioning the reception regions. Accordingly, the rotatable wheel has to be molded in accordance with its complicated shape, so that the manufacturing cost increases.

In addition, the partition walls for partitioning the reception regions are members that are worn very easily due to collision with the ball. That is, due to repeated collision with the ball with long-term use, there may occur irregularities in the surfaces of the partition walls, or painting applied thereto may peel off. In such an event, in the related-art roulette wheel having the partition walls formed integrally with the rotatable wheel, the rotatable wheel as a whole has to be replaced by a new one in order to replace the partition walls. Accordingly, the maintenance is inefficient, and a roulette wheel having a novel structure to solve such a problem has been desired.

In the roulette gaming machine disclosed in JP-A-8-229191, a complicated mechanism to retain the ball recovered from the wheel and shoot the ball onto the wheel again has to be provided under the wheel.

In addition, each ball reception member needs a movable portion such as a shutter for opening/closing the ball pass hole. Accordingly, the cost is increased, and it is highly likely that a game may be stopped due to a failure or the like in the movable portion. Further, the maintenance work of the equipment becomes troublesome. Since a ball pass hole has to be formed in each ball reception member, the ball reception member is required to have at least a predetermined depth so that a part of the ball received in the ball reception member sinks into the wheel. On the other hand, a launching hole for shooting the recovered ball onto the roulette wheel has to be formed in the wheel. Thus, the wheel is required to have at least a predetermined height.

The ball recovered thus is typically thrown in by a ball launcher provided on or inside the wheel. However, the ball is always thrown in from one and the same place in one and the same direction. Accordingly, little change can be observed in the rolling state of the ball in any game. When games are played for a long time, the games become unvaried to bore players therewith.

In the roulette apparatus disclosed in JP-A-8-229191, other motions than the rolling motion of the ball are so scarce that functions of stage effects for players are lowered. That is, since a mechanical lottery operation is repeated simply, players' feeling of expectation or players' feeling of tension with a result of a lottery declines. Thus, the gaming becomes unvaried enough to bore the players therewith.

In addition, a bet time in which each player performs an operation to select symbols and a lottery time in which a lottery is held using a ball in the roulette apparatus are separated in the roulette gaming machine. However, a new player who wants to take part in a game cannot confirm the current state of progress of the game unless the new player comes close to the roulette gaming machine actually. This work is troublesome. It is therefore desired to provide an informing unit for informing persons even in the distance of the current state of progress of a game in the roulette gaming machine.

The present invention provides at least one of:

(1) A roulette wheel in which ball reception members are formed separately and provided removably so that the roulette wheel can be molded easily in spite of its complicated shape with separation walls for defining reception portions for receiving a ball, while the separation walls which are easy to be worn can be repaired by replacing only the ball reception members with new ones, so that the maintenance work can be performed easily and efficiently.

(2) A roulette apparatus in which the compressed air discharged to a ball allows the ball to roll repeatedly without recovering the ball from the roulette wheel, so that any complicated mechanism such as a movable portion for recovering the ball or a launcher for launching the ball is not required, the maintenance work becomes easy and the equipment cost can be reduced.

(3) A roulette apparatus in which the discharge direction of the air can be changed over between different directions so as to bring the ball into a wide variety of rolling states and thereby prevent players from being bored.

(4) A roulette apparatus and a roulette gaming machine using the roulette apparatus, in which a roulette wheel is illuminated in various modes in accordance with the progress of a game so that novel stage effects using the illumination of the roulette wheel can be exhibited, and players' feeling of expectance or players' feeling of tension with a result of a lottery can be enhanced, while persons even in the distance are informed of the current state of progress of the game so that the convenience of gaming can be improved.

According to a first aspect of the invention, there is provided a roulette apparatus including: a roulette wheel having a rolling region where a ball rolls; and a ball reception member provided contiguously to the rolling region to receive the ball, wherein the ball reception member includes: a plurality of reception portions that receives the ball in one of the reception portions; and a plurality of separation walls that separates the reception portions from one another, wherein the ball reception member is formed separately from the roulette wheel and removably attached to the roulette wheel.

According to a second aspect of the invention, there is provided a roulette apparatus including: a roulette wheel having a rolling region where a ball rolls; a ball reception member provided contiguously to the rolling region to receive the ball and having a plurality of reception portions arranged in circumferential direction of the roulette wheel and receive the ball in one of the reception portions, each of the reception portions being provided with a symbol that identifies each of the reception portions from one another; a banked passageway that is provided on an outer circumferential edge of the roulette wheel and on which the ball rolls in a circular orbit; a compressor that compresses air; a launching discharge nozzle that is provided in the ball reception member and discharges the air compressed by the compressor toward the banked passageway; a first rotating discharge nozzle that is provided in the banked passageway and discharges the air compressed by the compressor in a first direction along a circumferential direction of the banked passageway; a second rotating discharge nozzle that is provided in the banked passageway and discharges the air compressed by the compressor in a second direction along a circumferential direction of the banked passageway and opposite to the first direction; and a discharge switching unit that switches the discharge of the air compressed by the compressor between the first rotating discharge nozzle and the second rotating discharge nozzle.

According to a third aspect of the invention, there is provided a roulette apparatus including: a roulette wheel having a rolling region where a ball rolls; a ball reception member provided contiguously to the rolling region to receive the ball and having a plurality of reception portions arranged in circumferential direction of the roulette wheel and receive the ball in one of the reception portions, each of the reception portions being provided with a symbol that identifies each of the reception portions from one another; a game providing unit that provides to a user a roulette game in which one game is performed by allowing the ball to be received in one of the ball reception members after rolling the ball on the roulette wheel for a predetermined time period, and the game is repeatedly performed; an illumination unit that illuminates the roulette wheel with a plurality of light emission colors; and an illumination control unit that controls the illumination unit to turn on and off and to change the light emission colors in accordance with progress of the game performed by the game providing unit.

According to a fourth aspect of the invention, there is provided a roulette gaming machine including: a roulette wheel having a rolling region where a ball rolls; a ball reception member provided contiguously to the rolling region to receive the ball and having a plurality of reception portions arranged in circumferential direction of the roulette wheel and receive the ball in one of the reception portions, each of the reception portions being provided with a symbol that identifies each of the reception portions from one another; a game providing unit that provides to a user a roulette game in which one game is performed by allowing the ball to be received in one of the ball reception members after rolling the ball on the roulette wheel for a predetermined time period, and the game is repeatedly performed; an illumination unit that illuminates the roulette wheel with a plurality of light emission colors; an illumination control unit that controls the illumination unit to turn on and off and to change the light emission colors in accordance with progress of the game performed by the game providing unit; a betting unit that allows a player to bet a chip on which of the reception portions the ball is received in each of the game; a chip payout unit that pays out chips to the player in accordance with a result of the game, wherein the game providing unit provides a bonus gaming state in which more advantageous condition than that in a base gaming state for the player under predetermined condition, and wherein the illumination control unit controls the illumination unit to emit light in a mode different from that in the base gaming state when the bonus gaming state occurs.

BRIEF DESCRIPTION OF THE DRAWINGS

In the accompanying drawings:

FIG. 44 is an explanatory diagram showing a bonus lottery pattern table;

DETAILED DESCRIPTION OF THE PREFERRED EMBODIMENTS

First Embodiment

A roulette gaming machine 1 having a roulette apparatus including a roulette wheel according to the invention will be described below in detail and with reference to the drawings based on a first embodiment bringing the invention into shape.

The roulette gaming machine 1 according to the first embodiment is a game machine configured as follows. That is, a player guesses a number or the like which will be decided by a roulette apparatus 2, and bets the player's own game media such as medals on the guessed number or the like. When the bet number or the like is hit, the player receives payout of a predetermined number of medals.

Figure 1:
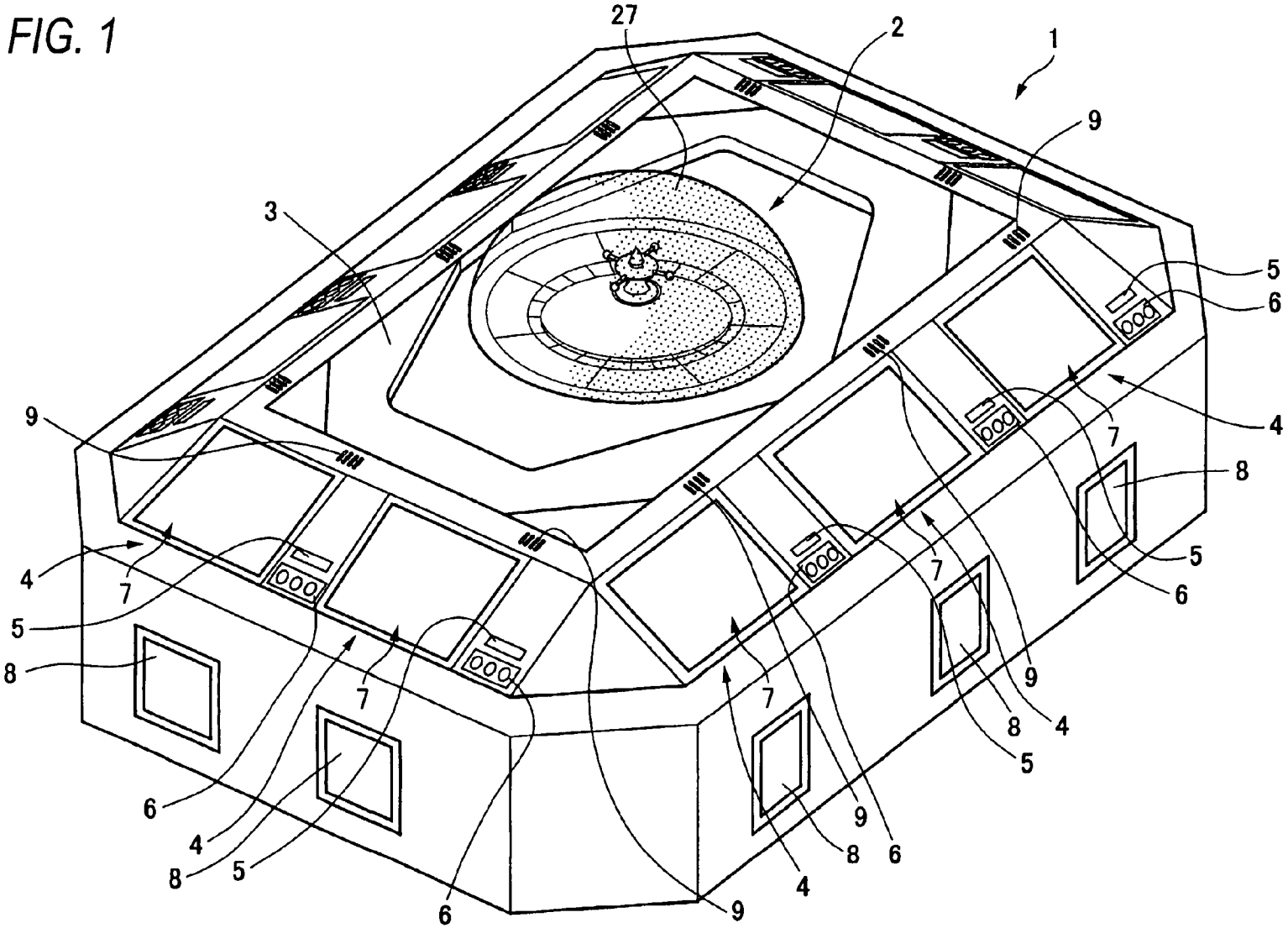
FIG. 1 is an outside perspective view showing a schematic configuration of a roulette gaming machine according to a first embodiment.

First, description will be made on the schematic configuration of the roulette gaming machine 1 according to the first embodiment with reference to FIG. 1. FIG. 1 is an outside perspective view showing the schematic configuration of the roulette gaming machine according to the first embodiment.

As shown in FIG. 1, the roulette gaming machine 1 includes a cabinet 3 serving as a body portion, a roulette apparatus 2 provided in an approximately central portion of the top of the cabinet 3, and a plurality (ten in the embodiment) of satellites 4 placed around the roulette apparatus 2 so as to surround the roulette apparatus 2.

Here, each satellite 4 is a game region including at least a medal insertion slot 5, a control portion 6 and an image display device 7. Game media such as coins or medals to be used in games are inserted into the medal insertion slot 5. The control portion 6 is provided with a plurality of control buttons etc. through which a player inputs predetermined instructions. Images concerned with games are displayed on the image display device 7. The player operates the control portion 6 or the like while viewing the images displayed on the image display device 7. Thus, the player makes progress with the games to be developed. Specifically, through the satellite 4, the player guesses a result (a number displayed in the portion where the rolling ball will be received finally) of a game played on the roulette apparatus 2 and operates the control portion 6 or the like so as to bet (gamble) medals on a number the play guesses to be hit.

Medal payout openings 8 are provided in the side surfaces of the cabinet 3 where the satellites 4 are placed, respectively. Further, a speaker 9 for playing music, sound effects, etc. is provided on the upper right of the image display device 7 of each satellite 4.

A medal sensor (not shown) is provided inside each medal insertion slot 5 so as to identify game media such as medals inserted through the medal insertion slot 5 and count the inserted medals. On the other hand, a hopper (not shown) is provided inside each medal payout opening 8 so as to pay out a predetermined number of medals from the medal payout opening 8.

Figure 2:
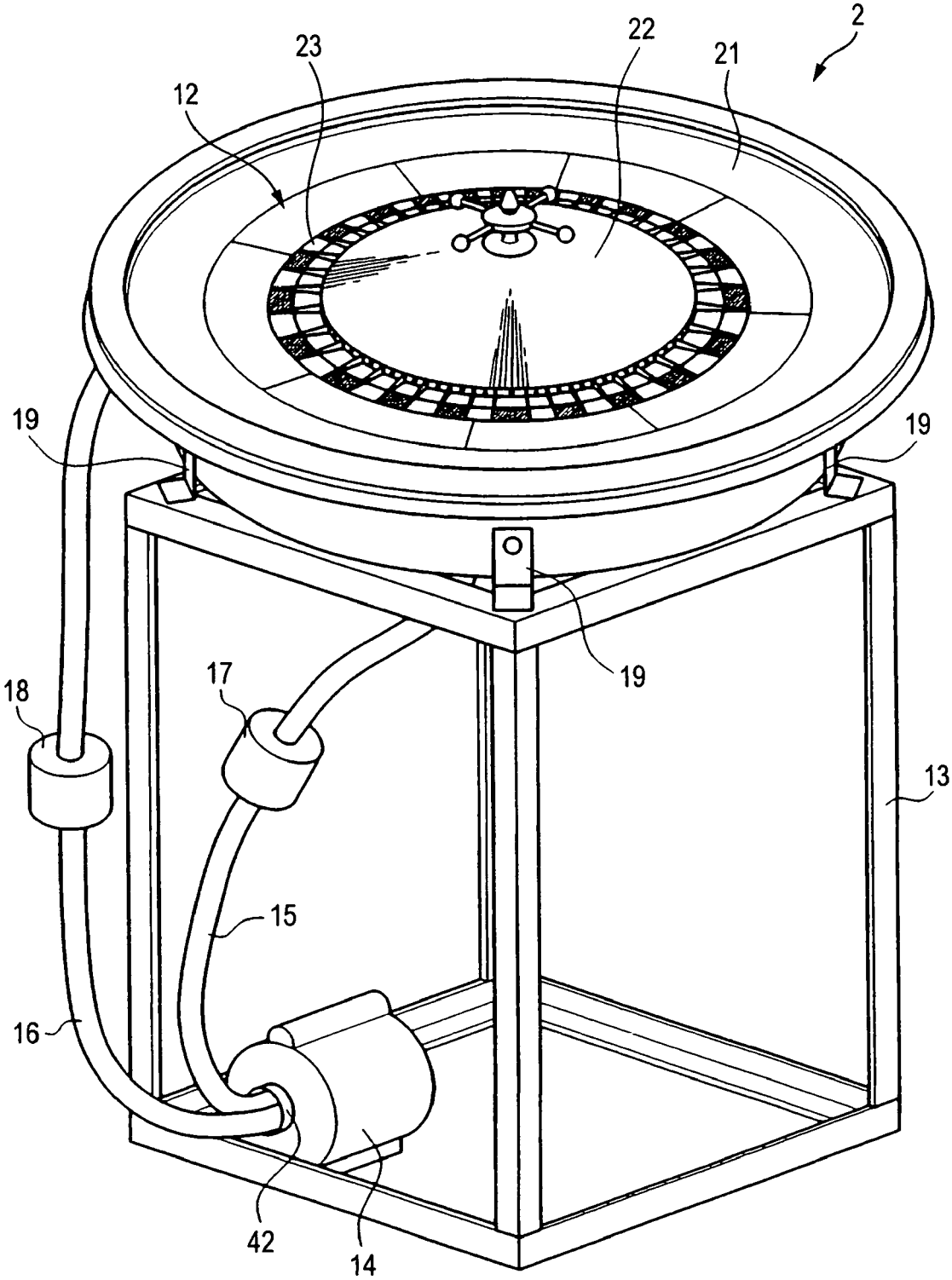
FIG. 2 is a perspective view showing a roulette apparatus according to the first embodiment.

Next, the basic configuration of the roulette apparatus 2 according to the embodiment will be described with reference to FIG. 2. FIG. 2 is a perspective view showing the roulette apparatus according to the first embodiment.

As shown in FIG. 2, the roulette apparatus 2 is provided with a roulette wheel 12, a support table 13, a compressor 14, air tubes 15 and 16, a first on-off valve 17 and a second on-off valve 18. The roulette wheel 12 has a rolling region where a ball 11 rolls during a game. The support table 13 supports the roulette wheel 12 at a predetermined height inside the roulette gaming machine 1 by means of fixing parts 19. The compressor 14 takes in the ambient air and compresses the air into predetermined pressure. The air compressed by the compressor 14 is sent through the tubes 15 and 16. The first and second on-off valves 17 and 18 are provided in approximately halfway points of the air tubes 15 and 16 respectively so as to adjust the pressure of the air flowing in the air tubes 15 and 16. Here, the air adjusted by the first and second on-off valves 17 and 18 and flowing through the air tubes 15 and 16 is discharged onto the roulette wheel 12 so as to roll the ball 11 in the roulette wheel 12 as will be described later.

The support table 13 is a table formed into an approximately rectangular shape by a combination of a plurality of pillars made of metal. The support table 13 fixes the roulette wheel 12 at a predetermined height by means of the fixing parts 19 provided at a total of four places in the corner portions of the top of the support table 13.

The compressor 14 is disposed in an internal space formed by the support table 13. The compressor 14 is a device for taking in the ambient air and compressing the air into predetermined pressure (1 MPa in the embodiment). The compressor 14 according to the embodiment has two discharge nozzles 42 for discharging the compressed air. The air tubes 15 and 16 are connected to the discharge nozzles 42 respectively.

The air tubes 15 and 16 are tubes through which the air compressed by the compressor 14 is conveyed to first discharge nozzles 35 and second discharge nozzles 36 (see FIG. 3) formed in the roulette wheel 12 respectively. The first and second openings 35 and 36 will be described later. The first on-off valve 17 and the second on-off valve 18 are provided in the halfway points of the air tubes 15 and 16 respectively.

The first on-off valve 17 and the second on-off valve 18 are electromagnetic valves each having a structure by which the valve opening time is adjusted. The first on-off valve 17 and the second on-off valve 18 are connected to a control portion of the roulette gaming machine 1. The control portion controls the on/off times of the first and second on-off valves 17 and 18 in accordance with a program stored in advance. Thus, the air pressures discharged from the first and second discharge nozzles 35 and 36 are adjusted to perform a series of operations to roll the ball 11 on the roulette wheel 12 and receive the ball 11 in one of below-mentioned ball reception members 23 after a predetermined time has passed.

When the roulette apparatus 2 is installed in the roulette gaming machine 1, the roulette wheel 12 is wholly covered with a hemispheric glass cover member 27 from above (see FIG. 1). Thus, the ball 11 rolling on the roulette wheel 12 during a game is held not to jump out from the roulette wheel 12. In addition, foreign matters are prevented from entering the roulette wheel 12 in order to prevent act of dishonesty and cheating.

Figure 3:
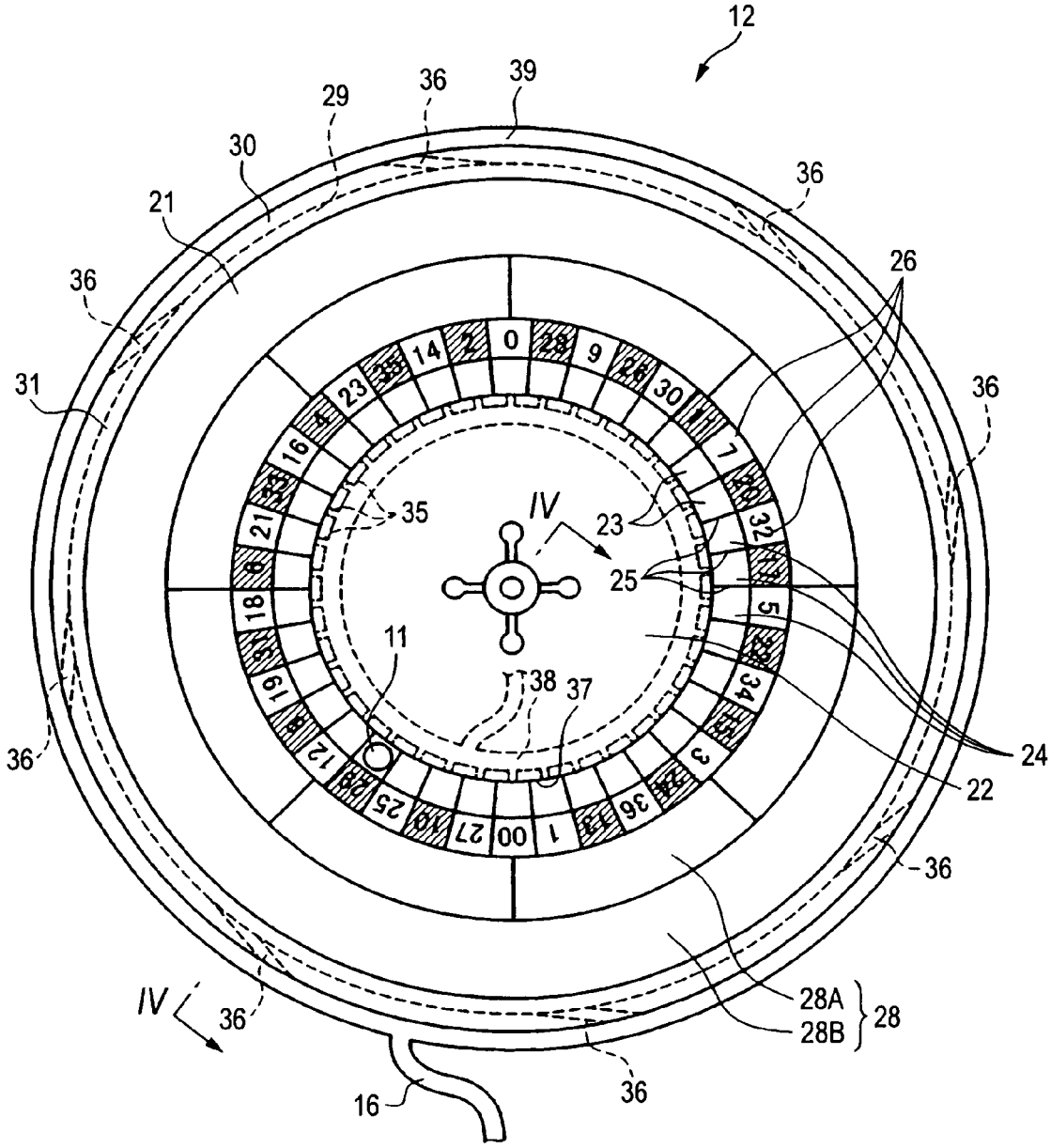
FIG. 3 is a plan view showing the roulette apparatus according to the first embodiment.
Figure 4:
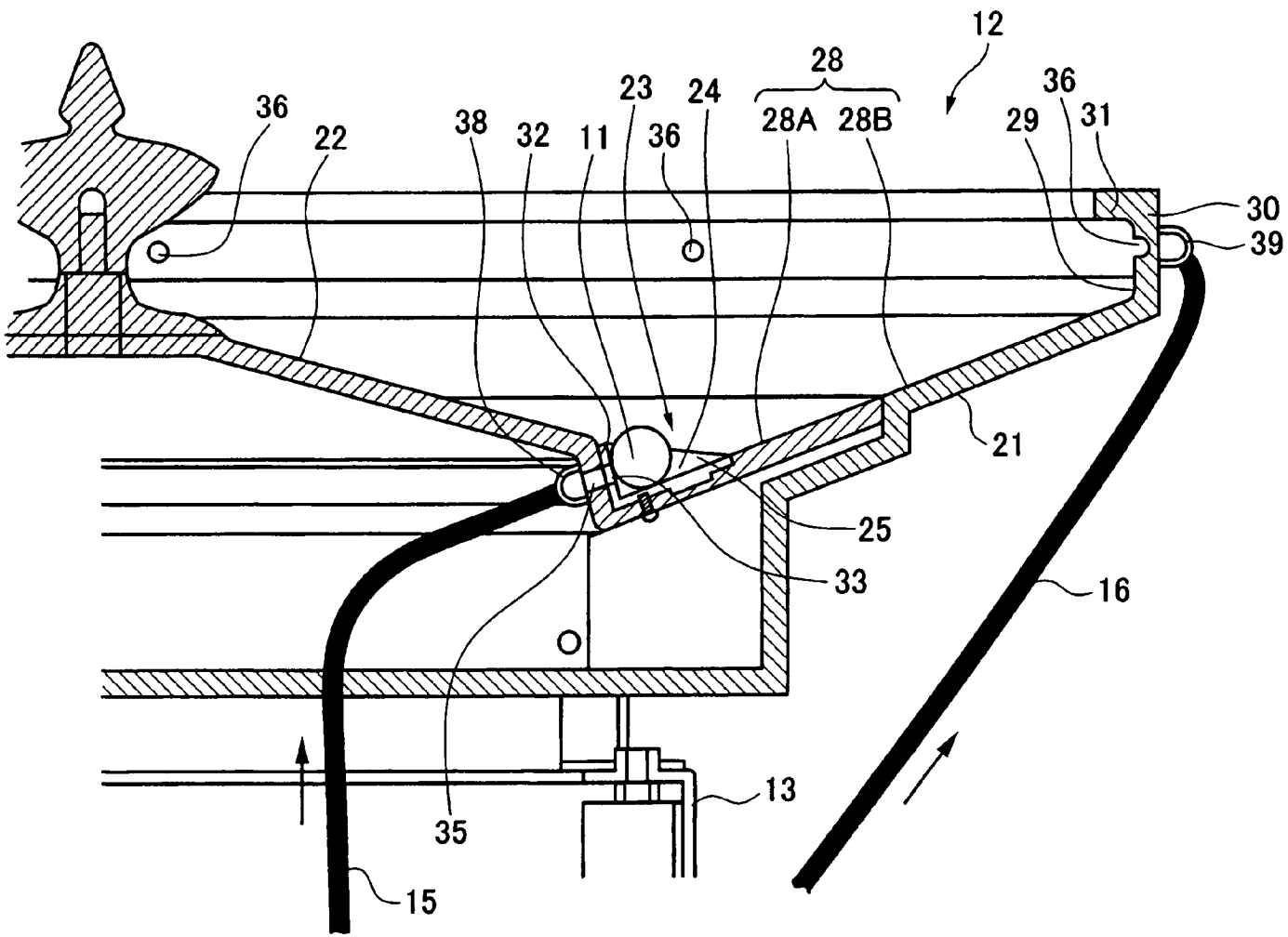
FIG. 4 is a sectional view of the roulette apparatus taken on line IV-IV in FIG. 3.
Figure 5:
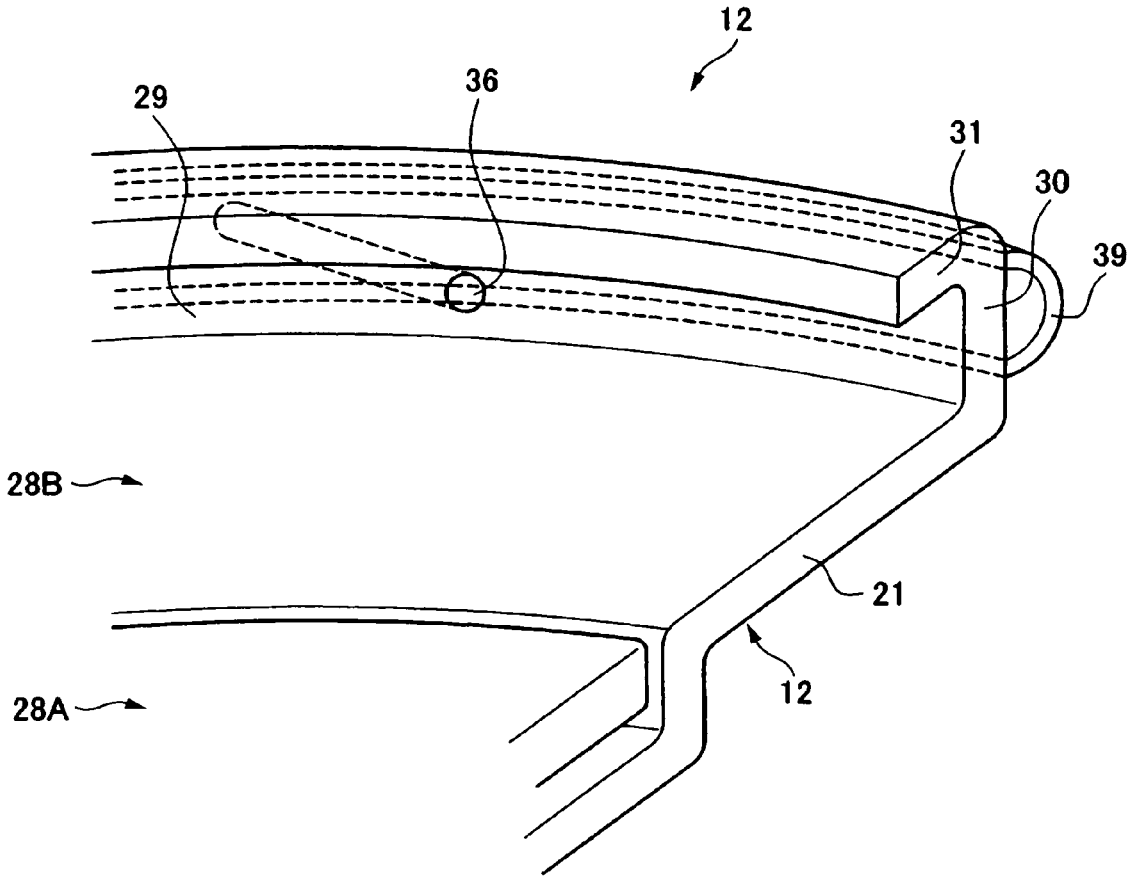
FIG. 5 is an enlarged perspective view showing the vicinity of a banked passageway of the roulette apparatus according to the first embodiment.
Figure 6:
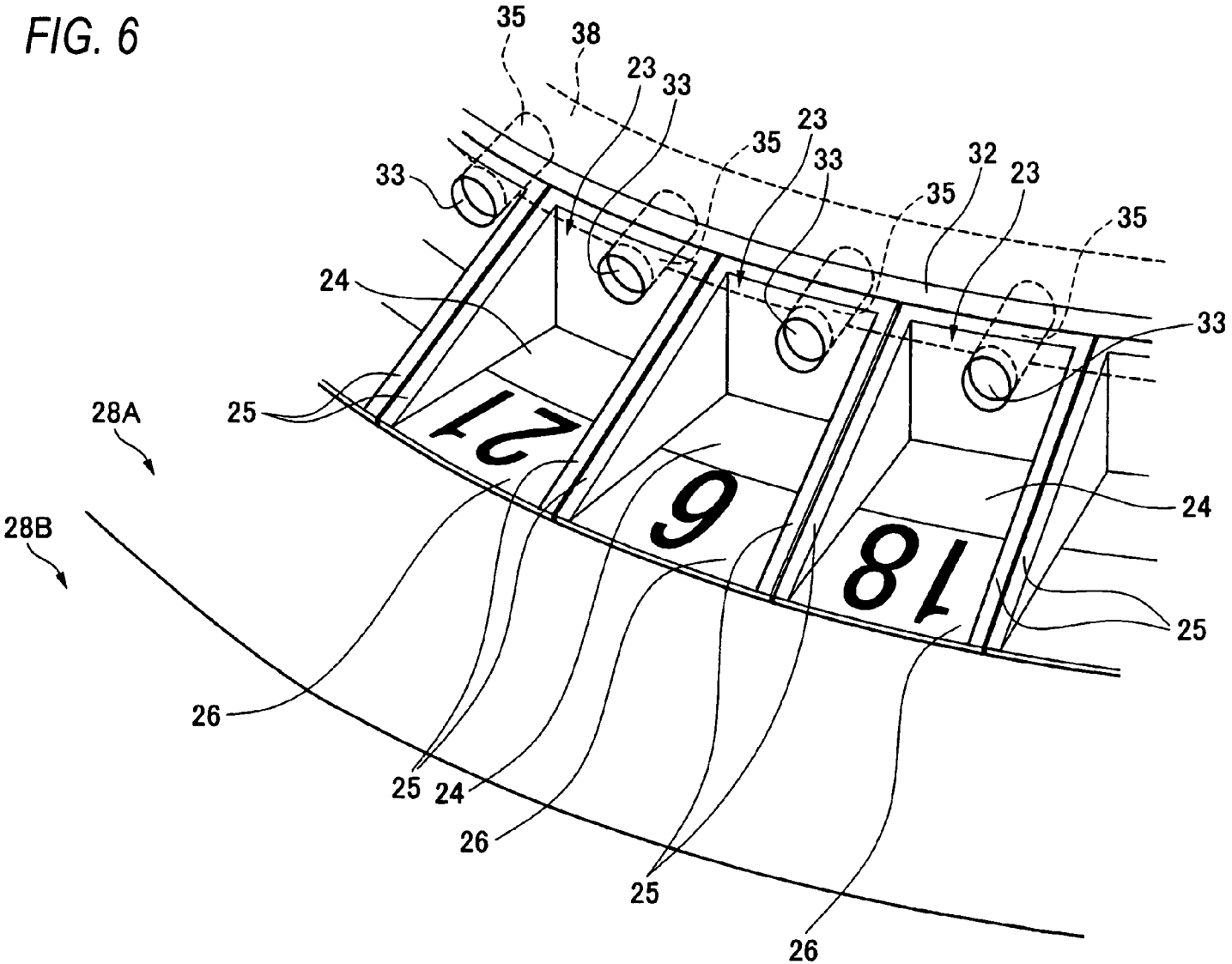
FIG. 6 is an enlarged perspective view showing the vicinity of a ball reception member of the roulette apparatus according to the first embodiment.
Figure 7:
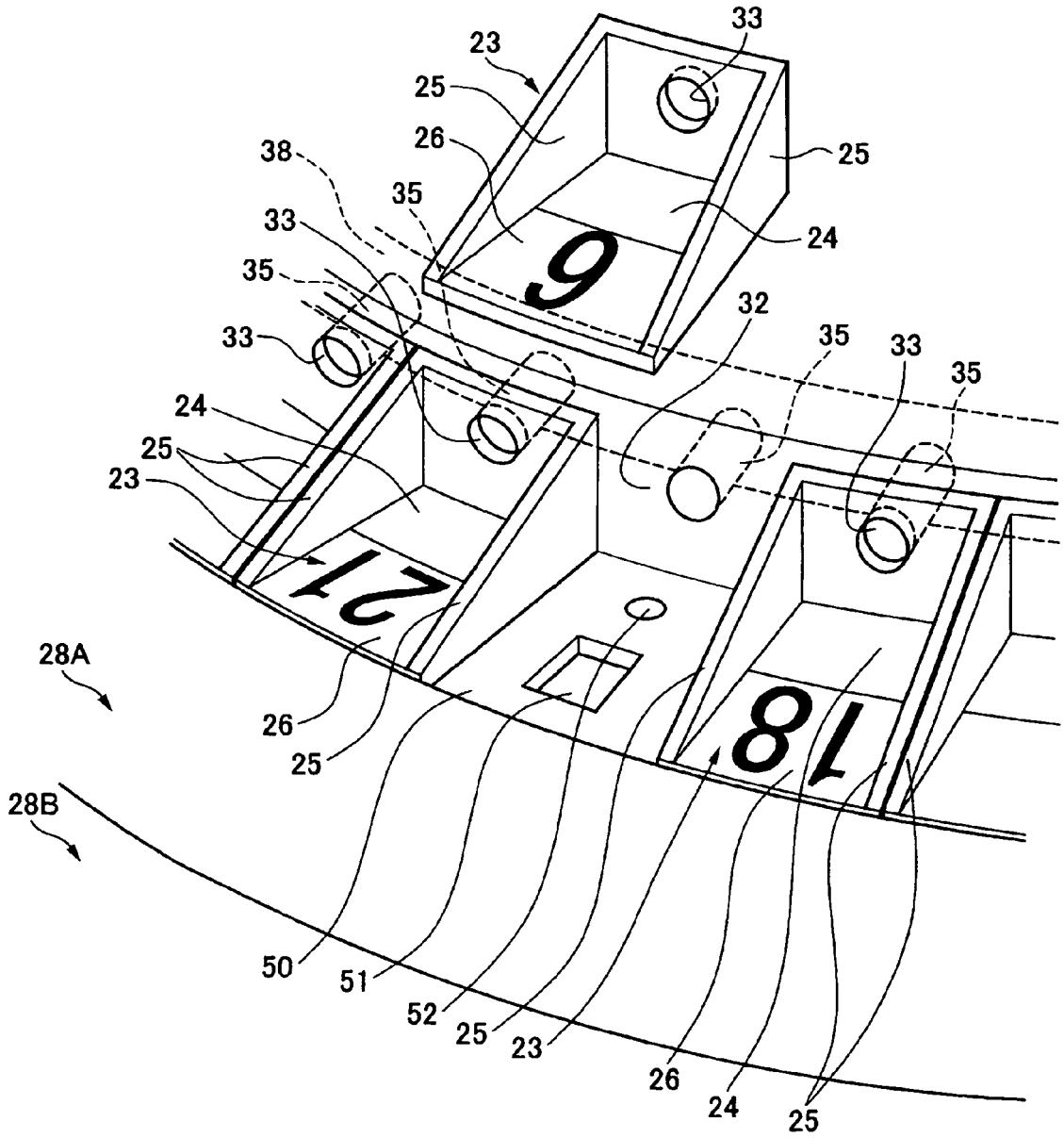
FIG. 7 is an enlarged perspective view showing the vicinity of the ball reception member in the state where the ball reception member has been removed.

Subsequently the roulette wheel 12 according to the embodiment will be described with reference to FIGS. 3 to 7. FIG. 3 is a plan view showing the roulette wheel according to the embodiment, and FIG. 4 is a sectional view of the roulette wheel taken on line IV-IV in FIG. 3. FIG. 5 is an enlarged perspective view showing the vicinity of a banked passageway of the roulette wheel according to the embodiment. FIG. 6 is an enlarged perspective view showing the vicinity of ball reception members of the roulette wheel according to the embodiment. FIG. 7 is an enlarged perspective view showing the vicinity of the ball reception members of the roulette wheel in the state where one of the ball reception members has been removed.

The roulette wheel 12 is provided with a frame 21 fixed to the support table 13, and a rotary disc 22 rotatably received and supported inside the frame 21, as shown in FIGS. 3 and 4.

Ball reception members 23 are provided circumferentially on the top of the rotary disc 22. The ball reception members 23 have a plurality of reception regions defined in a plurality of places. The ball 11 rolling on the roulette wheel 12 will be received in one of the reception regions finally.

Here, the ball reception members 23 according to the embodiment are divided into a total of 38 correspondingly to reception portions 24 capable of receiving the ball, and formed separately from the rotary disc 22 (see FIGS. 6 and 7). Each divided ball reception member 23 has one reception portion 24 partitioned by separation walls 25. Further, each ball reception member 23 is provided with a number indication portion 26 where one of numbers "0", "00" and "1" to "36" is indicated as a graphic character corresponding to each reception portion 24 (see FIG. 8). Here, the number (one of the numbers "0", "00" and "1" to "36") indicated in the ball reception member 23 having the reception portion 24 where the ball 11 is received in a game is a winning number in the game. When the number selected through the satellite 4 by the player coincides with the winning number, a predetermined number of medals are paid out from the medal payout opening.

Further, in the roulette wheel 12 according to the embodiment, each ball reception member 23 is not only formed separately from the rotary disc 22 but also provided to be removable. Thus, each ball reception member 23 may be replaced individually. The details of the ball reception member 23 will be described in details later.

The rolling region where the ball 11 rolls actually on the roulette wheel 12 during a game is provided with a slope 28 formed out of the frame 21 and the rotary disc 22, and a banked passageway 29 formed integrally with the slope 28 as will be described later. The slope 28 is formed out of a first slope 28A and a second slope 28B. The first slope 28A is formed on the inner circumferential edge side of the frame 21, and the second slope 28B is formed on the outer circumferential edge side of the rotary disc 22. The slope 28 is inclined at a predetermined angle (20 degrees in the embodiment) to sink from the outer circumference of the roulette wheel 12 toward the center thereof. The ball reception members 23 and the below-mentioned banked passageway 29 are formed contiguously through the slope 28.

On the other hand, the banked passageway 29 is provided circumferentially in the outer circumferential edge portion of the frame 21. The banked passageway 29 is a passageway to guide the ball 11 rolling on the roulette wheel 12 against the centrifugal force thereof so as to roll the ball 11 in a circular orbit. The banked passageway 29 is formed to be endless with respect to the roulette wheel 12 due to a guide wall 30 erected vertically in the outer circumference of the roulette wheel 12. Further, a wall portion 31 is formed contiguously to the banked passageway 29 in the upper end of the guide wall 30. The wall portion 31 is a prevention member provided for preventing the ball 11 rotating on the banked passageway 29 from jumping out from the roulette wheel 12.

When the ball 11 is to be rolled on the roulette wheel 12 configured thus, first, the air compressed by the compressor 14 is discharged from the first and second discharge nozzles 35 and 36 which will be described later. The ball 11 accelerated by the discharged air begins to roll on the slope 28. After that, the ball 11 gradually increasing in velocity begins to rotate along the banked passageway 29 due to the centrifugal force. When the discharge of the air from the first and second discharge nozzles 35 and 36 is stopped, the rotational velocity of the ball 11 becomes so weak that the ball 11 loses the centrifugal force. Thus, the ball 11 rolls down on the slope 28 toward the inner side of the roulette wheel 12, and reaches the rotary disc 22 which is rotating.

The ball 11 rolling onto the rotary disc 22 is received in the reception portion 24 of one of the ball reception members 23 provided in the rotary disc 22 which is rotating. Thus, the number indicated in the number indication portion 26 of the ball reception member 23 where the ball 11 has been received becomes a winning number.

A ball detection sensor (not shown) for detecting which ball reception member 23 has received the ball 11 is provided in the roulette wheel 12. The ball detection sensor is a photosensor capable of detecting an object when the object is present within a predetermined distance. The ball detection sensor is provided with a light emitting device and a light receiving device. When the ball 11 enters one of the ball reception members 23, the existence of the ball 11 is detected by the ball detection sensor, and the winning number is determined by the control portion of the roulette gaming machine 1.

Next, the first discharge nozzles 35 and the second discharge nozzles 36 provided in the roulette wheel 12 will be described with reference to FIGS. 5 and 6. Here, the roulette apparatus 2 according to the embodiment uses the air pressure of the compressed air as its power source for rolling the ball 11 on the roulette wheel 12. Specifically, the ambient air is taken in and compressed to a predetermined pressure (e.g. 1 MPa) by the compressor 14 (see FIG. 2) provided under the roulette apparatus 2. The compressed air is conveyed to the roulette wheel 12 through the air tubes 15 and 16. The air is discharged from the first and second discharge nozzles 35 and 36 so as to apply the air pressure to the ball 11 in the roulette wheel 12.

As shown in FIGS. 6 and 7, the first discharge nozzles 35 are formed in an inner side wall 32 of the rotary disc 22 correspondingly to the ball reception members 23. One side of each ball reception member 23 abuts against the inner wall 32. In this embodiment, 38 ball reception members 23 corresponding to the numbers "0", "00" and "1" to "36" are placed on the roulette wheel 12. Therefore, the first discharge nozzles 35 are formed at a total of 38 places. Each first discharge nozzle 35 is formed from the center of the roulette wheel 12 toward the periphery thereof. The air discharged from each first discharge nozzle 35 is discharged toward the banked passageway 29 provided in the outer circumferential edge portion of the roulette wheel 12, through a pass hole 33 (see FIGS. 8 and 9) formed in the ball reception member 23.

On the other hand, an annular launching air pipe 38 is placed in the back side surface of the inner wall side 32 where the first discharge nozzles 35 are formed. The launching air pipe 38 is connected to the air tube 15, and the outer periphery of the launching air pipe 38 is connected to the first discharge nozzles 35. Accordingly, the air conveyed through the air tube 15 once flows into the launching air pipe 38. After that, the air is discharged into the reception portions 24 of the ball reception members 23 all at once through the first discharge nozzles 35 provided at 38 places. Due to the air pressure of the discharged air, the ball 11 having been received in one of the reception portions 24 of the ball reception members 23 begins to roll toward the banked passageway 29 against the inclination of the slope 28.

The second discharge nozzles 36 are formed at predetermined intervals (at intervals of 45 degrees in the embodiment) in the guide wall 30 forming the banked passageway 29 as shown in FIG. 5. Each second discharge nozzle 36 is formed to look in the circumferential direction of the banked passageway 29, that is, in the tangential direction of the roulette wheel 12. The air discharged from each second discharge nozzle 36 forms a layer of the air flowing clockwise along the banked passageway 29 of the roulette wheel 12.

On the other hand, an annular rotating air pipe 39 is placed in the back side surface of the guide wall 30 where the second discharge nozzles 36 are formed. The rotating air pipe 39 is connected to the air tube 16. The air conveyed through the air tube 16 flows into the rotating air pipe 39. The air is discharged all at once through the second discharge nozzles 36 provided at 8 places. As a result, the ball 11 having been rolled toward the banked passageway 29 by the air discharged from the first discharge nozzles 35 begins to roll clockwise due to an annular layer of the air flowing along the banked passageway 29.

When the discharge of the air from the second discharge nozzles 36 is stopped, the layer of the air having flowed along the banked passageway 29 disappears. Thus, the rotational velocity of the ball 11 which is no longer urged by the air pressure is weakened gradually so that the ball 11 loses the centrifugal force. After that, the ball 11 rolls down to the inner side of the roulette wheel 12 along the inclination of the slope 28, and reaches the rotary disc 22 which is rotating. Then, the ball 11 is received in one of the ball reception members 23 placed on the rotary disc 22. Thus, the winning number is decided by the roulette apparatus 2, and the roulette gaming machine 1 pays out medals based on the decided number and the bet information as to which number each player has bet on. Then, the game is terminated.

Further, when the air is discharged from the first discharge nozzles 35 after that, the ball 11 received in the ball reception member 23 begins to roll again. Thus, the next game is played continuously.

In such a manner, a force is applied to the ball 11 due to the air pressure of the air discharged from the first and second discharge nozzles 35 and 36 so that rolling the ball 11 and receiving the ball 11 in one of the ball reception members 23 is performed repeatedly without recovering the ball 11 from the roulette wheel 12. Accordingly, it is not necessary to provide any complicated mechanism such as a movable portion for recovering the ball 11 or a launcher for launching the ball 11, but the maintenance work can be made easier and the equipment cost can be reduced.

Next, description will be made on the ball reception members 23 placed on the roulette wheel according to this embodiment, and a step portion 50 where the ball reception members will be placed. The ball reception members 23 are reception portions which are divided and one of which will finally receive the ball 11 rolling on the slope 28 and the banked passageway 29. As for the ball reception members 23 according to the embodiment, 38 ball reception members 23 are partitioned and formed correspondingly to the reception portions 24 defined in 38 places by the separation walls 25, as shown in FIGS. 6 and 7. Further, the ball reception members 23 are formed separately without being integrated with the rotary disc 22, and removably attached to the rotary disc 22.

On the other hand, a step portion 50 formed into a recess corresponding to the thickness of the bottom wall 40 (see FIGS. 8 and 9) of each ball reception member 23 with respect to a slope 28A is provided circumferentially in the rotary disc 22 as shown in FIG. 7. Further, the step portion 50 is provided with an engaged portion 51 and a tapped hole 52. The engaged portion 51 is engaged with a below-mentioned engagement portion 55 formed in the ball reception member 23, so as to position the ball reception member 23 in the step portion 50. Each engaged portion 51 has a substantially rectangular shape slightly larger than each engagement portion 55. When the engagement portion 55 is brought into engagement with the engaged portion 51, the ball reception member 23 is positioned in the step portion 50. Although a game is playable in this state, each ball reception member 23 is more surely fixed to the rotary disc 22 by fixation with a screw 60 through the tapped holes 52 and 56 (see FIGS. 10 and 11).

In FIG. 7, only the step portion 50 where the ball reception member 23 with the number "6" indicated in the number indication portion 26 is shown by way of example. However, the step portion 50, the engaged portion 51 and the tapped hole 52 are formed in the rotary disc 22 correspondingly to the installation position of each of the 38 ball reception members 23.

Figure 8:
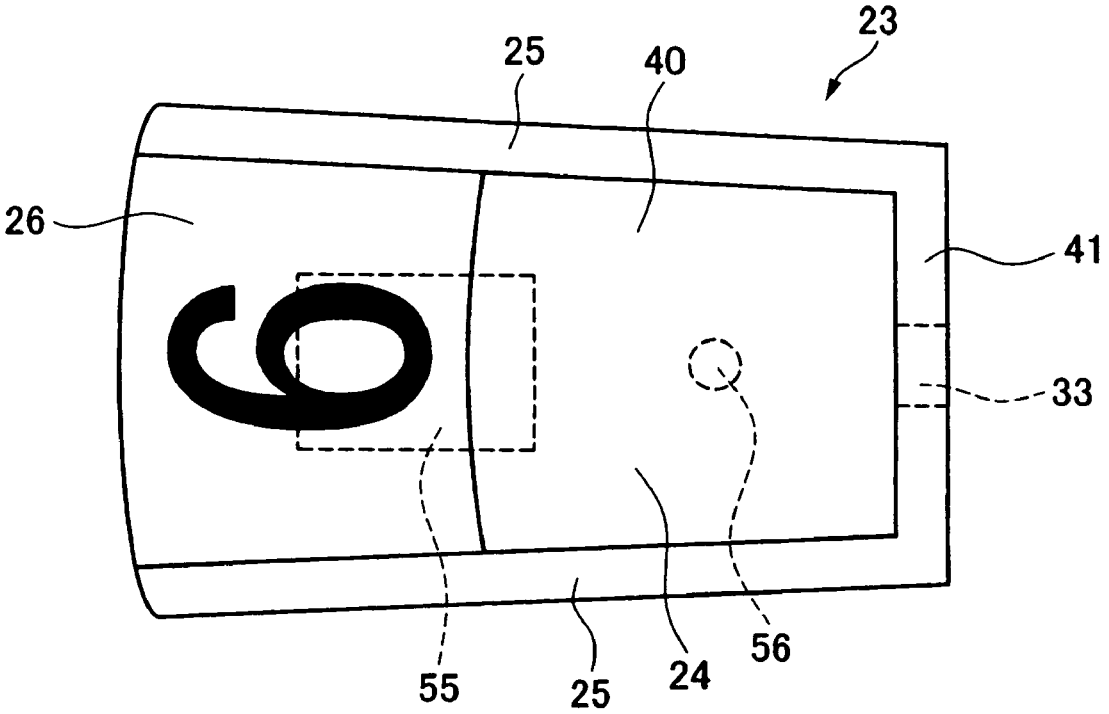
FIG. 8 is a plan view showing a ball reception member according to the first embodiment.

Next, the basic structure of each ball reception member 23 will be described with reference to FIGS. 8 and 9. Here, the 38 ball reception members 23 placed on the roulette wheel 12 have fundamentally the same configuration. The following description will be made on one 23 of the 38 ball reception members with the number "6" indicated in the number indication portion 26, by way of example, and description of the other ball reception members will be omitted. FIG. 8 is a plan view showing a ball reception member according to the first embodiment, and FIG. 9 is a side view showing the ball reception member according to the first embodiment.

Figure 9:
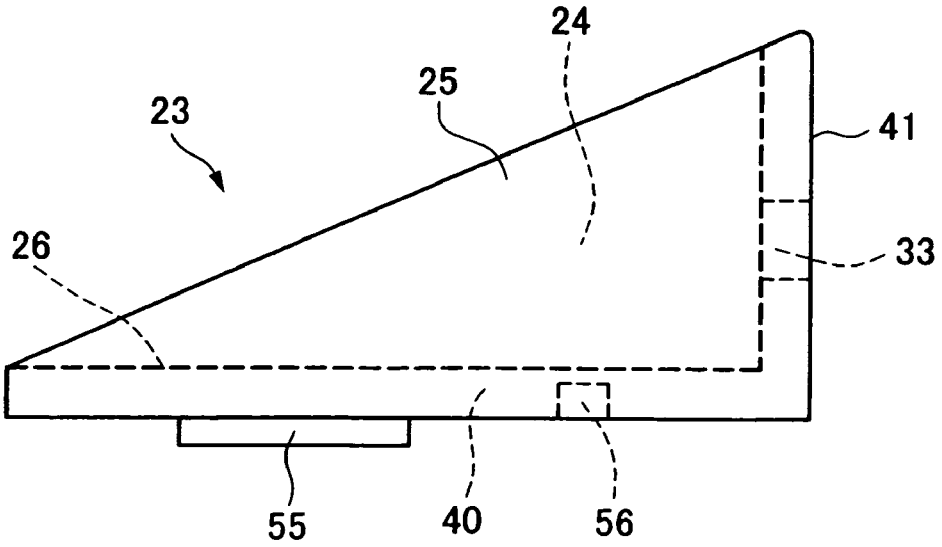
FIG. 9 is a side view showing the ball reception member according to the first embodiment.

As shown in FIGS. 8 and 9, the ball reception member 23 is provided with a bottom wall 40, a pair of separation walls 25 provided erectly on the left and right of the bottom wall 40, and a back wall 41 to be brought into abutment against the inner side wall 32 of the rotary disc 22. A reception portion 24 to receive the ball is formed out of the respective wall portions 25, 40 and 41.

The ball reception member 23 according to the first embodiment is formed integrally by a die-casting process using an aluminum alloy. Here, the die-casting means a technique in which a fused alloy of nonferrous metal such as aluminum, magnesium, zinc, etc. is injected into a precise mold at a high speed and under high pressure so as to be molded instantaneously, and a product manufactured in the technique. According to the die-casting, high dimensional accuracy can be secured so that a thin product having a complicated shape can be produced. Particularly the aluminum die-casting to be used in the embodiment has an advantage that it is light in weight, rich in durability and excellent in recyclability.

The bottom wall 40 is a wall portion which will abut against the ball reception member 23 when the ball reception member 23 is placed on the rotary disc 22. The bottom wall 40 has an approximately fan-like shape, and a number indication portion 26 having a symbol (e.g. the number "6") for identifying one of the reception portions 24 defined at 38 places is provided in the upper surface of the bottom wall 40. In the embodiment, the number indication portion 26 is formed on the bottom wall 40 by painting the bottom wall 40. However, the number indication portion 26 may be formed, for example, by processing the bottom wall 40 in relief along the shape of a symbol or pasting a seal-like printed symbol onto the bottom wall 40.

Further, an engagement portion 55 and a tapped hole 56 are formed in the lower surface of the bottom wall 40. The engagement portion 55 engages with the aforementioned engaged portion 51 of the step portion 50 so as to position the ball reception member 23 with respect to the rotary disc 22. The tapped hole 56 is to fix the ball reception member 23 to the rotary disc 22 more surely by means of an additional screw 60 fitted thereto through the tapped hole 52 formed in the step portion 50 (see FIGS. 10 and 11).

The separation walls 25 are paired to be erected on the left and right of the bottom wall 40. Each separation wall 25 is a plate-like member having an approximately triangular shape.

When the ball reception member 23 is placed on the step portion 50 of the rotary disc 22, the separation walls 25 defines the ball reception member 23 against the ball reception members 23 adjacent thereto on both sides (for example, defines the ball reception member 23 where the number "6" is indicated, against the ball reception members 23 where the numbers "18" and "21" are indicated respectively).

A pass hole 33 is formed into a circular shape in the approximately central portion of the back wall 41. The pass hole 33 forms a path of the air compressed by the compressor 14, which path is contiguous to the first discharge nozzle 35. Accordingly, due to the air discharged from the first discharge nozzle 35, the air pressure of the air is applied to the ball 11 received in the reception portion 24 so that the ball 11 is rolled toward the banked passageway 29.

Figure 10:
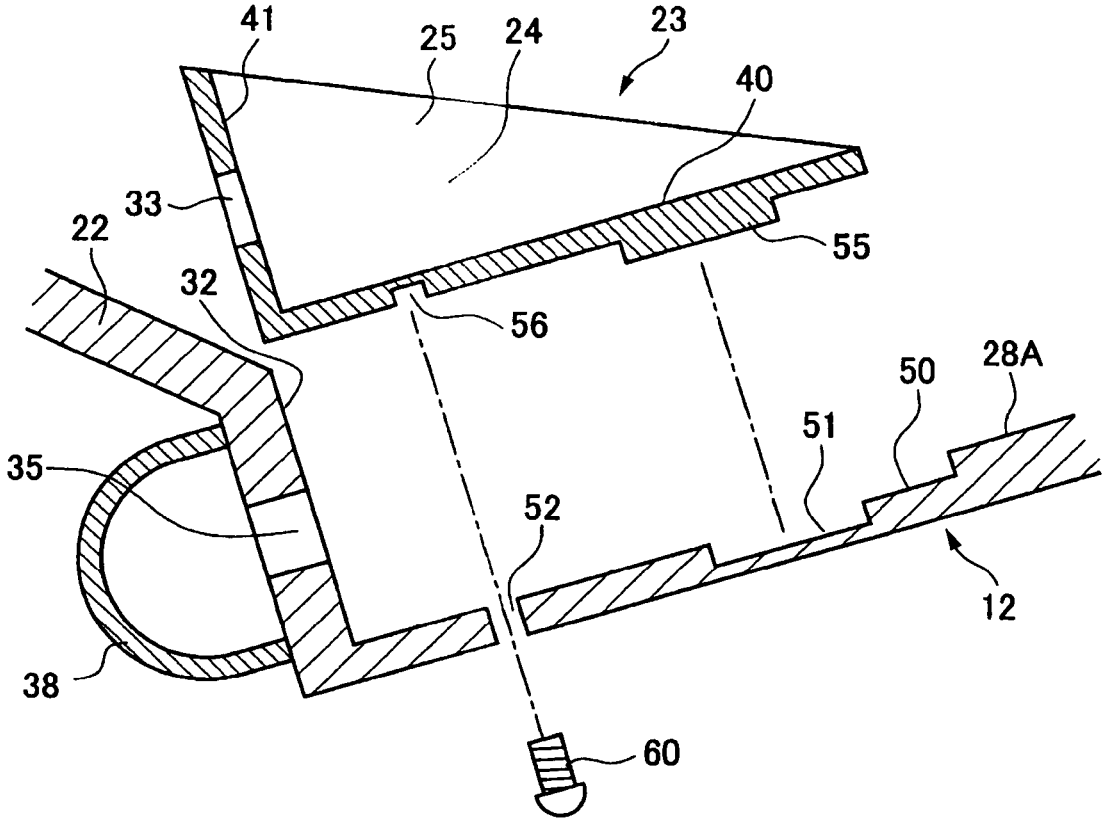
FIG. 10 is a schematic view showing a structure in which a ball reception member is attached/removed to/from a rotary disc according to the first embodiment.
Figure 11:
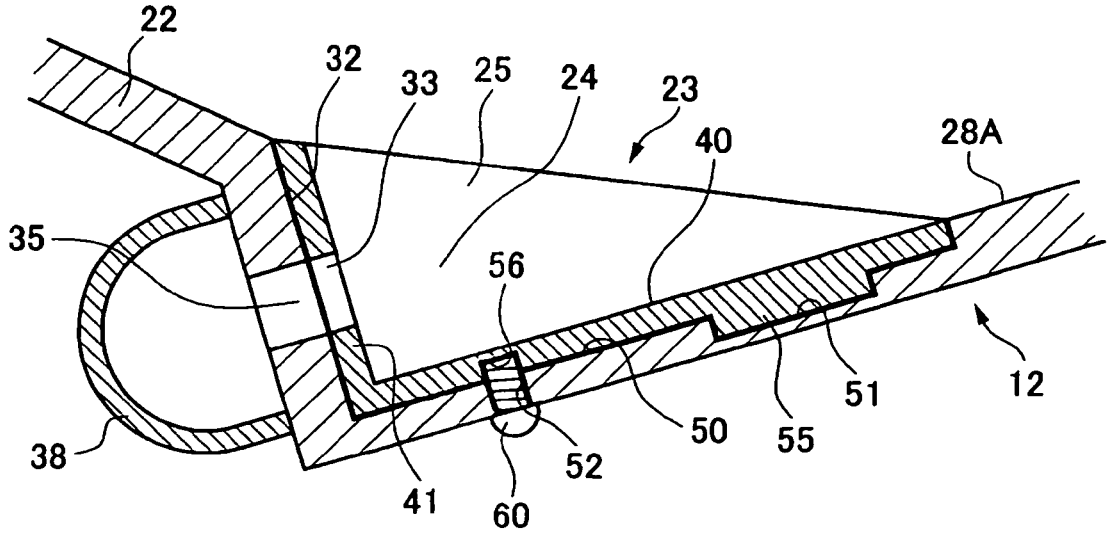
FIG. 11 is a schematic view showing the structure in which the ball reception member is attached/removed to/from the rotary disc according to the first embodiment.

Next, the structure in which the ball reception member 23 configured thus is attached to and removed from the step portion 50 of the rotary disc 22 will be described with reference to FIGS. 10 and 11. FIGS. 10 and 11 are schematic views showing the structure in which a ball reception member is attached to and removed from the rotary disc according to the first embodiment.

As shown in FIGS. 10 and 11, when the ball reception member 23 is to be attached to the rotary disc 22, first, the engagement portion 55 formed in the lower surface of the bottom wall 40 of the ball reception member 23 is inserted from above so as to be fitted into the engaged portion 51 formed in the step portion 50. After the engagement portion 55 engages with the engaged portion 51, the screw 60 is inserted into the tapped holes 52 and 56 so as to fix the ball reception member 23 to the rotary disc 22 surely.

On the contrary, when the ball reception member 23 is to be removed from the rotary disc, first, the screw 60 is pulled out from the tapped holes 52 and 56. After that, the ball reception member 23 is lifted up from the rotary disc 22. Thus, the engagement portion 55 is detached from the engaged portion 51 so that the ball reception member 23 is removable from the rotary disc 22.

Since molding is performed so that the depth of the step portion 50 is equal to the thickness of the bottom wall 40, the slope 28A and the upper surface of the bottom wall 40 are disposed contiguously without any step when the ball reception member 23 is attached to the rotary disc 22. Accordingly, the ball 11 is rolled smoothly even when the ball reception member 23 is provided separately from the rotary disc 22.

In the roulette wheel 12 used in the roulette gaming machine 1 according to the first embodiment as described above, a total of 38 ball reception members 23 divided for receiving the ball 11 rolling on the roulette wheel 12 are partitioned in accordance with the reception portions 24 for receiving the ball, and formed separately from the rotary disc 22. Each ball reception member 23 is moved down from above with respect to the rotary disc 22 so as to engage the engagement portion 55 with the engaged portion 51. Thus, the ball reception member 23 is fixed to the rotary disc 22. On the contrary, when the ball reception member 23 is moved up from below with respect to the rotary disc 22, the ball reception member 23 is removable from the rotary disc 22. Even when there occur irregularities in the surface of one partition wall 25 or painting thereon peels off due to collision with the ball 11 with long-term use, only the ball reception member 23 in question should be removed from the rotary disc 22 and replaced by a new ball reception member 23. Thus, repair can be performed easily. In such a case where the painting has peeled off, only the corresponding ball reception member 23 should be removed and only the corresponding portion thereof should be then painted again. Thus, various works of maintenance can be performed efficiently. Further, each ball reception member 23 is moved vertically with respect to the rotary disc 22 so as to be attached thereto and removed therefrom. Accordingly, the ball reception member 23 is attached or removed easily without being disturbed by any other member or the like provided on the rotary disc 22. Accordingly, the maintenance work of the roulette wheel 12 can be performed more easily and efficiently.

The roulette wheel 12 is manufactured without forming the separation walls 25 on the rotary disc 22. After that, the ball reception members formed separately by die-casting are attached to the rotary disc 22. Thus, the manufacturing of the roulette wheel 12 is completed. Accordingly, it is not necessary to mold any member having a complicated shape. It is therefore possible to reduce the manufacturing cost on a large scale.

The number indication portions 26 for indicating symbols (numbers) for identifying the reception portions 24 are provided in the upper surfaces of the bottom walls 40 of the ball reception members 23 respectively. Accordingly, when the ball reception members 23 are replaced with one another, the order with which the symbols (numbers) are arranged on the roulette wheel 12 is to be changed. Thus, the variety of the game is expanded to prevent players from getting bored with the game.

When the number indication portions 26 are formed by painting the bottom walls 4*b* or pasting sticker-like printed symbols (number) onto the bottom walls 40, there is a fear that the painting may be worn or the sticker may be peeled due to abutment against the ball 11 with long-term use so that the symbols (numbers) cannot be distinguished. Even in such a case, only the ball reception member 23 with the symbol (number) in question should be removed from the rotary disc 22 and replaced by a new ball reception member 23. Thus, repair can be performed easily in the same manner as that in the separation walls 25. Further, in such a case where the painting has peeled off, only the corresponding ball reception member 23 should be removed and only the corresponding portion thereof should be then painted again. Thus, various works of maintenance can be performed efficiently.

The above described roulette gaming machine 1 according to the first embodiment may be applied various improvements or modifications without departing from the spirit and scope of the present invention.

Figure 12:
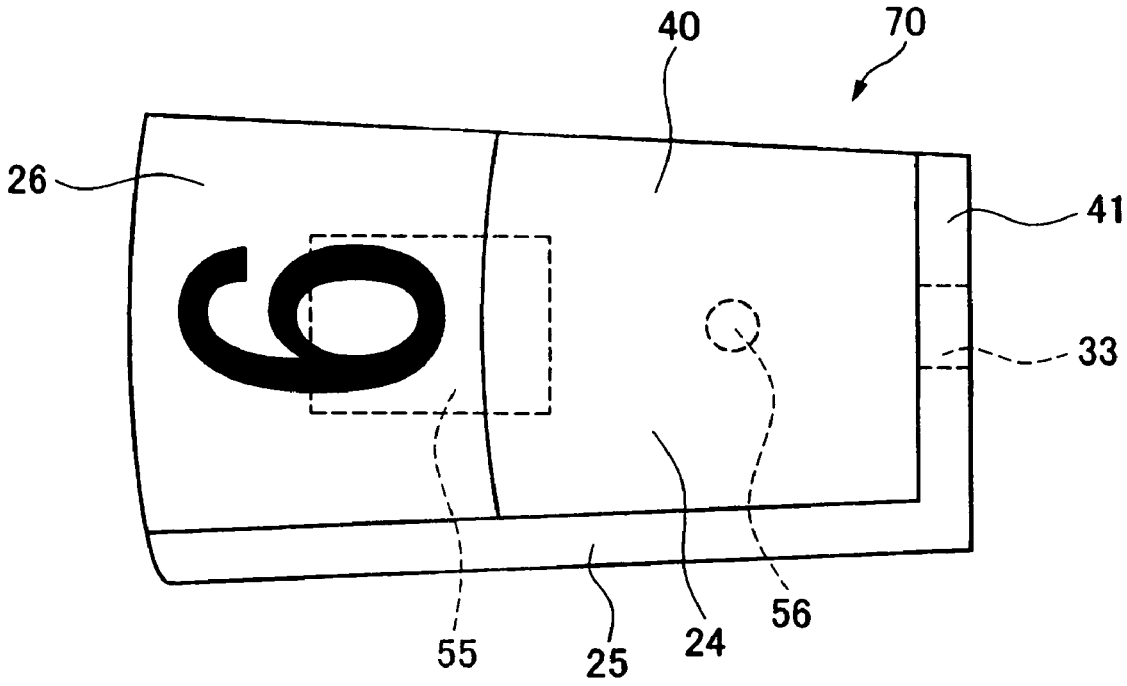
FIG. 12 is a plan view showing a ball reception member according to a modification of the first embodiment.

For example, although the separation walls 25 are provided on the both sides of the bottom wall 40 of each ball reception member 23 in the first embodiment, a separation wall 25 may be provided only one side portion. That is, although the reception portion 24 of each ball reception member 23 is defined on each side by the two separation walls 25 of the ball reception member 23 and another adjacent ball reception member 23 in the first embodiment, the reception portion 24 is defined by only one separation wall 25. A modification of a ball reception member having a separation wall 25 in only one side portion thereof will be described below with reference to FIGS. 12 and 13. In view of strength, the ball reception member in this modification where the separation wall 25 is provided in only one side portion of the bottom wall 40 is inferior to the ball reception member 23 in the embodiment where the separation walls 25 are provided in the both side portions of the bottom wall 40. However, there is an advantage that the ball reception member in this modification can be molded more easily. FIG. 12 is a plan view showing a ball reception member 70 according to the modification, and FIG. 13 is a side view showing the ball reception member 70 according to the modification.

Figure 13:
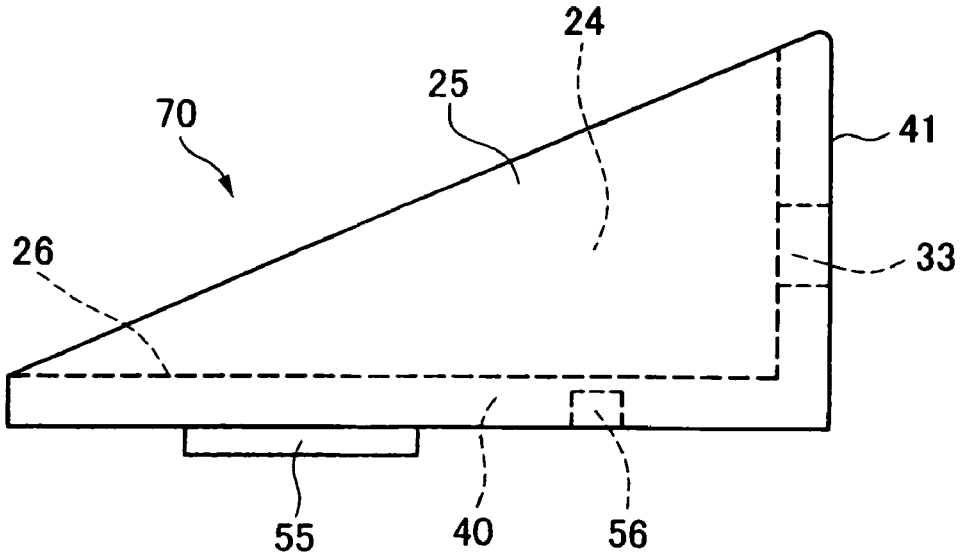
FIG. 13 is a side view showing the ball reception member according to the modification of the first embodiment.

As shown in FIGS. 12 and 13, the ball reception member 70 according to this modification is provided with a bottom wall 40, a separation wall 25 provided erectly on the left side of the bottom wall 40, and a back wall 41 to be brought into abutment against the inner side wall 32 of the rotary disc 22. A reception portion 24 for receiving the ball is formed out of the respective wall portions 25, 40 and 41 and a separation wall of another ball reception member 70 placed adjacently on the right side.

Each ball reception member 70 is molded integrally by a die-casting process using an aluminum alloy. Here, the die-casting means a technique in which a fused alloy of nonferrous metal such as aluminum, magnesium, zinc, etc. is injected into a precise mold at a high speed and under high pressure so as to be molded instantaneously, and a product manufactured in the technique. According to the die-casting, high dimensional accuracy can be secured so that a thin product having a complicated shape can be produced. Particularly the aluminum die-casting to be used in the modification has an advantage that it is light in weight, rich in durability and excellent in recyclability. In addition, the ball reception member 70 according to the modification has a separation wall 25 only in one side portion thereof. Therefore, the shape of the ball reception member 70 is simpler than that of the ball reception member 23 according to the aforementioned embodiment. Thus, the ball reception member 70 can be molded more easily.

The other configuration is fundamentally the same as that of the ball reception member 23 according to the first embodiment. Description thereof will be omitted here.

Although the number indication portion 26 is provided in the bottom wall 40 of each ball reception member 23 according to the embodiment, the number indication portion 26 may be provided on the rotary disc 22 side. In this case, when the number indication portion 26 is damaged, the work of replacement thereof becomes troublesome. However, the 38 ball reception members 23 is formed as perfectly common members, so that each ball reception member 23 is used in any one of a total of 38 places. Thus, the flexibility thereof increases.

The air is discharged concurrently from all the ball reception members 23 through the launching air pipe 38 according to the embodiment. However, which ball reception member 23 receives the ball 11 may be determined by ball detection sensors. In this case, the air is discharged from only the first discharge nozzle 35 provided in the reception groove of the ball reception member 23 where the ball 11 is received.

As described above, the roulette apparatus (roulette wheel 12) according to the first embodiment includes: a roulette wheel (for example, a frame 21 and a rotary disc 22) having a rolling region where a ball (for example, a ball 11) rolls; and a plurality of ball reception members (for example, ball reception members 23) divided and provided contiguously to the rolling region so that one of the ball reception members will receive the rolling ball; wherein each of the ball reception members includes: a reception portion (for example, a reception portion 24) for receiving the ball; and separation walls (for example, separation walls 25) for separating the reception portion from reception portions of adjacent ball reception members; and the ball reception members are formed separately from the roulette wheel and removably attached to the roulette wheel.

In the roulette apparatus according to the configuration described above, the ball reception members formed by partition at a plurality of places for receiving the ball rolling in the rolling region are formed separately from the roulette wheel and removably attached to the roulette wheel. Due to collision of the ball against the separation walls with long-term use, there may occur irregularities in the surfaces of the separation walls, or painting applied thereto may peel off. Even in such a case, only the ball reception member in question should be removed from the roulette wheel disc and replaced by a new one. Thus, repair can be performed easily. It is therefore possible to perform maintenance efficiently on the roulette wheel.

In addition, the roulette apparatus is manufactured without forming the separation walls on the roulette wheel. After that, the ball reception members formed separately by a die-casting process or the like are attached to the roulette wheel. Thus, the manufacturing of the roulette apparatus is completed. Accordingly, it is not necessary to mold any member having a complicated shape. It is therefore possible to reduce the manufacturing cost on a large scale.

In the roulette apparatus (for example, the roulette wheel 12), the ball reception members (for example, the ball reception members 23) are formed separately from one another in accordance with the individual reception portions (for example, the reception portions 24) defined by the separation walls (for example, the separation walls 25).

In the roulette apparatus according to the configuration described above, the ball reception members are formed separately from one another correspondingly to the reception portions defined by the separation walls. Due to collision of the ball against the separation walls with long-term use, there may occur irregularities in the surfaces of the separation walls, or painting applied thereto may peel off. Even in such a case, only the ball reception member in question should be removed from the roulette wheel and replaced by a new one. Thus, repair can be performed more easily. It is therefore possible to perform maintenance efficiently on the roulette apparatus.

In addition, the roulette apparatus is manufactured without forming the separation walls on the roulette wheel. After that, the ball reception members formed separately by die-casting are attached to the roulette wheel. Thus, the manufacturing of the roulette apparatus can be completed. Accordingly, it is not necessary to mold any member having a complicated shape. It is therefore possible to reduce the manufacturing cost on a large scale.

In the roulette apparatus (for example, the roulette wheel 12) according to the configuration described above, each of the ball reception members (for example, the ball reception members 23) includes: a bottom wall (for example, a bottom wall 40) which will abut against the roulette wheel (for example, the frame 21 and the rotary disc 22) when the ball reception member is supported on the roulette wheel, and on which the separation walls (for example, the separation walls 25) are provided erectly; and an engagement portion (for example, an engagement portion 55) provided on the bottom wall; and the roulette wheel includes engaged portions (for example, engaged portions 51) to engage with the engagement portions to thereby support the ball reception members on the roulette apparatus.

In the roulette apparatus according to the configuration described above, the engagement portion is formed on the bottom wall of each ball reception member. Due to engagement of the engagement portion with the engaged portion formed in the roulette wheel, the ball reception member is supported on the roulette wheel. Accordingly, the ball reception member can be attached to and removed from the roulette wheel easily. Due to collision of the ball against the separation walls with long-term use, there may occur irregularities in the surfaces of the separation walls, or painting applied thereto may peel off. Even in such a case, only the ball reception member in question should be removed from the roulette wheel and replaced by a new one easily.

In the roulette apparatus (for example, the roulette wheel 12) according to the configuration described above, each of the ball reception members (for example, the ball reception members 23) is moved up/down relatively to the roulette wheel (for example, the frame 21 and the rotary disc 22) so as to be attached/removed to/from the roulette wheel.

In the roulette apparatus according to the configuration described above, each ball reception member can be moved vertically with respect to the roulette wheel so as to be attached to and removed from the roulette wheel. Accordingly, the ball reception member can be attached to and removed from the roulette wheel easily without being disturbed by any other member or the like provided on the roulette apparatus.

In the roulette apparatus (for example, the roulette wheel 12) according to the configuration described above, symbols (for example, number indication portions 26) for identifying the reception portions (for example, the reception portions 24) defined by the separation walls (for example, the separation walls 25) are provided in the ball reception members (for example, the ball reception members 23) respectively.

In the roulette apparatus according to the configuration described above, symbols for identifying the reception portions defined by the separation walls are provided in the ball reception members respectively. When the symbols are provided by painting the ball reception members or pasting sticker-like printed symbols onto the ball reception members, the painting may be worn or the sticker may be peeled due to abutment against the ball with long-term use so that the symbols cannot be distinguished. Even in such a case, only the ball reception member with the symbol in question should be removed from the roulette wheel and replaced by a new ball reception member. Thus, repair can be performed. It is therefore possible to perform the maintenance work on the roulette apparatus efficiently.

Further, when locations of the ball reception members are replaced with one another, the order with which the symbols are arranged on the roulette wheel can be changed. Thus, the variety of the game is expanded to prevent players from getting bored with the game.

Second Embodiment

A roulette gaming machine 101 having a roulette apparatus according to the invention will be described below in detail and with reference to the drawings based on a second embodiment.

The roulette gaming machine 101 is a game machine configured as follows. That is, a player guesses a number or the like which will be decided by a roulette apparatus 102, and bets the player's own game media such as medals on the guessed number or the like. When the bet number or the like is hit, the player receives payout of a predetermined number of medals.

Figure 14:
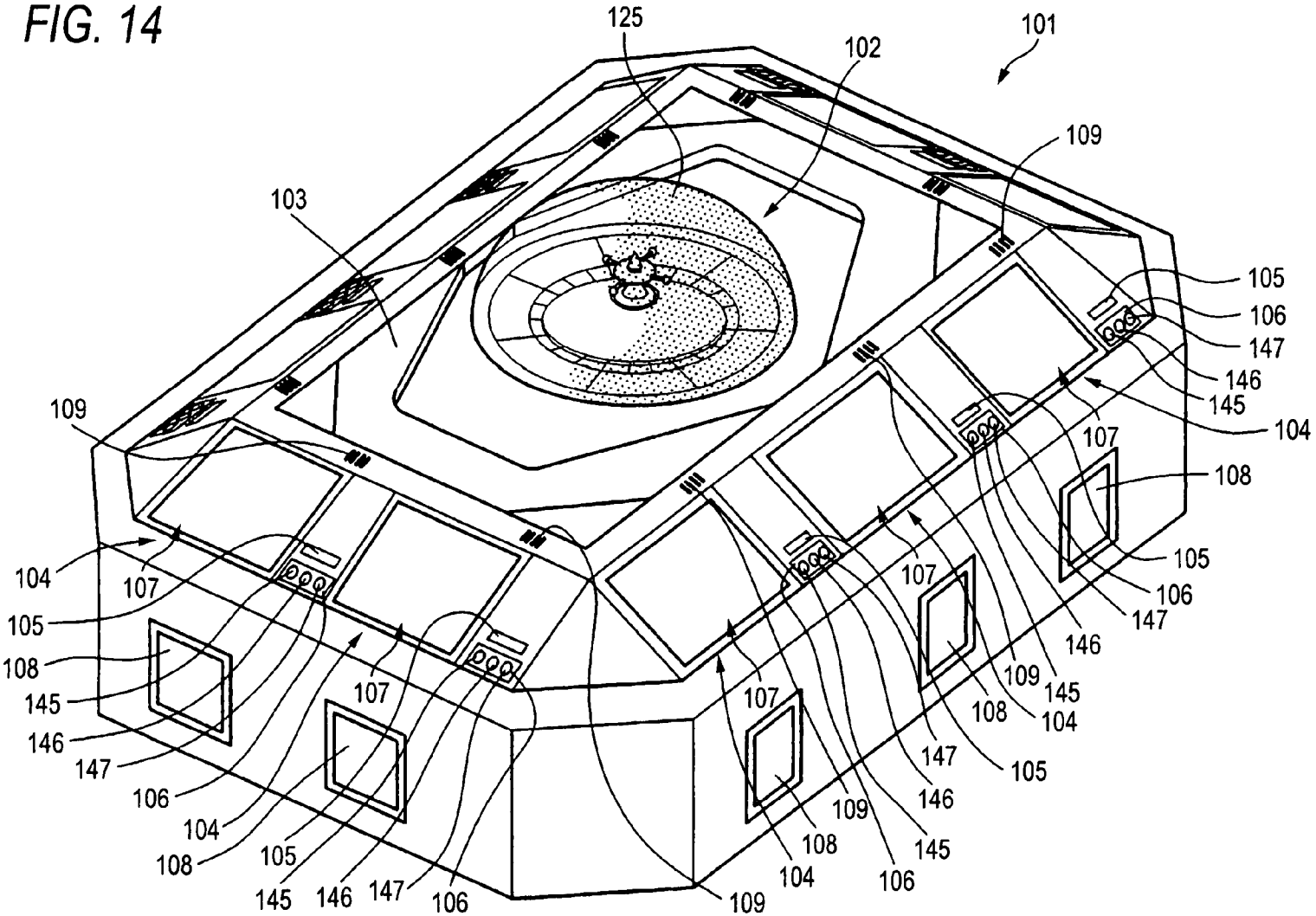
FIG. 14 is an outside perspective view showing a schematic configuration of a roulette gaming machine according to a second embodiment.

First, description will be made about the schematic configuration of the roulette gaming machine 101 according to the second embodiment with reference to FIG. 14. FIG. 14 is an outside perspective view showing the schematic configuration of the roulette gaming machine according to the second embodiment.

As shown in FIG. 14, the roulette gaming machine 101 is provided with a cabinet 103 serving as a body portion, a roulette apparatus 102 provided in an approximately central portion of the top of the cabinet 103, and a plurality (ten in the embodiment) of satellites 104 placed around the roulette apparatus 102 so as to surround the roulette apparatus 102.

Here, each satellite 104 is a game region including at least a medal insertion slot 105, a control portion 106 and an image display device 107. Game media such as coins or medals to be used in games are inserted into the medal insertion slot 105. The control portion 106 is provided with a plurality of control buttons through which a player inputs predetermined instructions. Images concerned with games are displayed on the image display device 107. The player operates the control portion 106 or the like while viewing the images displayed on the image display device 107. Thus, the player makes progress with the games to be developed.

Medal payout openings 108 are provided in the side surfaces of the cabinet 103 where the satellites 104 are placed, respectively. Further, a speaker 109 for playing music, sound effects, etc. is provided on the upper right of the image display device 107 of each satellite 104.

A medal sensor (not shown) is provided inside each medal insertion slot 105 so as to identify game media such as medals inserted through the medal insertion slot 105 and count the inserted medals. On the other hand, a hopper (not shown) is provided inside each medal payout opening 108 so as to pay out a predetermined number of medals from the medal payout opening 108.

Figure 15:
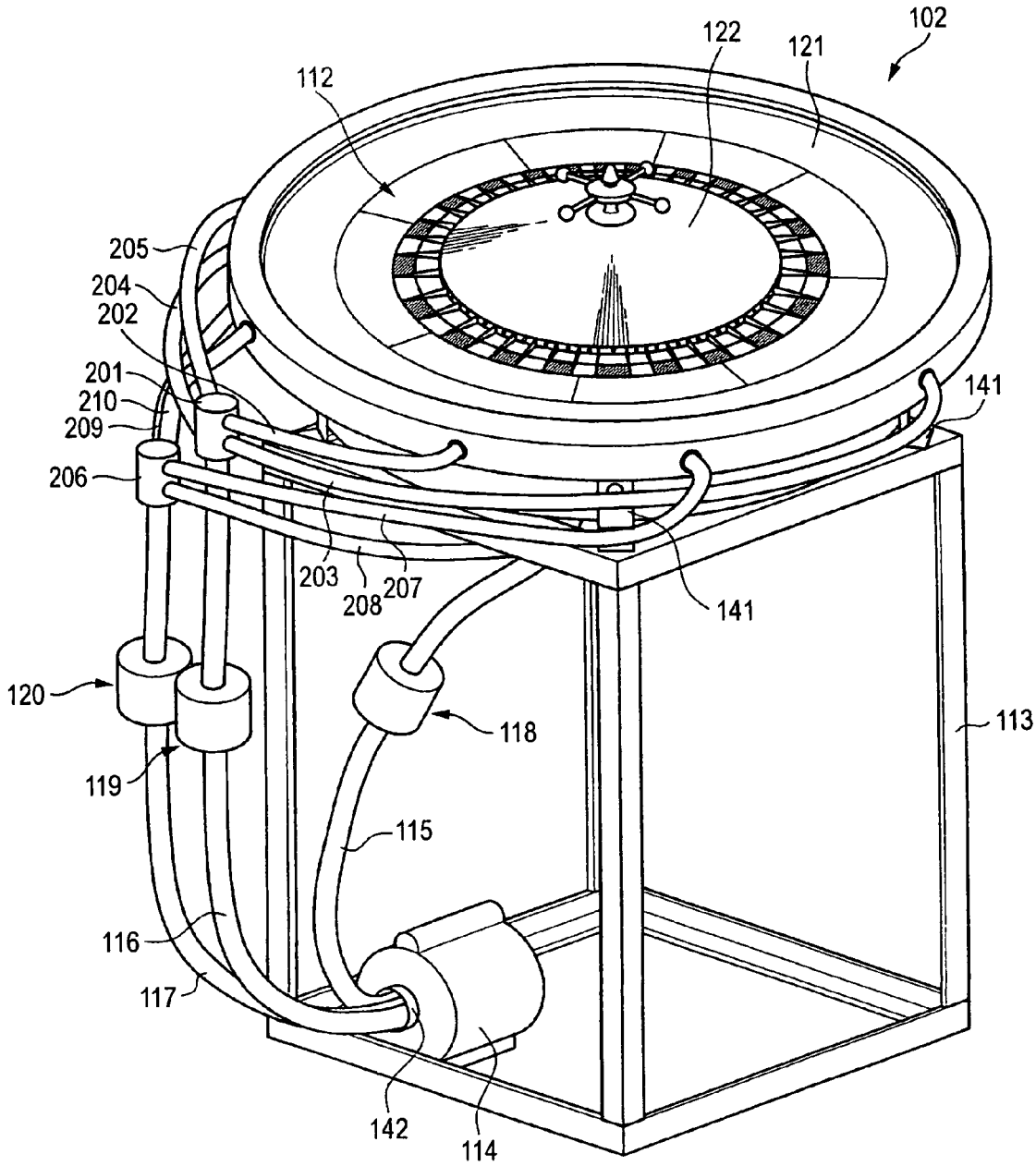
FIG. 15 is a perspective view showing a roulette apparatus according to the second embodiment.
Figure 16:
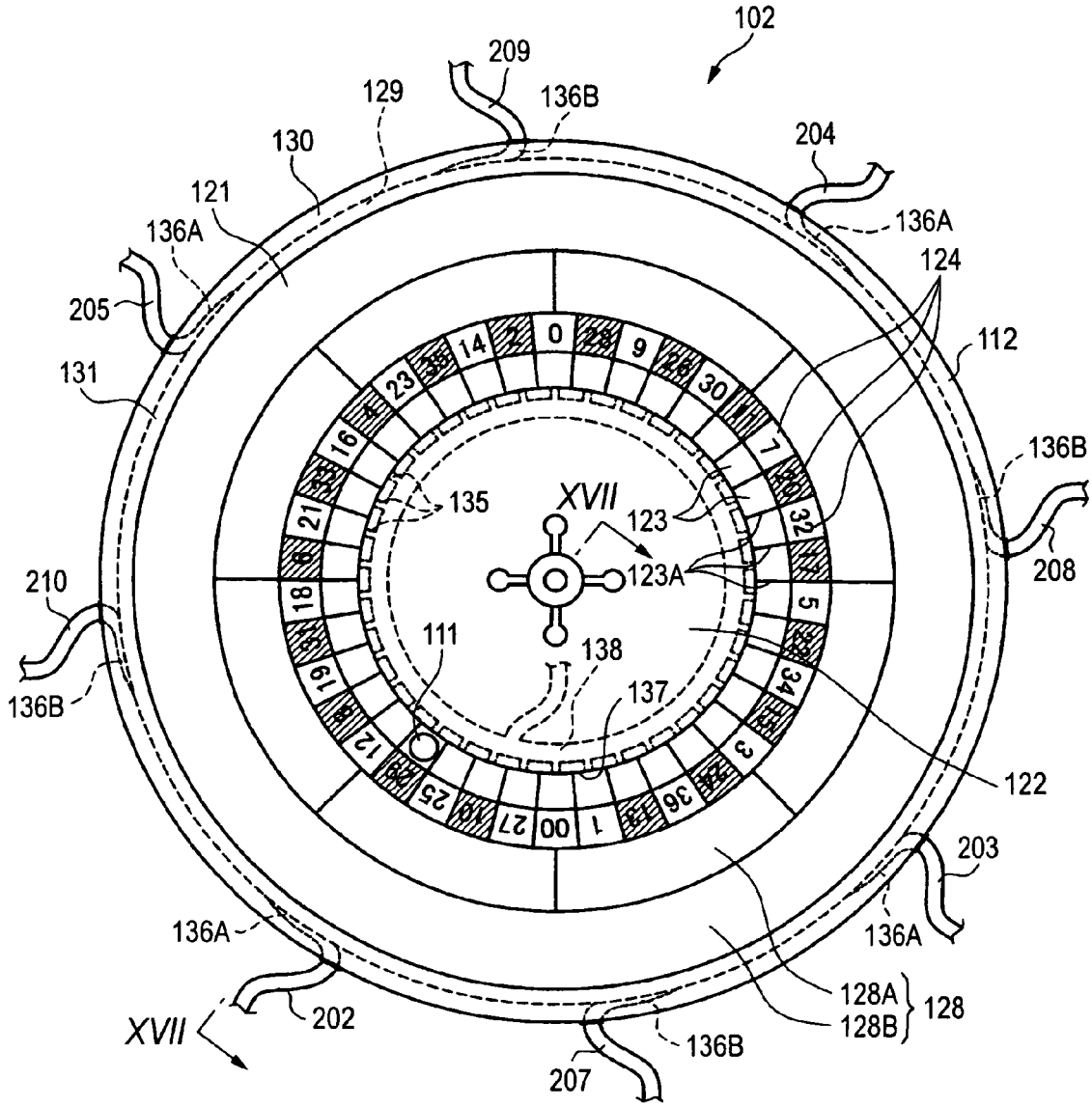
FIG. 16 is a plan view showing the roulette apparatus according to the second embodiment.
Figure 17:
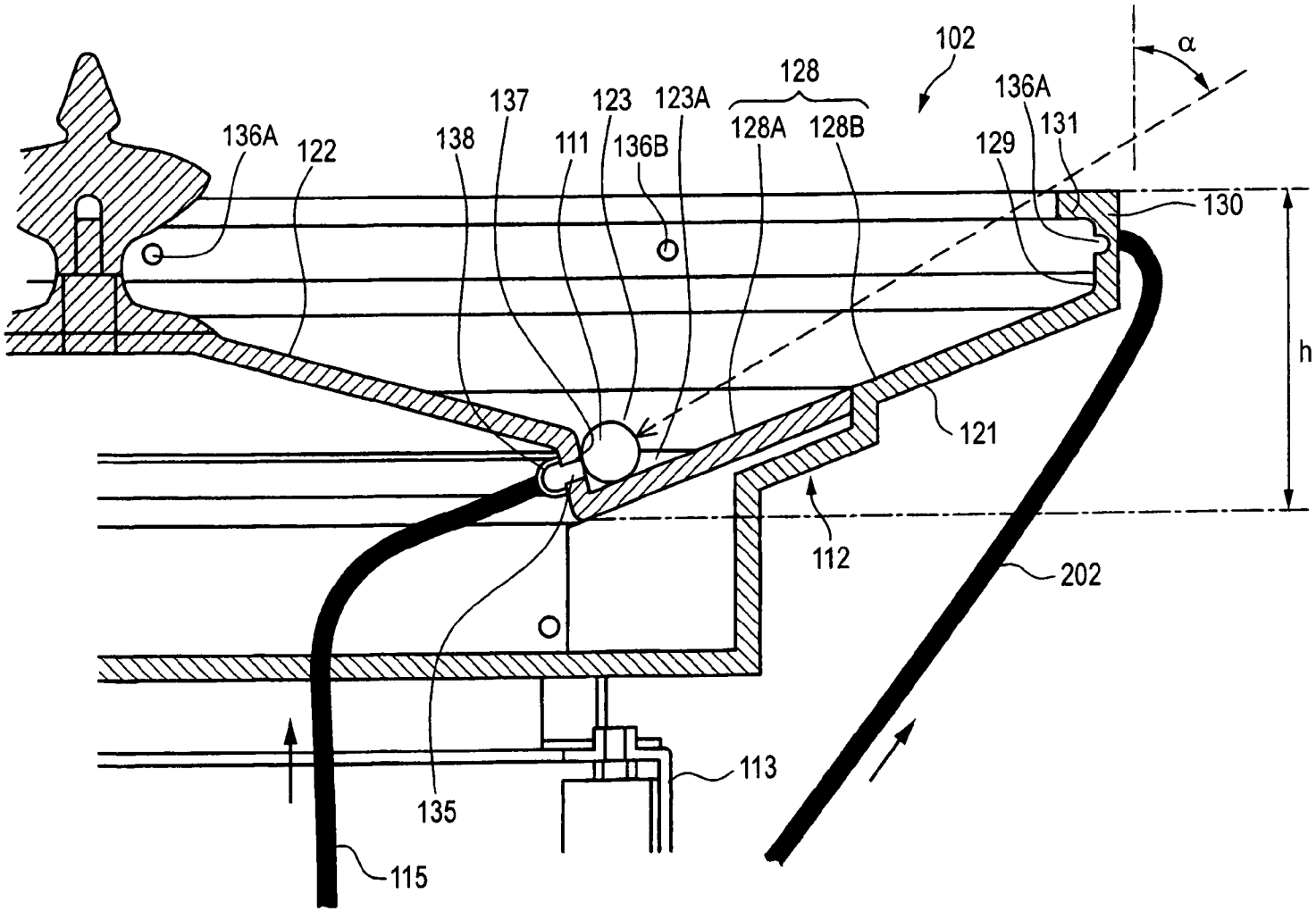
FIG. 17 is a sectional view of the roulette apparatus taken on line XVII-XVII in FIG. 16.

Next, the configuration of the roulette apparatus 102 according to the second embodiment will be described with reference to FIGS. 15 to 19. FIG. 15 is a perspective view showing the roulette apparatus according to the second embodiment. FIG. 16 is a plan view showing the roulette apparatus according to the second embodiment. FIG. 17 is a sectional view of the roulette apparatus taken on line XVII-XVII in FIG. 16. FIG. 17 is an enlarged perspective view showing the vicinity of a ball reception groove of the roulette apparatus according to the second embodiment. FIG. 19 is an enlarged perspective view showing the vicinity of a banked passageway of the roulette apparatus according to the second embodiment.

As shown in FIG. 15, the roulette apparatus 102 is provided with a roulette wheel 112, a support table 113, a compressor 114, air tubes 115, 116 and 117, a first on-off valve 118, a second on-off valve 119 and a third on-off valve 120. The roulette wheel 112 has a rolling region where a ball 111 rolls during a game. The support table 113 supports the roulette wheel 112 inside the roulette gaming machine 101. The compressor 114 takes in the ambient air and compresses the air into predetermined pressure. The air compressed by the compressor 114 is sent through the air tubes 115, 116 and 117. The first, second and third on-off valves 117, 118 and 119 are provided in halfway points of the air tubes 115, 116 and 117 for adjusting the pressure of the air flowing in the air tubes 115, 116 and 117 respectively.

The compressor 114 is disposed in an internal space formed by the support table 113. The compressor 114 is a device for taking in the ambient air and compressing the air into predetermined pressure (1 MPa in the second embodiment). The compressor 114 according to the embodiment has two discharge nozzles 142 for discharging the compressed air. The air tubes 115 and 116 are connected to the discharge nozzles 142 respectively.

The compressor 114 is disposed in an internal space formed by the support table 113. The compressor 114 is a device for taking in the ambient air and compressing the air into predetermined pressure (1 MPa in the second embodiment). The compressor 114 according to the second embodiment has three discharge nozzles 142 for discharging the compressed air. The air tubes 115, 116 and 117 are connected to the discharge nozzles 142 respectively.

The air tubes 115, 116 and 117 are tubes through which the air compressed by the compressor 114 is conveyed to first discharge nozzles 135, second discharge nozzles 136A and third discharge nozzles 136B formed in the roulette wheel 112 respectively. The first on-off valve 118, the second on-off valve 119 and the third on-off valve 120 are provided in the halfway points of the air tubes 115, 116 and 117 respectively. The air tube 116 is divided into four air tubes 202-205 by a distributor 201 provided on the downstream side of the second on-off valve 119. The air tubes 202-205 are connected to the below-mentioned second discharge nozzles 136A respectively. The air tube 117 is divided into four air tubes 207-210 by a distributor 206 provided on the downstream side of the third on-off valve 120. The air tubes 207-210 are connected to the below-mentioned third discharge nozzles 136B respectively.

Here, the first on-off valve 118, the second on-off valve 119 and the third on-off valve 120 are electromagnetic valves each having a structure by which the valve opening time is adjusted. The first on-off valve 118, the second on-off valve 119 and the third on-off valve 120 are connected to a main control CPU 180 (see FIG. 22). The main control CPU 180 controls the on/off times of the first, second and third on-off valves 118, 119 and 120 in accordance with a program stored in a ROM 181 in advance as will be described later. Thus, the air pressures discharged from the first, second and third on-off valves 118, 119 and 120 are adjusted to perform a series of operations to roll the ball 111 on the roulette wheel 112 and receive the ball 111 in one of ball reception grooves 123 after a predetermined time has passed.

Subsequently the roulette wheel 112 according to the second embodiment will be described. The roulette wheel 112 is provided with a frame 121 fixed to the support table 113, and a rotary disc 122 rotatably received and supported inside the frame 121. A large number (38 in the second embodiment) of concave ball reception grooves 123 are provided circumferentially on the top of the rotary disc 122.

The ball reception grooves 123 are reception portions to receive the rolling ball 111. The ball reception grooves 123 are partitioned from one another by partition walls 123A (see FIG. 18) each having an approximately triangular shape. Further, a number indication plate 124 where one of numbers "0", "00" and "1" to "36" is indicated as a graphic character corresponding to each ball reception groove 123 is provided on the top of the rotary disc 122 in the outside direction of the ball reception groove 123.

When the roulette apparatus 102 is installed in the roulette gaming machine 101, the roulette wheel 112 is wholly covered with a hemispheric glass cover member 125 from above (see FIG. 14). Thus, the ball 111 rolling on the roulette wheel 112 during a game is held not to jump out from the roulette wheel 112. In addition, foreign matters are prevented from entering the roulette wheel 112 in order to prevent act of dishonesty and cheating.

The rolling region where the ball 111 rolls actually on the roulette wheel 112 during a game is provided with a slope 128 formed out of the frame 121 and the rotary disc 122, and a banked passageway 129 formed integrally with the slope 128 as will be described later. The slope 128 is formed out of a first slope 128A and a second slope 128B. The first slope 128A is formed on the inner circumferential edge side of the frame 121, and the second slope 128B is formed on the outer circumferential edge side of the rotary disc 122. The slope 128 is inclined at a predetermined angle (20 degrees in the second embodiment) to sink from the outer circumference of the roulette wheel 112 toward the center thereof. The ball reception members 123 and the below-mentioned banked passageway 129 are formed contiguously through the slope 128.

The banked passageway 129 is provided circumferentially in the outer circumferential edge portion of the frame 121. The banked passageway 129 is a passageway to guide the ball 111 rolling on the roulette wheel 112 against the centrifugal force thereof so as to roll the ball 111 in a circular orbit. The banked passageway 129 is formed to be endless with respect to the roulette wheel 112 due to a guide wall 130 erected vertically in the outer circumference of the roulette wheel 112. Further, a wall portion 131 is formed contiguously to the banked passageway 129 in the upper end of the guide wall 130. The wall portion 131 is a prevention member provided for preventing the ball 111 rotating on the banked passageway 129 from jumping out from the roulette wheel 112.

The ball 111 accelerated by the air discharged from the below-mentioned first, second and third discharge nozzles 135, 136A and 136B increases gradually in velocity and rotates along the banked passageway 129. When the discharge of the air from the second discharge nozzles 136A or the third discharge nozzles 136B is stopped, the rotational velocity of the ball 111 becomes weak enough that the ball 111 loses the centrifugal force. Thus, the ball 111 rolls down on the slope 128 toward the inner side of the roulette wheel 112, and reaches the rotary disc 122 which is rotating.

The ball 111 rolling onto the rotary disc 122 passes over one of the number indication plates 124 of the rotating rotary disc 122 and is received in one of the ball reception grooves 123. Thus, the number indicated in the number indication plate 124 corresponding to the ball reception groove 123 where the ball 111 has been received becomes a winning number.

Figure 18:
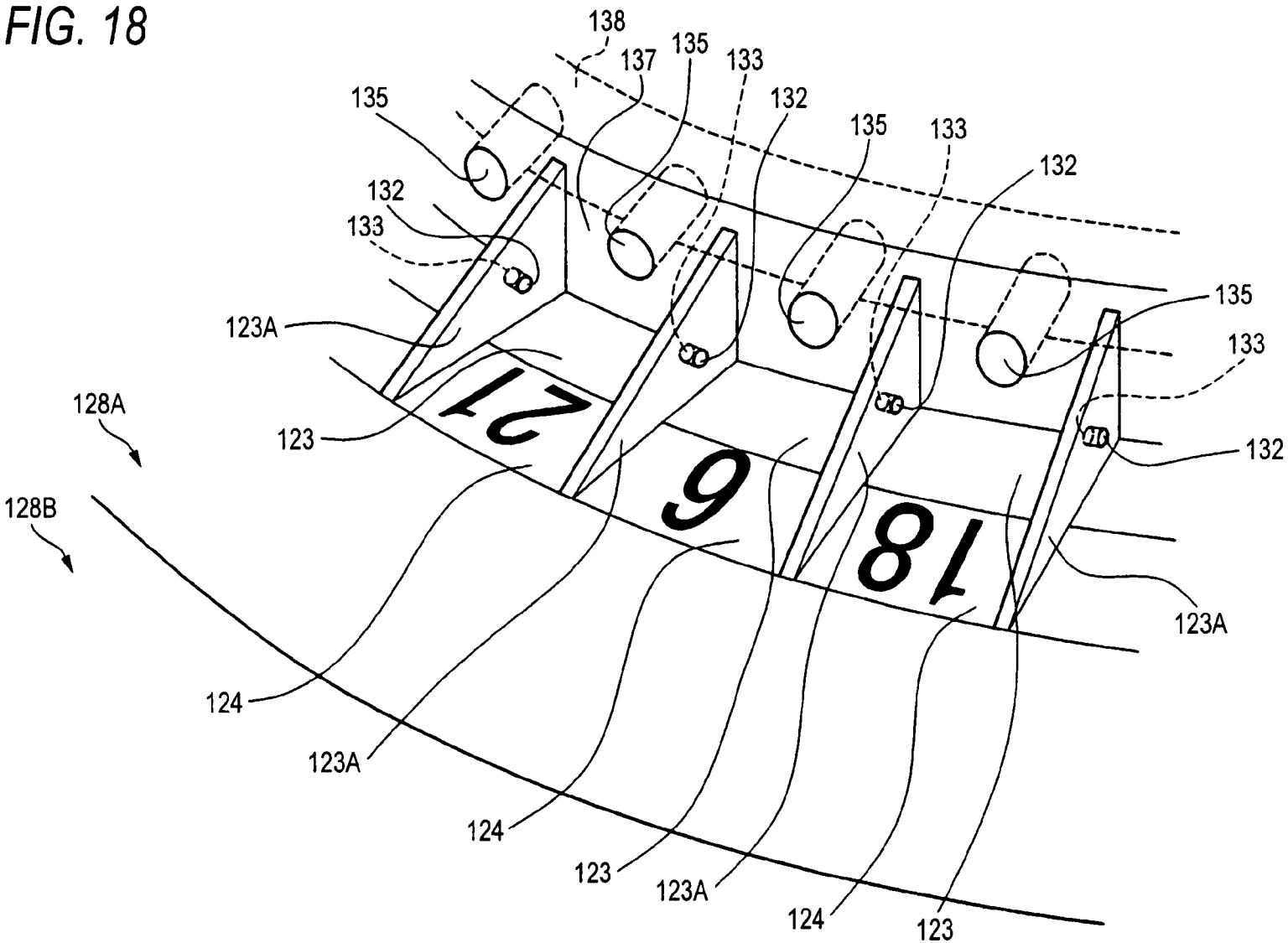
FIG. 18 is an enlarged perspective view showing the vicinity of a ball reception groove of the roulette apparatus according to the second embodiment.
Figure 19:
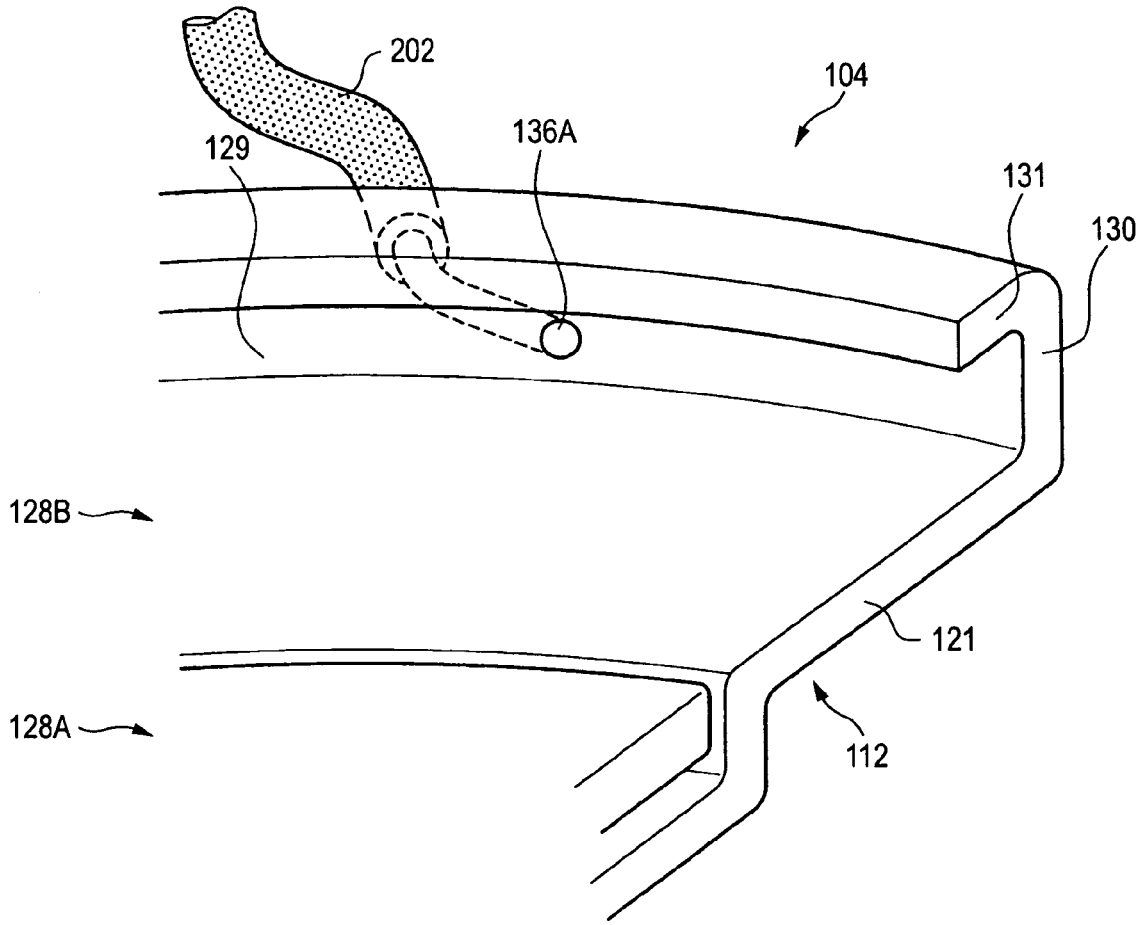
FIG. 19 is an enlarged perspective view showing the vicinity of a banked passageway of the roulette apparatus according to the second embodiment.

The partition walls 123A forming the ball reception grooves 123 are partially notched, and a light emitter 132 and a light receiver 133 are provided in each partition wall 123A (see FIG. 18). Light emitted from the light emitter 132 of one of the partition walls 123A forming one ball reception groove 123 reaches the light receiver 133 of the other partition wall 123A. When the ball 111 enters the ball reception groove 123, the light is blocked by the ball 111. Thus, the existence of the ball 111 is detected. Therefore, when the ball 111 enters one ball reception groove 123, the existence of the ball 111 is detected by a light sensor provided with a light emitter 132 and a light receiver 133, and a detection signal is transmitted to the below-mentioned main control CPU 180 (see FIG. 22). Based on the result of the detection, the main control CPU 180 makes determination of a winning number.

Figure 20:
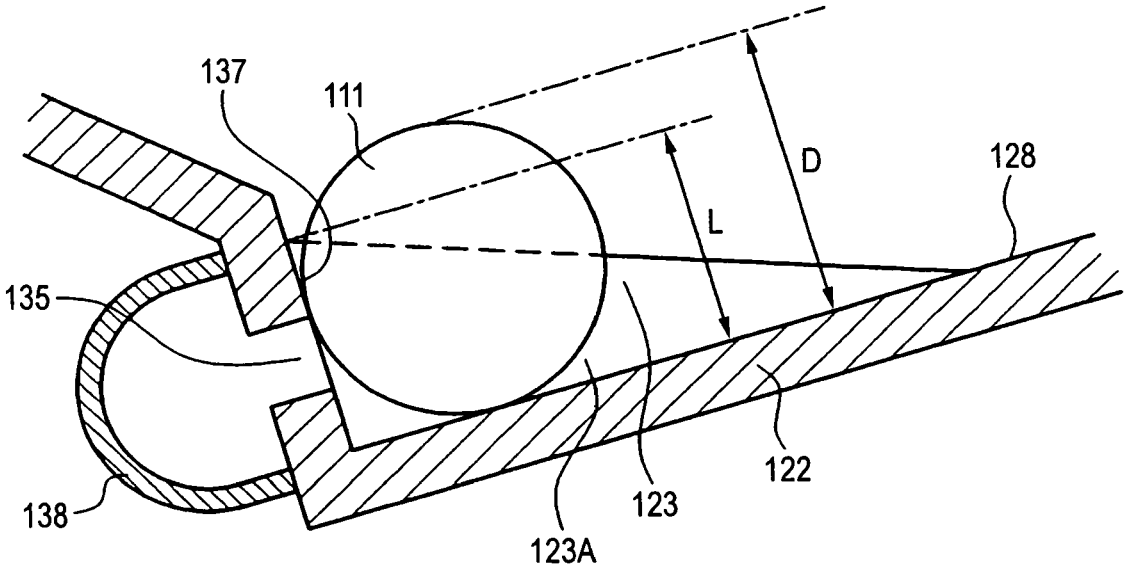
FIG. 20 is a sectional view of a roulette wheel, in which particularly the vicinity of a ball reception groove is enlarged.

Each ball reception groove 123 is formed so that depth L of the ball reception groove 123 with respect to the slope 128 is smaller than the diameter D of the ball 111. FIG. 20 is a schematic view showing a ball reception groove according to the second embodiment.

As described previously, the ball reception grooves 123 are a total of 138 reception portions partitioned circumferentially by the partition walls 123A and for receiving the ball 111. Since the depth L of each ball reception groove 123 is designed to be smaller than the diameter D of the ball 111, there is no fear that the ball 111 sinks in the ball reception groove 123 when the ball 111 is received in the ball reception groove 123, as shown in FIG. 20. Thus, the players easily confirm the position of the ball 111 received in the ball reception groove 123 during each game. Accordingly, the enjoyability of the game is enhanced.

In the roulette apparatus 102 according to the second embodiment, as described previously, the compressed air discharged to the ball 111 allows the ball to roll repeatedly without recovering the ball from the roulette wheel 112. Thus, any complicated mechanism such as a movable portion for recovering the ball 111 or a launcher for launching the ball 111 is not required. In addition, the depth L of each ball reception groove 123 is made smaller than the diameter D of the ball 111 (see FIG. 20). Thus, as shown in FIG. 18, height h of the roulette wheel 112 is reduced. Accordingly, a visual field angle α of the roulette apparatus 102 for confirming the ball 111 is widened so that ball confirmation by the players becomes easy. Thus, the enjoyability of gaming is enhanced.

Further, the ball reception grooves 123 and the banked passageway 129 are formed contiguously through one slope 128 rising from the ball reception grooves 123 toward the banked passageway 129 at a predetermined inclination angle. Accordingly, each player easily confirms the ball 111 received in one of the ball reception grooves 123.

Next, the first discharge nozzles 135, the second discharge nozzles 136A and the third discharge nozzles 136B provided in the roulette wheel 112 will be described with reference to FIGS. 18 and 19. Here, the roulette apparatus 102 according to the second embodiment uses the air pressure of the compressed air as its power source for rolling the ball 111 on the roulette wheel 112. Specifically, the ambient air is taken in and compressed to a predetermined pressure (e.g. 1 MPa) by the compressor 114 (see FIG. 15) provided under the roulette apparatus 102. The compressed air is conveyed to the roulette wheel 112 through the air tubes 115, 116 and 117. The air is discharged from the first, second and third discharge nozzles 135, 136A and 136B so as to apply a force based on the air pressure to the ball 111 in the roulette wheel 112.

As shown in FIG. 18, the first discharge nozzles 135 are formed in an inner side wall 137 of the rotary disc 122 correspondingly to the ball reception grooves 123 respectively. The inner side wall 137 forms the ball reception grooves 123 in cooperation with the partition walls 123A. In the second embodiment, 38 ball reception grooves 123 corresponding to the numbers "0", "00" and "1" to "36" are formed. Therefore, the first discharge nozzles 135 are formed at 38 places. Each first discharge nozzle 135 is formed from the center of the roulette wheel 112 toward the periphery thereof. The air discharged from each first discharge nozzle 135 is discharged toward the banked passageway 129 provided in the outer circumferential edge portion of the roulette wheel 112.

An annular launching air pipe 138 is placed in the back side surface of the inner wall side 137 where the first discharge nozzles 135 are formed. The launching air pipe 138 is connected to the air tube 115, and the first discharge nozzles 135 are formed at a total of 38 places on the outer periphery of the launching air pipe 138. Accordingly, the air conveyed through the air tube 115 once flows into the launching air pipe 138. After that, the air is discharged into the reception grooves 123 all at once through the first discharge nozzles 135 provided at 38 places. Due to the air pressure of the discharged air, the ball 111 having been received in one of the reception grooves 123 begins to roll toward the banked passageway 129 against the inclination of the slope 128.

The second discharge nozzles 136A and the third discharge nozzles 136B are formed alternately each at four places at predetermined intervals (at intervals of 45 degrees in the second embodiment) in the guide wall 130 forming the banked passageway 129 as shown in FIGS. 16 and 19. The second discharge nozzles 136 and the third discharge nozzles are formed to look in the circumferential direction of the banked passageway 129, that is, in the tangential direction of the roulette wheel 112. The second discharge nozzles 136A discharge the air clockwise along the banked passageway 129. On the other hand, the third discharge nozzles 136B discharge the air counterclockwise along the banked passageway 129. The below-mentioned main control CPU 180 (see FIG. 22) changes over so that the second on-off value 119 and the third on-off valve 120 are opened alternately in every game when the ball 111 is rolled along the banked passageway 129 (see FIG. 26).

Figure 30:
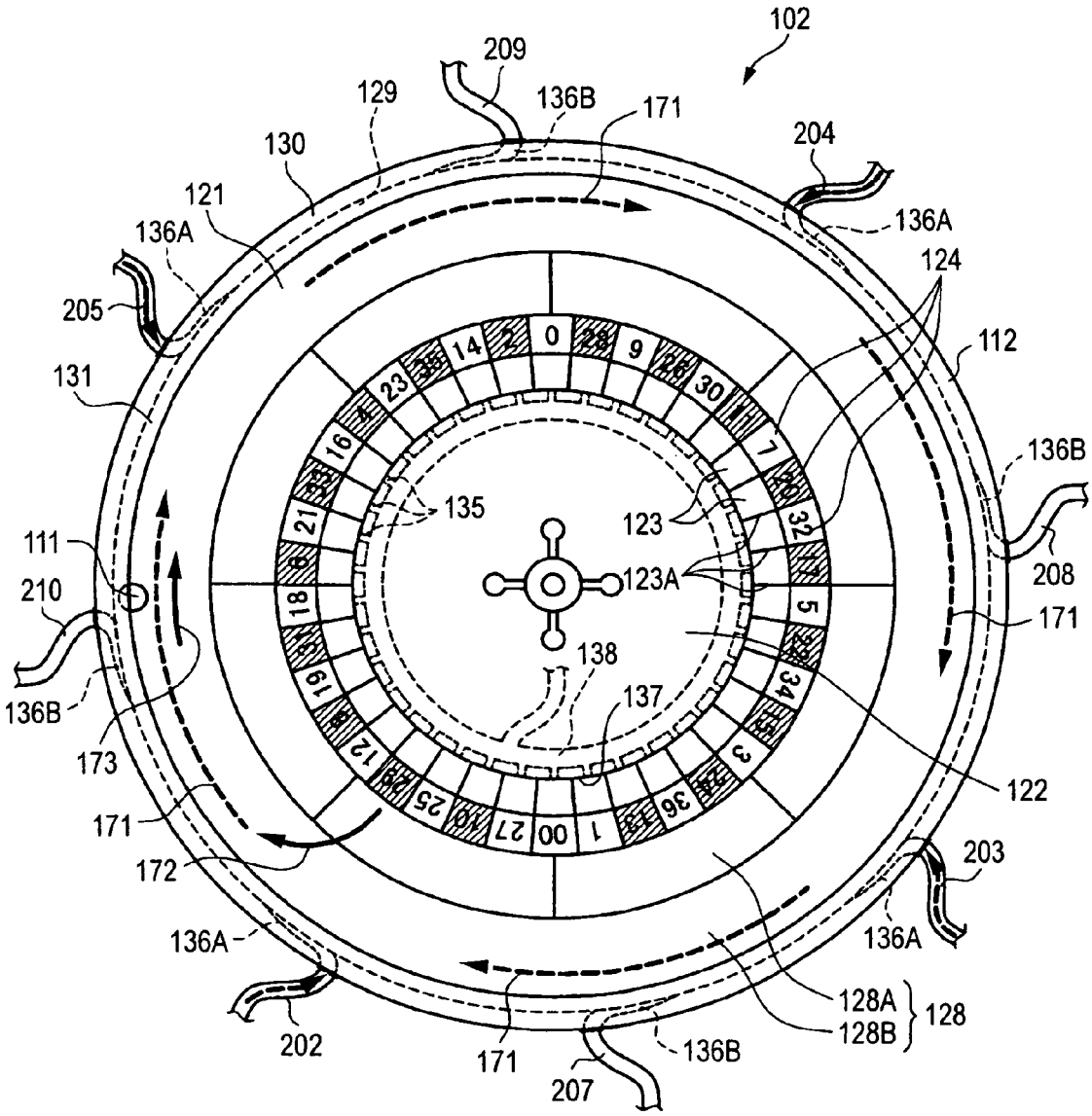
FIG. 30 is a schematic view showing a rolling state of the ball of the roulette apparatus in Step 27.

When the air is discharged from the second discharge nozzles 136A, a layer of the air flowing clockwise along the banked passageway 129 of the roulette wheel 112 is formed to roll the ball 111 clockwise along the banked passageway 129 (see FIG. 30). On the other hand, when the air is discharged from the third discharge nozzles 136B, a layer of the air flowing counterclockwise along the banked passageway 129 of the roulette wheel 112 is formed to roll the ball 111 counterclockwise along the banked passageway 129 (see FIG. 32).

The air tubes 202-205 are connected to the back side surface of the guide wall 130 where the second discharge nozzles 136A are formed. The air tubes 202-205 are four tubes into which the air tube 116 is divided through the distributor 201 as shown in FIG. 15.

When the second on-off valve 119 is opened, the air conveyed through the air tube 116 flows into the air tubes 202-205 through the distributor 201. The air is discharged all at once from the second discharge nozzles 136A provided at four places. Thus, the ball 111 rolling onto the banked passageway 129 due to the air discharged from the first discharge nozzles 135 begins to roll clockwise due to the annular layer of the air flowing along the banked passageway 129.

On the other hand, the air tubes 207-210 are connected to the back side surface of the guide wall 130 where the third discharge nozzles 136B are formed. The air tubes 207-210 are four tubes into which the air tube 117 is divided through the distributor 206 as shown in FIG. 15.

When the third on-off valve 120 is opened, the air conveyed through the air tube 117 flows into the air tubes 207-210 through the distributor 206. The air is discharged all at once from the third discharge nozzles 136B provided at four places. Thus, the ball 111 rolling onto the banked passageway 129 due to the air discharged from the first discharge nozzles 135 begins to roll counterclockwise due to the annular layer of the air flowing along the banked passageway 129.

When the discharge of the air from the second discharge nozzles 136A or the third discharge nozzles 136B is stopped, the layer of the air having formed along the banked passageway 129 disappears. Thus, the rotational velocity of the ball 111 is weakened gradually so that the ball 111 loses the centrifugal force. After that, the ball 111 rolls down to the inner side of the roulette wheel 112 along the inclination of the slope 128, and reaches the rotary disc 122 which is rotating. Then, the ball 111 is received in one of the ball reception grooves 123 formed on the rotary disc 122. After that, a winning number is detected by the light emitter 132 and the light receiver 133, and the roulette gaming machine 101 pays out medals based on the decided number and the bet information as to which number each player has bet on. Then, the game is terminated.

Further, when the air is discharged from the first discharge nozzles 135 after that, the ball 111 received in the ball reception groove 123 begins to roll again. Thus, the next game is played continuously.

In such a manner, a force is applied to the ball 111 due to the air pressure of the air discharged from the first and second discharge nozzles 135 and 136A or the first and third discharge nozzles 135 and 136B so that rolling the ball 111 and receiving the ball 111 in one of the ball reception grooves 123 is performed repeatedly without recovering the ball 111 from the roulette wheel 112. Accordingly, it is not necessary to provide any complicated mechanism such as a movable portion for recovering the ball 111 or a launcher for launching the ball 111, but the maintenance work can be made easy and the equipment cost can be reduced. Further, the discharge nozzles to discharge the air are changed over between the second discharge nozzles 136A and the third discharge nozzles 136B in every game by the operation of the second on-off valve 119 and the third on-off valve 120. Thus, the rolling direction of the ball 111 on the banked passageway 129 is changed in every game.

A mechanism for rolling the ball 111 using the first discharge nozzles 135, the second discharge nozzles 136A and the third discharge nozzles 136B will be described in detail later.

Next, description will be made about the configurations of the control portion 106 and the image display device 107 according to the second embodiment.

The control portion 106 is provided in a side portion of the image display device 107 as shown in FIG. 14. Buttons to be operated by a player are disposed in the control portion 106. Specifically, a BET decision button 145, a payout (CASH-OUT) button 146, a help (HELP) button 147 are disposed in order from the left side in view from a position opposed to the satellite 104.

The BET decision button 145 is a button to be pushed down for deciding a bet after the bet operation using the image display device 107 which will be described later. When a player decides a bet and places the bet on the number indicated in the number indication plate 124 corresponding to the ball reception groove 123 in which the ball 111 is received in the roulette apparatus 102 in a game, the player wins the game. When the player wins the game, credits corresponding to the number of bet chips are added to credits currently possessed by the player. The bet operation will be described in detail later.

The payout button 146 is typically a button to be pushed down when a game is terminated. When the payout button 146 is pushed down, medals corresponding to the credits acquired by games or the like and currently possessed by the player (typically one medal for one credit) are paid out from the medal payout opening 108.

The help button 147 is a button to be pushed down when the player does not know how to operate a game or the like. As soon as the help button 147 is pushed down, a help screen showing various kinds of operation information is displayed on the image display device 107.

Figure 21:
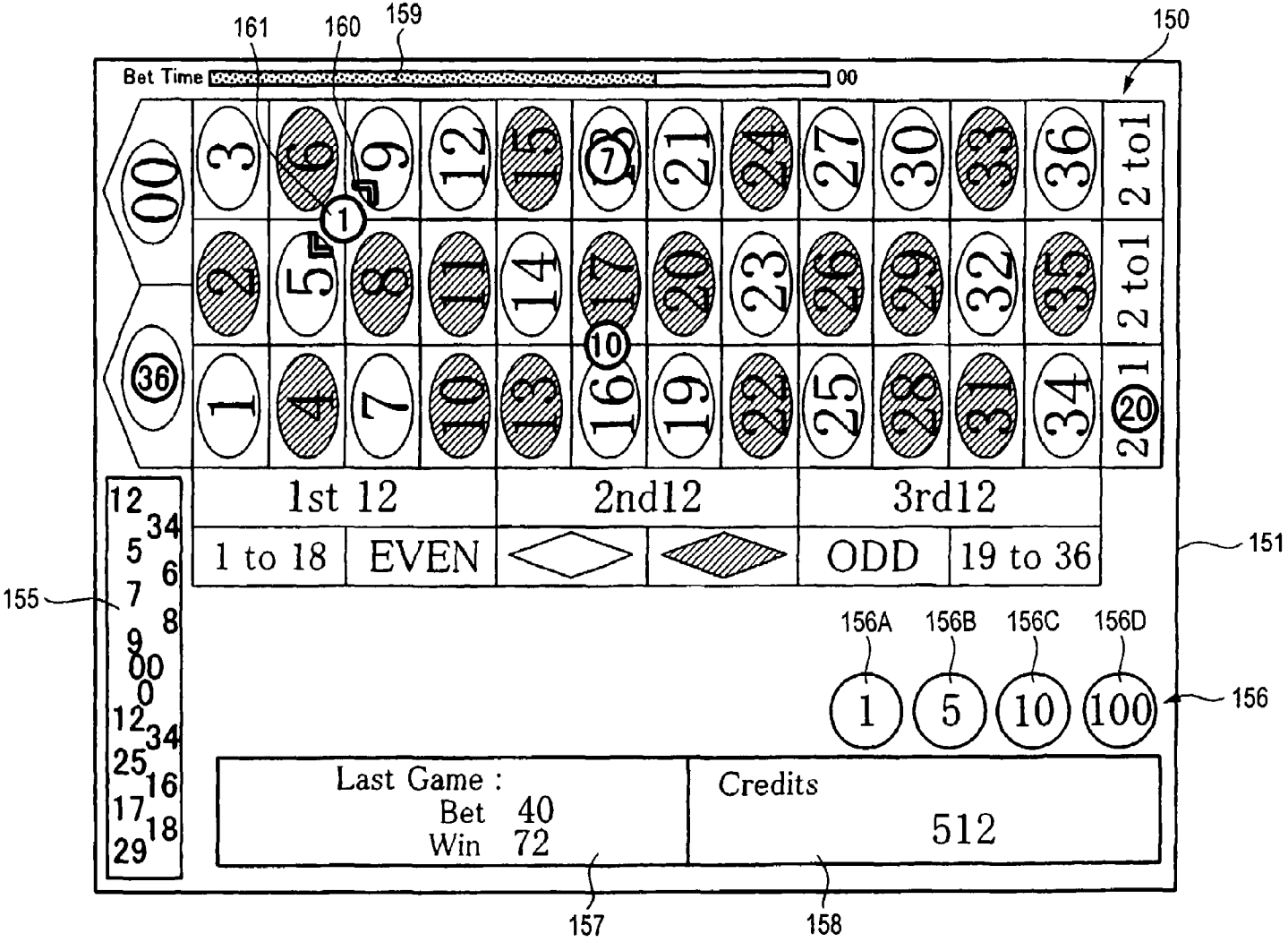
FIG. 21 is a view of an example of a display screen to be displayed on an image display device.

On the other hand, the image display device 107 is a so-called touch-panel liquid crystal display in which a touch panel 148 is attached to the front surface. When an icon displayed on the liquid crystal screen is pressed by a finger or the like, the icon can be selected. FIG. 21 is a view showing an example of a display screen to be displayed on the image display device during a game.

As shown in FIG. 21, a BET screen 151 having a table type betting board 150 is displayed on the image display device 107 during a game in the roulette gaming machine 101. A player operates the BET screen 151 so that the player bets chips using the player's own credits.

The BET screen 151 will be described below with reference to FIG. 21. Numbers the same as the numbers "0", "00" and "1" to "36" indicated on the number indication plates 124 are arrayed and displayed like boxes in the table type betting board 150 displayed on the BET screen 151. In the same manner, special bet areas for identifying "odd numbers", "even numbers", "kinds of color of number indication plates (red or black)", "predetermined number ranges (e.g. "1" to "12" and the like) and betting chips thereon are arrayed like boxes.

Under the table type betting board 150, a result history display portion 155, unit BET buttons 156, a payout result display portion 157 and a credit number display portion 158 are displayed in order from the left of the screen.

The result history display portion 155 shows a list of results of winning numbers in games till the last game (here, one game means a series of operations in which each player bets in each satellite 104, the ball 111 falls in one of the ball reception grooves 123, and credits are paid out based on a winning number). In that event, whenever one game is terminated, a new winning number is added from top and displayed. Thus, the player confirms the history of winning numbers of up to 16 games.

Each unit BET button 156 is a button for betting a BET area (on a box of a number or a symbol, or on a line forming boxes) specified by the player. The unit BET buttons are provided with four kinds, that is, a 1-BET button 156A, a 5-BET button 156B, a 10-BET button 156C and a 100-BET button 156D.

First, when the player pushes a BET area to bet on the screen directly with the player's finger or the like, the BET area is specified by a cursor 160 which will be described later. Whenever the player pushes down the 1-BET button 156A in that state, the player bets one chip (the number of bet chips increases to "1", "2", "3", . . . one by one whenever the 1-BET button 156A is pushed by finger or the like). Whenever the player pushes down the 10-BET button 156C, the player bets 10 chips (the number of bet chips increases to "10", "20", "30", . . . ten by ten whenever the 10-BET button 156C is pushed by finger or the like). The 5-BET button 156B and the 100-BET button 156D are operated similarly. Accordingly, when a large number of chips are to be bet, the operation of the betting is simplified.

The payout result display portion 157 displays the number of bet chips placed by the player in the last game and the number of payout credits paid out to the player in the last game. Here, the number obtained by subtracting the number of bet chips from the number of payout credits is the number of credits newly acquired by the player in the last game.

The credit number display portion 158 displays the number of credits possessed by the current player. When chips are bet, the number of credits is reduced in accordance with the number of bet chips (one credit per one chip). When the number on which chips are bet is hit and credits are paid out, the number of credits increases by the number of paid credits. When the number of credits possessed by the player is 0, the player's game is terminated.

A BET timer graph 159 is provided above the table type betting board 150. The BET timer graph 159 is a graph showing the remaining time in which the player bets. A red graph begins to extend to right gradually as soon as a game starts. When the red graph reaches the right end, the time in which the player bets in the current game is terminated. As soon as the bet time of each player in each satellite 104 is terminated, that is, as soon as the BET timer graph 159 reaches the right end, the air is discharged from the first discharge nozzles 135 so as to initiate rolling of the ball 111 received in one of the ball reception grooves 123.

A cursor 160 indicating a BET area currently selected by the player is displayed on the table type betting board 150. In addition, chip symbols 161 each indicating the number of chips and a BET area bet till now are displayed. The number displayed on each chip symbol 161 indicates the number of bet chips. For example, as shown in FIG. 21, the chip symbol 161 with "7" placed on the box "18" indicates that seven chips have been bet on the number "18". The manner to bet on only one number like this is a bet manner called "straight up".

The chip symbol 161 with "1" placed at the intersection point of the boxes "5", "6", "8" and "9" indicates that one chip has been bet to cover the four numbers "5", "6", "8" and "9". The manner to bet to cover four numbers like this is a bet manner called "corner bet".

Other bet manners include "split bet" to place a chip on a line between two numbers so as to bet to cover two numbers, "street bet" to place a chip on an end of a row of numbers (one lengthwise line in FIG. 21) so as to bet to cover three numbers (for example, "13", "14" and "15"), "five bet" to place a chip on the line between the numbers "00" and "3" so as to bet to cover the five numbers "0", "00", "1", "2" and "3", "line bet" to place a chip on the boundary between two rows of numbers (two lengthwise lines in FIG. 21) so as to bet to cover six numbers (for example, "13", "14", "15", "16", "17" and "18"), "column bet" to place a chip on a box labeled "2 to 1" so as to bet to cover 12 numbers, and "dozen bet" to place a chip on a box labeled "1st 12", "2nd 12" or "3rd 12" so as to bet to cover 12 numbers. Further, there is a bet manner using one of six boxes provided in the lowest stage of the table type betting board 150 so as to bet to cover 18 numbers in accordance with which color to choose as the color of the number indication plates ("red" or "black"), which numbers to choose, odd or even, or which numbers to choose, numbers equal to or smaller than 18 or numbers equal to or larger than 19.

When the player is to bet on the BET screen 151 configured thus, first the player specifies and presses a BET area (on a box of a number or a symbol, or on a line forming boxes) to bet, directly on the screen by finger. As a result, the cursor 160 moves to the specified BET area.

After that, whenever any unit button (1-BET button 156A, 5-BET button 156B, 10-BET button 156C, or 100-BET button 156D) of the unit BET buttons 156 is pushed down, medals corresponding to the unit of the pushed unit button are bet on the specified BET area. For example, when the 10-BET button 156C is pushed four times, the 5-BET button 156B is pushed once, and the 1-BET button 156A is pushed three times, a total of 48 medals can be bet.

Figure 22:
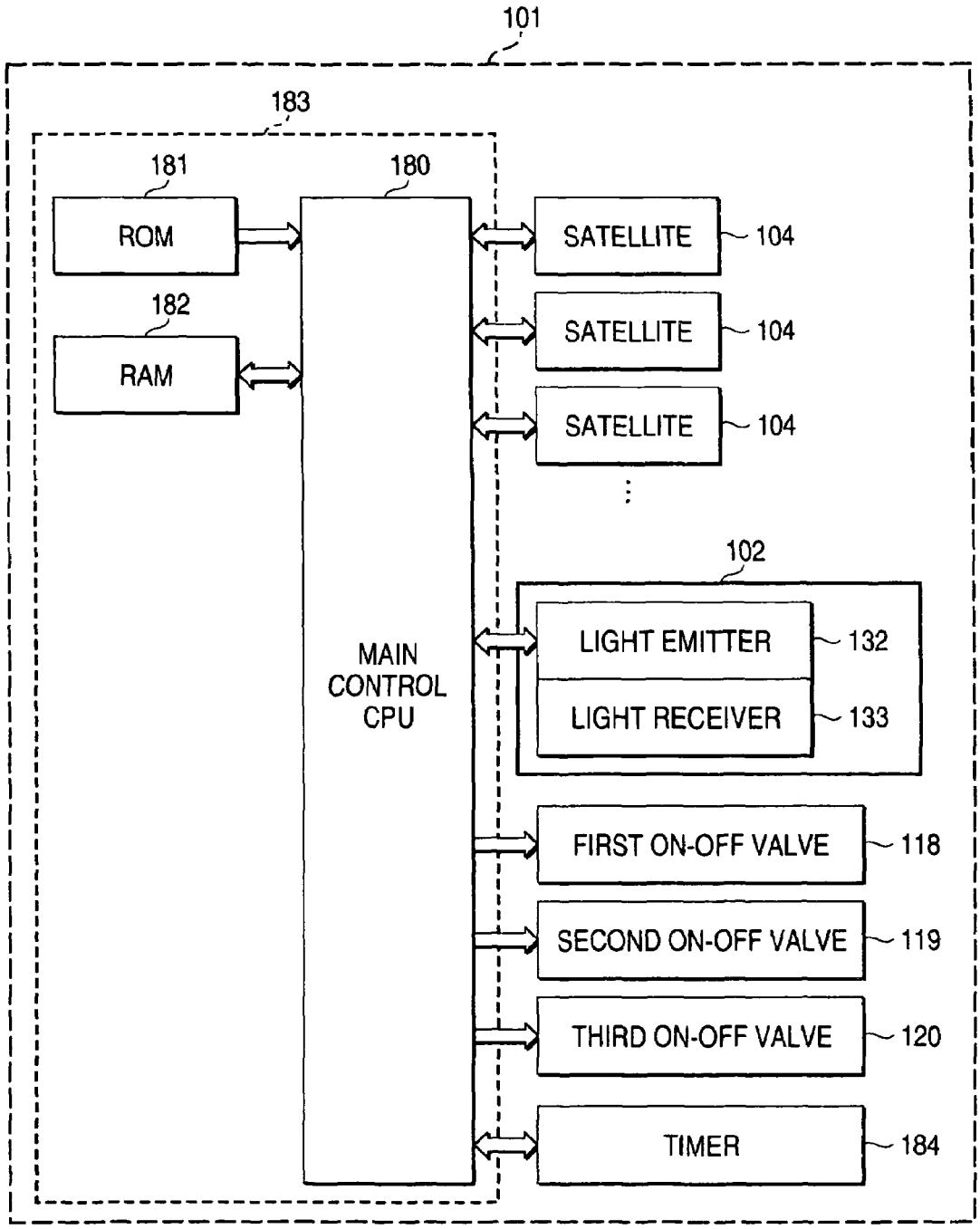
FIG. 22 is a block diagram schematically showing a control system of the roulette gaming machine according to the second embodiment.

Next, the configuration concerning the control system of the roulette gaming machine 101 will be described with reference to FIG. 22. FIG. 22 is a block diagram schematically showing the control system of the roulette gaming machine 101.

As shown in FIG. 22, the roulette gaming machine 101 is provided with a main control portion 183, the roulette apparatus 102, 10 satellites 104, the first on-off valve 118, the second on-off valve 119 and the third on-off valve 120. The main control portion 183 includes a main control CPU 180, a ROM 181 and a RAM 182. The roulette apparatus 102 and the 10 satellites 104 (see FIG. 14) are connected to the main control portion 183. The control system of each satellite 104 will be described in detail later.

The main control CPU 180 performs various processes based on input signals and so on supplied from the satellites 104, and data or programs stored in the ROM 181 and the RAM 182. Based on results of the performed processes, the main control CPU 180 transmits command signals to the satellites 104 so as to control the satellites 104 initiatively and make progress on games. Further, the main control CPU 180 controls the light emitters 132 and the light receivers 133 (see FIG. 18) provided in the roulette apparatus 102 so as to determine a winning number of the ball reception groove 123 where the ball 111 has fallen. Based on the obtained winning number and the bet information transmitted from each satellite 104, the main control CPU 180 determines whether the bet chips are successful or not, and calculates the number of credits to be paid out in the satellite 104.

The ROM 181 is, for example, made of a semiconductor memory or the like, storing a program for implementing the fundamental functions of the roulette gaming machine 101, a program for controlling each device in the roulette apparatus 102, the first on-off valve 118, the second on-off valve 119 and the third on-off valve 120, a program for controlling odds (the number of credits to be paid out for one winning chip) in a normal roulette game using the BET screen 151, and each satellite 104 initiatively, and so on.

On the other hand, the RAM 182 temporarily stores bet chip information supplied from each satellite 104, a winning number of the roulette apparatus 102 determined by the light emitters 132 and the light receivers 133, data about the results of processes executed by the main control CPU 180, and so on.

The first, second and third on-off valves 118, 119 and 120 for adjusting the air pressure in the air tubes 115, 116 and 117 respectively are also connected to the main control CPU 180. When the first on-off valve 118 is opened, the air compressed by the compressor 114 (see FIG. 15) is discharged from the first discharge nozzles 135 provided in the ball reception grooves 123. When the second on-off valve 119 is opened, the air compressed by the compressor 114 is discharged from the second discharge nozzles 136A provided in the banked passageway 129. When the third on-off valve 120 is opened, the air compressed by the compressor 114 is discharged from the third discharge nozzles 136B provided in the banked passageway 129.

As soon as the bet time of each player is terminated in each satellite 104, that is, as soon as the BET timer graph 159 on the BET screen 151 reaches the right end, the first on-off valve 118 is opened for a predetermined time (2 seconds in the second embodiment). As a result, the ball 111 received in one of the ball reception grooves 123 at the time of termination of the last game is rolled toward the banked passageway 129 due to the air pressure.

Successively, the second on-off valve 119 or the third on-off valve 120 is opened to produce a layer of the air flowing along the banked passageway 129 of the roulette wheel 112. Then, the ball 111 rolling toward the banked passageway 129 due to the air pressure from the first discharge nozzles 135 rotates clockwise or counterclockwise along the banked passageway 129 in accordance with the flow of the air layer. In the second embodiment, the second on-off valve 119 and the third on-off valve 120 are changed over to be opened alternately every game (here, one game means a series of processes to begin to accept a bet operation through each satellite 104, allow the ball 111 to begin to roll after the termination of the acceptance, then allow one of the ball reception grooves 123 to receive the ball 111, and detect a winning number) (see FIG. 26).

After that, the second on-off valve 119 or the third on-off valve 120 is closed as soon as a predetermined time (15 seconds in the second embodiment) has passed. Thus, the flow of the air discharged from the second discharge nozzles 136A or the third discharge nozzles 136B is suspended. As a result, the rotational velocity of the ball 111 is weakened gradually so that the ball 111 loses the centrifugal force. Thus, the ball 111 rolls down on the slope 128 and is received in one of the ball reception grooves 123.

The light emitters 132 and the light receivers 133 provided in the roulette apparatus 102 are connected to the main control CPU 180. A pair of a light emitter 132 and a light receiver 133 are provided in each ball reception groove 123 as described previously. When the ball 111 enters the ball reception groove 123, the ball 111 blocks the light so that the existence of the ball 111 is detected. Accordingly, when the ball 111 enters one ball reception groove 123, the existence of the ball 111 is detected by a light sensor comprised of a light emitter 132 and a light receiver 133, a detection signal is transmitted to the main control CPU 180. Based on the result of the detection, the main control CPU 180 determines a winning number.

A timer 184 for measuring time is connected to the main control CPU 180. Time information of the timer 184 is transmitted to the main control CPU 180. Based on the time information of the timer 184, the main control CPU 180 opens/closes the first on-off valve 118, the second on-off valve 119 and the third on-off valve 120 as will be described later.

Figure 24:
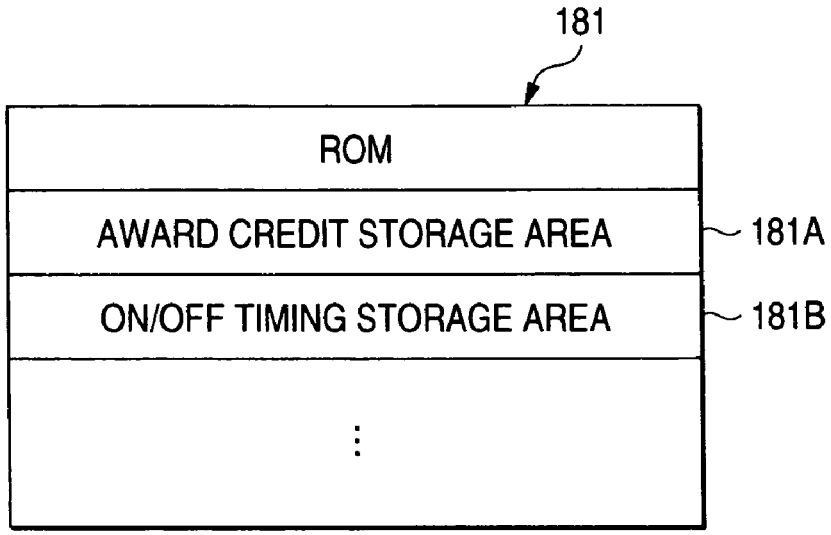
FIG. 24 is a schematic diagram showing storage areas of a ROM of the roulette gaming machine according to the second embodiment.

As shown in FIG. 24, the ROM 181 is provided with an award credit storage area 181A and an on/off timing storage area 181B. The award credit storage area 181A stores odds about roulette games using the BET screen 151. The on/off timing storage area 181B stores on/off timings of the first on-off valve 118, the second on-off valve 119 and the third on-off valve 120. Odds for respective BET areas on the BET screen 151 are stored in the award credit storage area 181A, ranging from "×2" to "×36" in accordance with their bet manners ("straight up", "corner bet", "split bet", etc.).

Figure 26:
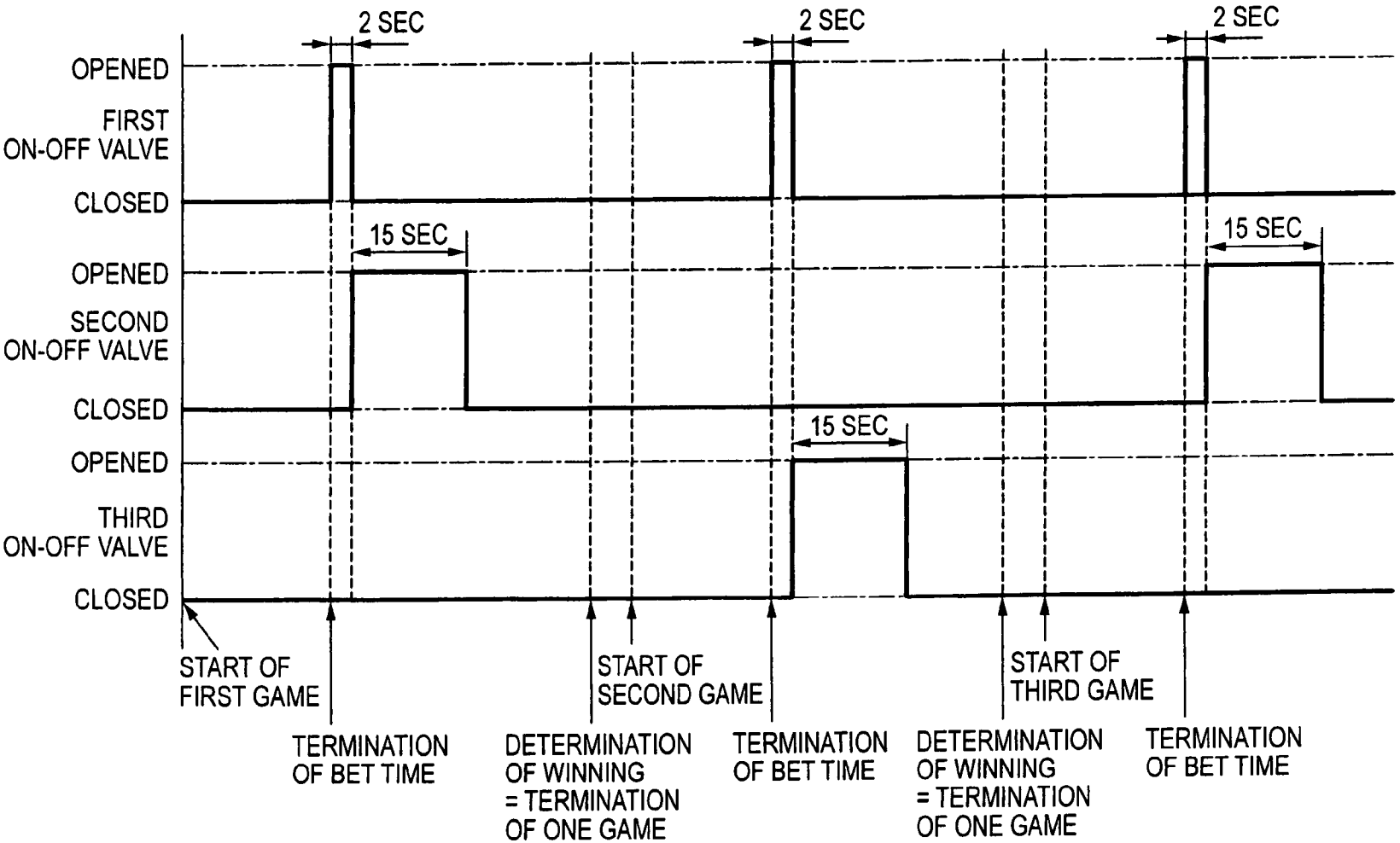
FIG. 26 is an explanatory diagram showing on/off timings of a first on-off valve, a second on-off valve and a third on-off valve.

Next, with reference to FIG. 26, description will be made about the on/off timings of the first on-off valve 118, the second on-off valve 119 and the third on-off valve 120 stored in the on/off timing storage area 181B of the ROM 181. FIG. 26 is an explanatory diagram showing on/off timings of a first on-off valve, a second on-off valve and a third on-off valve.

As shown in FIG. 26, when a first game is first started, a bet time for each player to bet chips in each satellite 104 is first started. As soon as the bet time is terminated (the BET timer graph 159 on the BET screen 151 reaches the right end), the main control CPU 180 opens the first on-off valve 118 for a predetermined time (2 seconds in the second embodiment). Successively the main control CPU 180 opens the second on-off valve 119 so as to produce an annular layer of the air flowing along the banked passageway 129 of the roulette wheel 112 (see FIG. 30). Then, the ball 111 rolling toward the banked passageway 129 due to the air pressure from the first discharge nozzles 135 rotates clockwise along the banked passageway 129 in accordance with the flow of the air.

After that, the main control CPU 180 closes the second on-off valve 119 as soon as a predetermined time (15 seconds in the second embodiment) has passed. Thus, the air discharged from the second discharge nozzles 136A is suspended so that the rotational velocity of the ball 111 is weakened gradually. The circle drawn by the ball 111 becomes smaller gradually, and finally the ball 111 loses the centrifugal force so that the ball 111 rolls down on the slope 128 and is received in one of the ball reception grooves 123. A winning number is determined by a light sensor of the light emitter 132 and the light receiver 133, and medals are paid out. Thus, the first game is terminated.

Further, when a second game is started continuously, a bet time of each satellite 104 is started in the same manner. As soon as the bet time is terminated, the main control CPU 180 opens the first on-off valve 118 for a predetermined time (2 seconds in the second embodiment). Successively the main control CPU 180 opens the third on-off valve 120 in this time so as to produce an annular layer of the air flowing along the banked passageway 129 of the roulette wheel 112 (see FIG. 21). Then, the ball 111 rolling toward the banked passageway 129 due to the air pressure from the first discharge nozzles 135 rotates counterclockwise along the banked passageway 129 in accordance with the flow of the air.

After that, the main control CPU 180 closes the third on-off valve 120 as soon as a predetermined time (15 seconds in the second embodiment) has passed. Thus, the air discharged from the third discharge nozzles 136B is suspended so that the rotational velocity of the ball 111 is weakened gradually. The circle drawn by the ball 111 becomes smaller gradually, and finally the ball 111 loses the centrifugal force so that the ball 111 rolls down on the slope 128 and is received in one of the ball reception grooves 123. A winning number is determined by a light sensor of the light emitter 132 and the light receiver 133, and medals are paid out. Thus, the second game is terminated.

When a third game is started after that, a bet time of each satellite 104 is started in the same manner. When the bet time is terminated, the main control CPU 180 opens the first on-off valve 118 for a predetermined time, and then opens the second on-off valve 119 in this time in the same manner as in the first game. When games are performed repeatedly after that, games in which the second on-off valve 119 is opened to roll the ball 111 clockwise and games in which the third on-off valve 120 is opened to roll the ball 111 counterclockwise are performed alternately. A roulette game processing program based on on/off timings of the first on-off valve 118, the second on-off valve 119 and the third on-off valve 120 will be described in detail later with reference to the flow chart (see FIG. 27).

Figure 25:
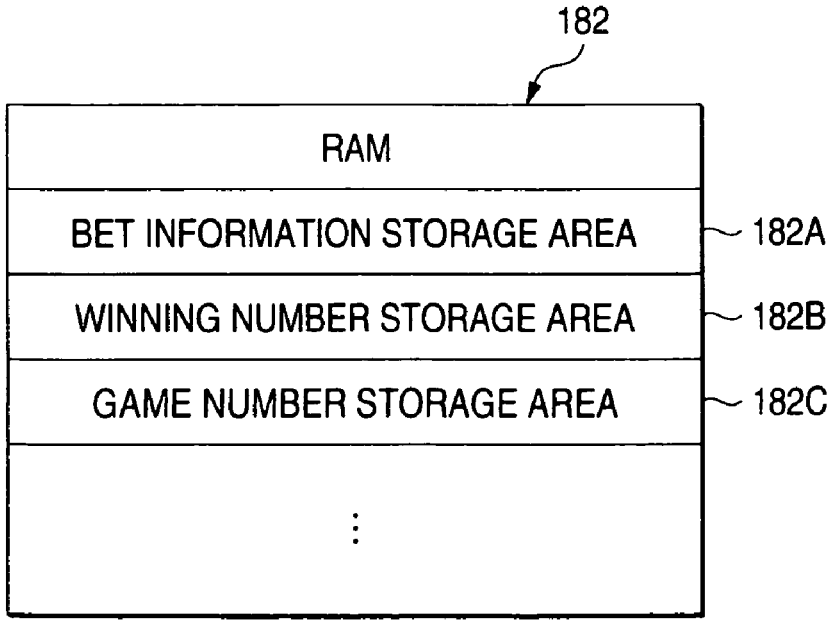
FIG. 25 is a schematic diagram showing storage areas of a RAM of the roulette gaming machine according to the second embodiment.

The RAM 182 is provided with a bet information storage area 182A, a winning number storage area 182B and a game number storage area 182C as shown in FIG. 25. The bet information storage area 182A stores bet information of each player gaming currently. The winning number storage area 182B stores a winning number of the roulette wheel 112 determined by the light emitter 132 and the light receiver 133. The game number storage area 182C counts the number of games which have been performed till now. Specifically the bet information includes BET areas specified on the BET screen 151, and the number of chips bet in each BET area.

Figure 23:
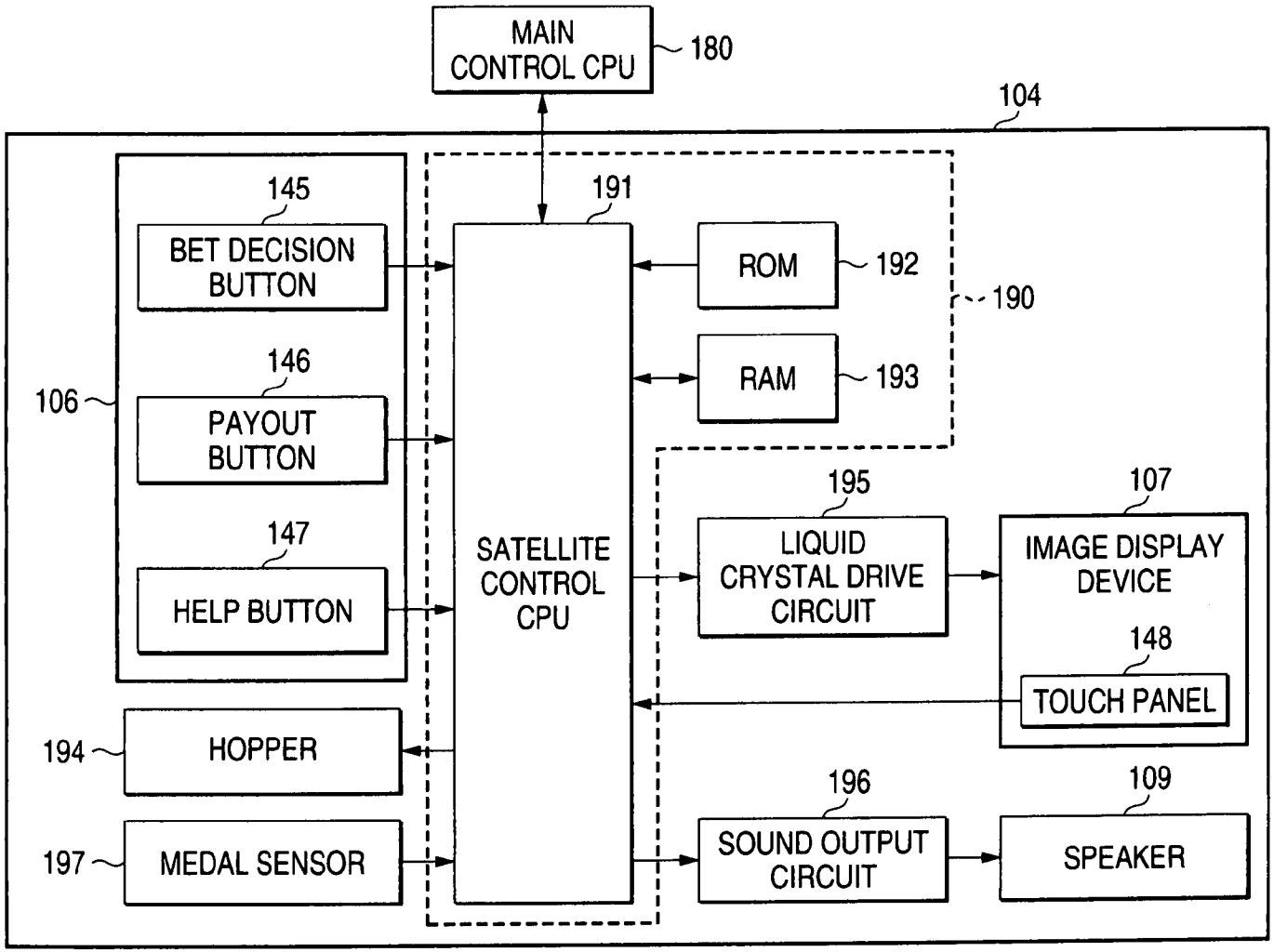
FIG. 23 is a block diagram schematically showing a control system of a satellite according to the second embodiment.

Next, the configuration concerning the control system of each satellite 104 connected to the CPU 180 of the main control portion 183 will be described with reference to FIG. 23. FIG. 23 is a block diagram schematically showing the control system of the satellite according to the second embodiment. The ten satellites 104 have fundamentally one and the same configuration, and one of the satellites 104 will be described below by way of example.

As shown in FIG. 23, the satellite 104 is provided with a satellite control portion 190 and some peripheral devices/instruments. The satellite control portion 190 is provided with a satellite control CPU 191, a ROM 192 and a RAM 193. The ROM 192 is, for example, comprised of a semiconductor memory or the like, storing a program for implementing the fundamental functions of the satellite 104, various other programs required for controlling the satellite 104, data tables, etc. On the other hand, the RAM 193 is a memory for temporarily storing various data calculated by the satellite control CPU 191, the number of credits currently possessed by the player, the state of chips bet by the player, etc.

The BET decision button 145, the payout button 146 and the help button 147 provided in the control portion 106 (see FIG. 14) are connected to the satellite control CPU 191 individually. Based on operation signals output in response to pushing down or the like on the respective buttons, the satellite control CPU 191 controls to execute various operations corresponding to the operation signals. Specifically, the satellite control CPU 191 executes various processes based on input signals supplied from the control portion 106 in response to operations input by the player, and data or programs stored in the ROM 192 and the RAM 193. The satellite control CPU 191 transmits the results of the various processes to the aforementioned main control CPU 180 of the main control portion 183.

The satellite control CPU 191 receives command signals from the main control CPU 180 and controls the peripheral devices constituting the satellite 104 so as to make progress on roulette games in the satellite 104. Alternatively, for the contents of some processes, the satellite control CPU 191 executes various processes based on input signals supplied from the control portion 106 in response to operations input by the player, and data or programs stored in the ROM 192 and the RAM 193. Based on the results of the various processes, the satellite control CPU 191 controls the peripheral devices constituting the satellite 104 so as to make progress on roulette games in the satellite 104. Which method is used to perform a process is set individually in accordance with the contents of the process. For example, a process to pay out medals for the winning number is executed by the former method, while a process for the player to bet on the BET screen 151 is executed by the latter method.

A hopper 194 is also connected to the satellite control CPU 191. In accordance with a command signal from the satellite control CPU 191, the hopper 194 pays out a given number of medals from the medal payout opening 108 (see FIG. 14).

Further, the image display device 107 is connected to the satellite control CPU 191 through a liquid crystal drive circuit 195. In terms of this point, the liquid crystal drive circuit 195 is provided with a program ROM, an image ROM, an image control CPU, a work RAM, a VDP (Video Display Processor), a video RAM, etc. The program ROM stores an image control program and various selection tables concerned with display on the image display device 107. The image ROM, for example, stores dot data (bitmap data) for forming images to be displayed on the image display device 107. The image control CPU decides, of the dot data stored in the image ROM in advance, an image to be displayed on the image display device 107 based on parameters set in the satellite control CPU 191 and in accordance with the image control program stored in the program ROM in advance. The work RAM is arranged as a temporary storage for executing the image control program in the image control CPU. The VDP serves to form an image corresponding to the display contents decided by the image control CPU, and output the decided image to the image display device 107. The video RAM is arranged as a temporary storage for forming an image in the VDP.

The touch panel 148 is attached to the front surface of the image display device 107 as described previously. Operation information of the touch panel 148 is transmitted to the satellite control CPU 191. In the touch panel 148, an operation for the player to bet chips is performed on the BET screen 151. Specifically, the touch panel 148 is operated for selection of a BET area, operation on each unit BET button 156, etc. The information of the operations is transmitted to the satellite control CPU 191. Based on the transmitted information, bet information (BET areas specified on the BET screen 151, and the number of chips bet in each BET area) of the current player is stored in the RAM 193 in accordance with necessity. Further, the bet information is transmitted to the main control CPU 180, and stored in the bet information storage area 182A of the RAM 182.

Further, a sound output circuit 196 and the speaker 109 are connected to the satellite control CPU 191. The speaker 109 generates various sound effects for providing various presentations based on output signals from the sound output circuit 196.

A medal sensor 197 is also connected to the satellite control CPU 191. The medal sensor 197 detects medals inserted into the medal insertion slot 105 (FIG. 14), calculates the inserted medals and transmits the result of the calculation to the satellite control CPU 191. Based on the transmitted signal, the satellite control CPU 191 increases the number of credits of the player stored in the RAM 193.

Figure 27:
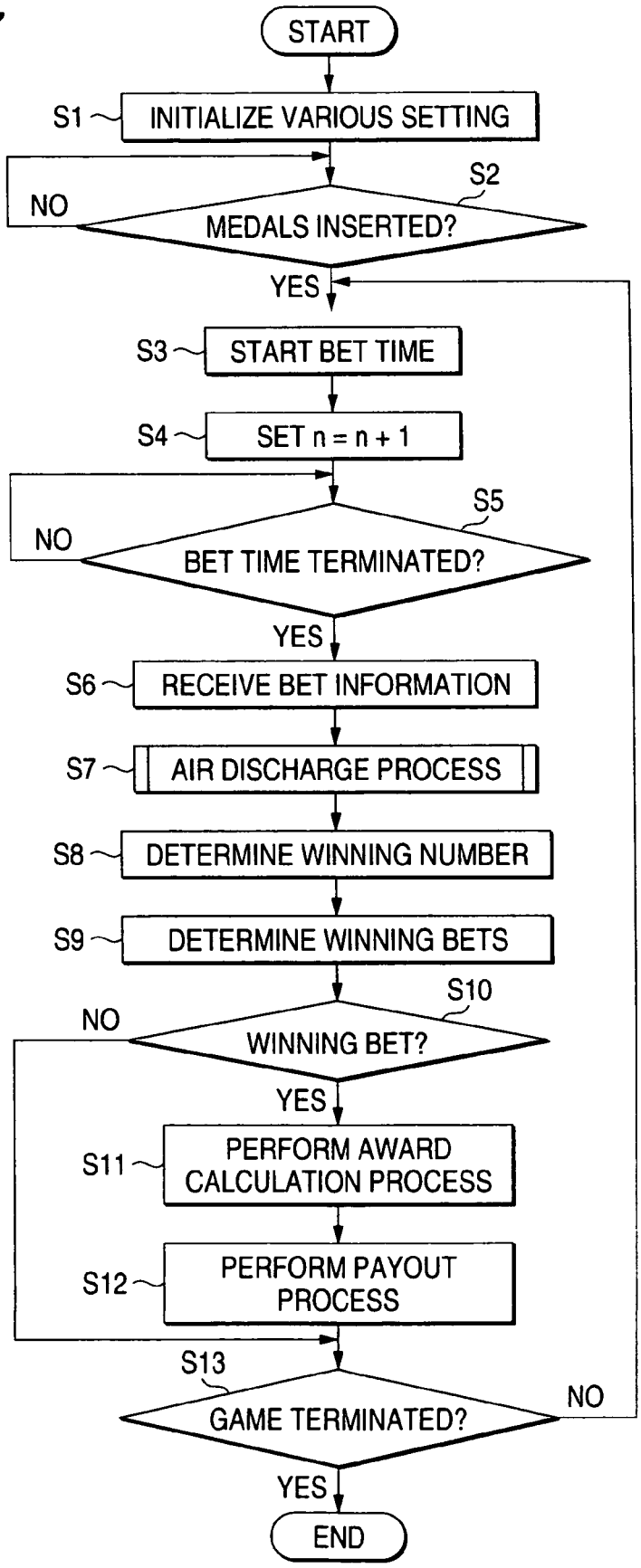
FIG. 27 is a flow chart showing a roulette game process program according to the second embodiment.

Subsequently, a game processing program in the roulette gaming machine 101 will be described with reference to FIG. 27. FIG. 27 is a flow chart of the roulette game processing program in the roulette gaming machine. Each program shown in the flow chart of FIG. 27 is stored in the ROM 181 or the RAM 182 belonging to the roulette gaming machine 101, and executed by the main control CPU 180.

First, in Step (hereinafter abbreviated to "S") 1, the main control CPU 180 initializes each storage area and stores a default value therein. At that time, "0" is set in the number N of games stored in the game number storage area 82C of the RAM 182.

Subsequently, the main control CPU 180 determines whether medals or coins are inserted by a player or not (S2). In the roulette gaming machine 101 according to the second embodiment, when medals or coins are inserted into the medal insertion slot 105 of any one of the satellites 104, the insertion is detected and transmitted to the satellite control CPU 191 by the corresponding medal sensor 197. After that, a medal insertion signal is further transmitted from the satellite 104 to the satellite control portion 183. Thus, the main control CPU 180 determines whether medals or coins are inserted by the player or not. When medals or coins are not inserted (S2: NO), the main control CPU 180 waits till medals or coins are inserted. When medals or coins are inserted (S2: YES), the main control CPU 180 proceeds the process to S3. When medals or coins are inserted, data of credits corresponding to the number of the inserted medals or coins is recorded in the RAM 193 of the corresponding satellite control portion 190.

The BET screen 151 shown in FIG. 21 is displayed on the image display device 107 of the satellite 104 used by the player so that the player bets chips. Other players may take part in the middle of the game. In the roulette gaming machine 101 according to the second embodiment, up to 10 players can play.

A bet time as an acceptable time in which players bet is started at the time when the first player to take part in the game inserts medals or coins (S3). At the same time, the number N of games stored in the game number storage area 182C of the RAM 182 is read, and the value of the number N is increased by "+1" and stored in the RAM 182 again (S4).

When the game in question is to be performed continuously to the last game, the bet time is started as soon as the last game is terminated. Each player taking part in the game operates the touch panel 148 during the bet time so as to bet the player's own chips on BET areas corresponding to numbers the player expects (see FIG. 21). The specific bet manners using the BET screen 151 have been already described, description thereof will be omitted here.

Next, in S5, it is determined whether the bet time is terminated or not. Here, the bet time is indicated by the BET timer graph 159, and the red graph begins to extend to right gradually from the start of the bet time (S3). As soon as the red graph reaches the right end, the bet time in the current game is terminated.

Here, when the bet time is not terminated (S5: NO), bets are accepted continuously. When the bet time is terminated (S5: YES), a bet termination signal is output to the satellite control portion 190 of each satellite 104. On the liquid crystal screen of each satellite 104, an image showing the termination of betting is displayed, and any bet operation on the touch panel 148 is prohibited. Bet information (specified BET areas, and the number of chips bet on each specified BET area) of each player in each satellite 104 is received (S6), and stored in the bet information storage area 182A of the RAM 182.

Next, the main control CPU 180 executes an air discharge process by the roulette apparatus 102 in accordance with a game execution program in S7. The air discharge process is a process to open/close the on-off valves 118-120 to thereby roll the ball 111 on the roulette wheel 112 or receive the ball 111 in one of the ball reception grooves 123, and draw a winning number. The air discharge process will be described in detail later.

After the ball 111 is received in one of the ball reception grooves 123 on the rotary disc 122 due to the air discharge process, which ball reception groove 123 the ball 111 has dropped into is detected by a pair of the light emitter 132 and the light receiver 133, and the main control CPU 180 determines a winning number (one of "0", "00" and "1" to "36") (S8).

Further, the main control CPU 180 determines whether chips bet in each satellite 104 are hit or not, based on the bet information of each satellite 104 received in S6 and the winning number determined in S8 (S9).

Based on the determination of winning in S9, it is determined whether chips bet in at least one satellite 104 are hit or not (S10). When it is concluded that chips are hit (S10: YES), the main control CPU 180 executes an award calculation process (S11). In the award calculation process, winning chips are recognized for each satellite 104, and the total amount of awards of credits to be paid out to the satellite 104 is calculated using odds (the number of credits to be paid out per chip) for BET areas stored in the award credit storage area 181A of the ROM 181. Then, the main control CPU 180 proceeds the process to S12.

On the other hand, when it is concluded that there is no winning chip in any satellite 104 (S10: NO), the main control CPU 180 proceeds the process to S13.

In S12, a payout process to pay out credits based on the award calculation process in S11 is executed. When credits are to be paid out to each satellite 104, credit data corresponding to awards are output to the satellite control portion 190 of each winning satellite 104 from the main control portion 183. The credit data are added to the RAM 193 of the corresponding satellite 104.

In S13, it is determined whether gaming will be performed continuously in at least one satellite 104 or not. When any player wants to terminate a game, the player usually pushes down the payout button 146. When the payout button 146 is pushed down, medals (typically one medal per credit) corresponding to credits acquired by games or the like and currently possessed by the player are paid back from the medal payout opening 108 by the hopper 194.

When gaming is performed continuously in any one of the satellites 104 (S13: NO), the main control CPU 180 returns to S3, where the bet time is started again, and the next game is advanced.

On the other hand, when gaming is terminated in any satellite 104 (S13: YES), the roulette game process is terminated.

Figure 28:
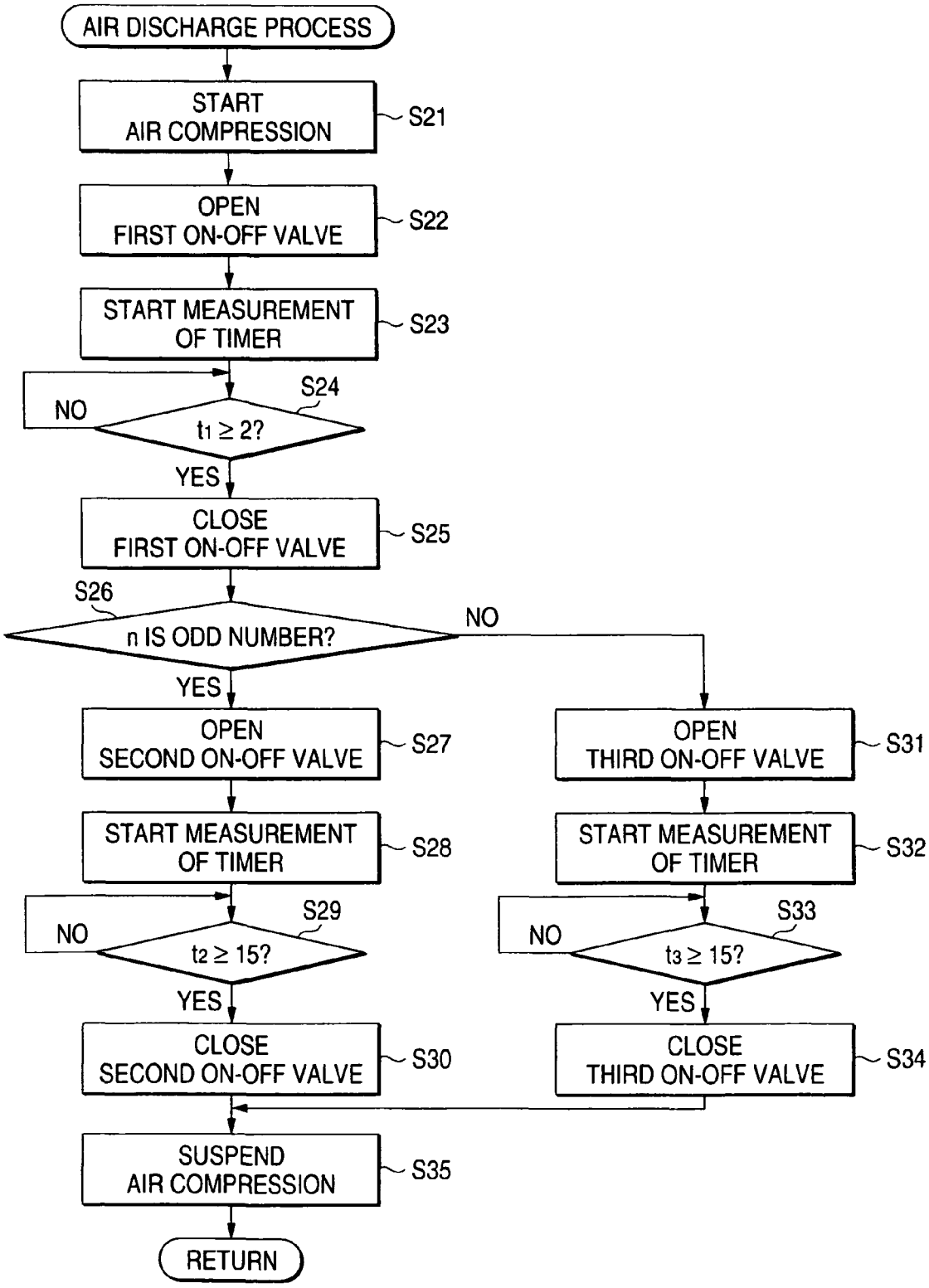
FIG. 28 is a flow chart showing an air discharge process program according to the second embodiment.

Subsequently the air discharge process program in S7 will be described with reference to FIG. 28. FIG. 28 is a flow chart of the air discharge process program in the roulette gaming machine. Each program shown in the flowchart of FIG. 28 is stored in the ROM 181 or the RAM 182 belonging to the roulette gaming machine 101, and executed by the main control CPU 180.

Figure 29:
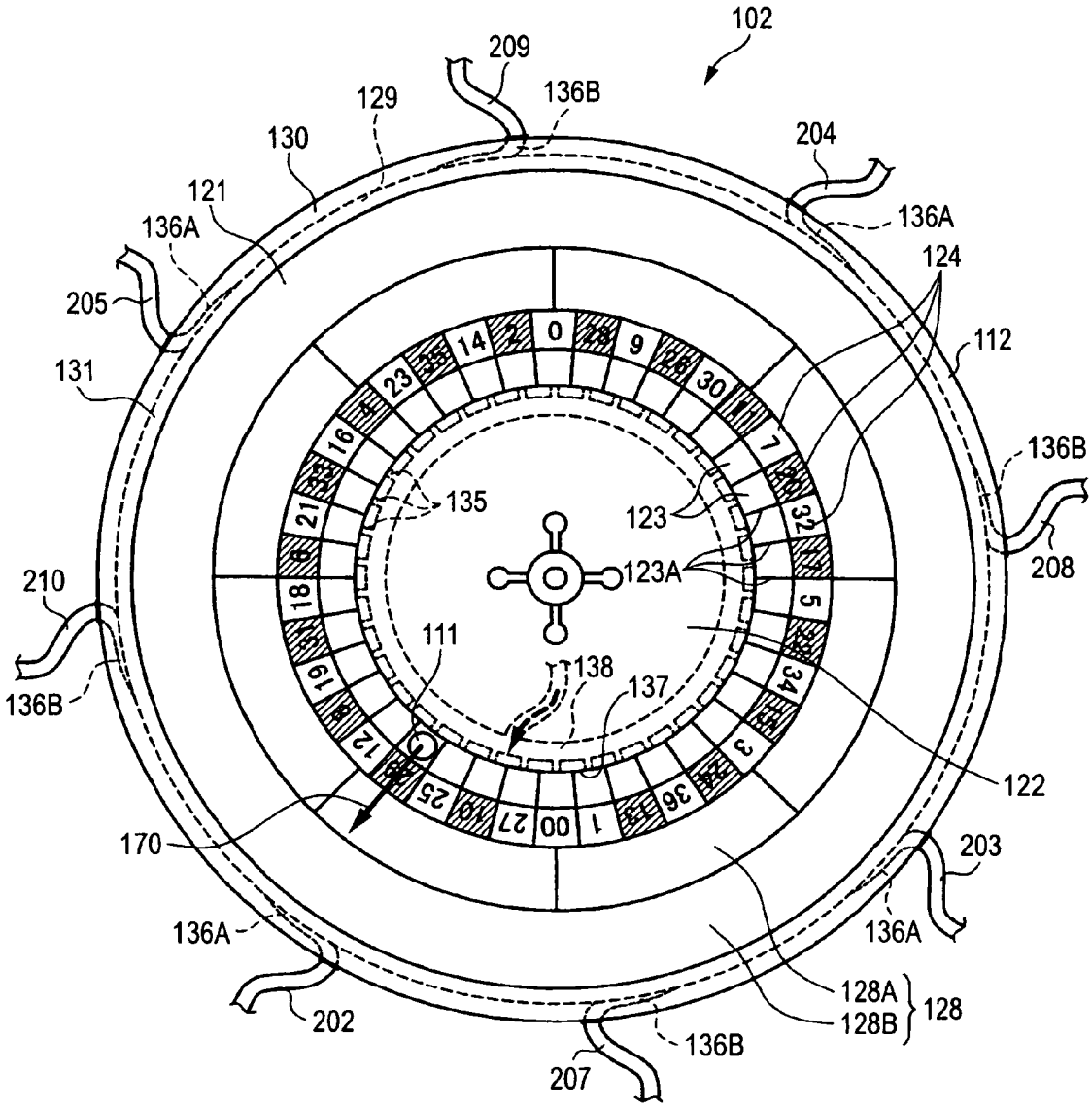
FIG. 29 is a schematic view showing a rolling state of a ball of the roulette apparatus in Step 22.

First, the power of the compressor 114 is turned on in S21 so as to start air compression of the compressor 114. After that, the first on-off valve 118 is opened (S22). Here, the first on-off valve 118 is provided in the air tube 115 for conveying the air compressed by the compressor 114 to the first discharge nozzles 135 as described previously, so that the first on-off valve 118 adjusts the air pressure of the air passing through the air tube 115. When the first on-off valve 118 is opened, the compressed air begins to be discharged from the first discharge nozzles 135. Thus, the air pressure is applied to the ball 111 received in one of the ball reception grooves 123 so as to roll the ball 111 toward the banked passageway 129 against the inclination of the slope 128. FIG. 29 is a schematic view showing the rolling state of the ball of the roulette apparatus in Step 22.

As shown in FIG. 29, when the first on-off valve 118 is opened in S22, the ball 11 received in one of the ball reception grooves 123 is rolled toward the banked passageway 129 (in the arrow 170 direction) due to the air pressure from the first discharge nozzles 135 provided in the ball reception grooves 123.

Next, the timer 184 begins to measure time in S23, and the main control CPU 180 determines whether a predetermined time (2 seconds in the second embodiment) has passed or not since the first on-off valve 118 was opened (S24). When a measured value t1 since the first on-off valve 118 was opened is smaller than 2 seconds (S24: NO), the first on-off valve 118 is opened continuously.

On the other hand, when the measured time t1 since the first on-off valve 118 was opened is not smaller than 2 seconds (S24: YES), the main control CPU 180 proceeds the process to S25.

In S25, the main control CPU 180 closes the first on-off valve 118 so as to suspend the discharge of the air from the first discharge nozzles 135. Subsequently the main control CPU 180 reads the number N of games stored in the game number storage area 182C of the RAM 182, and determines whether the read value is "odd" or not (S26).

As a result, when the value of N is "odd" (S26: YES), that is, when the current game is one of the first, third, fifth, seventh, ninth, . . . , the main control CPU 180 proceeds the process to S27 and opens the second on-off valve 119. Here, the second on-off valve 119 is provided in the air tube 116 for conveying the air compressed by the compressor 114 to the second discharge nozzles 136A as described previously, so that the second on-off valve 119 adjusts the air pressure of the air passing through the air tube 116. When the second on-off valve 119 is opened, the compressed air begins to be discharged from the second discharge nozzles 136A formed in the periphery of the banked passageway 129 through the air tubes 202-205. Thus, a layer of the air flowing clockwise along the banked passageway 129 is generated so that the ball 111 rolled onto the banked passageway 129 in S22 begins to roll in a circular orbit in accordance with the discharged air pressure. FIG. 30 is a schematic view showing the rolling state of the ball of the roulette apparatus in Step 27.

As shown in FIG. 30, when the second on-off valve 119 is opened in S27, a flow of the air flowing clockwise (in the arrow 171 direction) along the banked passageway 129 is formed on the roulette wheel 112 due to the air discharged from the second discharge nozzles 136A provided in the banked passageway 129. The rolling direction of the ball 111 rolled toward the banked passageway 129 due to the air pressure from the first discharge nozzles 135 is changed to the circumferential direction of the roulette wheel 112 due to the air pressure from the second discharge nozzles 136A (see the arrow 172). Further, the ball 11 applied with the air pressure from the second discharge nozzles 136A is rolled toward the outer circumferential edge of the roulette wheel 112 gradually due to the centrifugal force. Thus, the ball 111 begins to roll along the banked passageway 129 (see the arrow 173). Here, the banked passageway 129 guides the ball 111 against the centrifugal force of the ball 111 rolling on the roulette wheel 112 so as to roll the ball 111 in a circular orbit. Further, due to the wall portion 131 formed contiguously to the banked passageway 129 in the upper end corresponding to the outer circumferential portion of the banked passageway 129, the ball 111 having a rotary motion on the banked passageway 129 is prevented from jumping out of the roulette wheel 112.

Next, the timer 184 begins to measure time in S28, and the main control CPU 180 determines whether a predetermined time (15 seconds in the second embodiment) has passed or not since the second on-off valve 119 was opened (S29). When a measured value t2 since the second on-off valve 119 was opened is smaller than 15 seconds (S29: NO), the second on-off valve 119 is opened continuously.

On the other hand, when the measured time t2 since the second on-off valve 119 was opened is not smaller than 15 seconds (S29: YES), the main control CPU 180 proceeds the process to S30.

In S30, the main control CPU 180 closes the second on-off valve 119 so as to suspend the discharge of the air from the second discharge nozzles 136A. Further, the main control CPU 180 turns off the power of the compressor 114 in S35 so as to suspend the air compression of the compressor 114. Then, the main control CPU 180 terminates the air discharge process and returns to S8.

Figure 31:
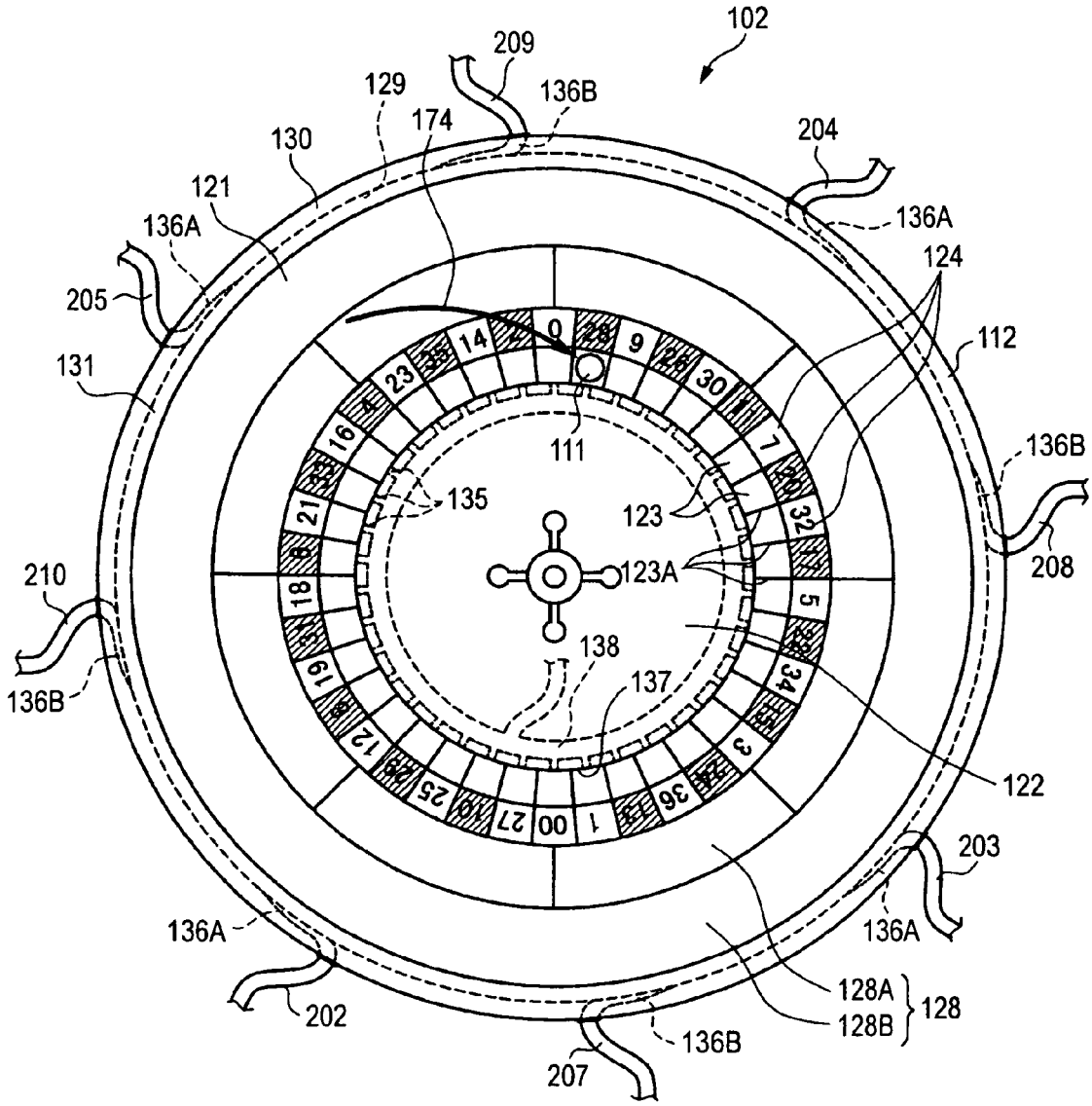
FIG. 31 is a schematic view showing a rolling state of the ball of the roulette apparatus in Step 35.

When the discharge of the air from the second discharge nozzles 136A is suspended, the ball 111 rolling along the banked passageway 129 receives no air pressure from the second discharge nozzles 136A. Thus, the rotational velocity of the ball 111 drops gradually so that the centrifugal force is lowered. Finally the ball 111 rolls down on the slope 128 and toward the inner side of the roulette wheel 112, and reaches the rotary disc 122 which is rotating. FIG. 31 is a schematic view showing the rolling state of the ball in the roulette apparatus in Step 30.

As shown in FIG. 31, when the second on-off valve 119 is closed in S30, the air discharged from the second discharge nozzles 136A provided along the banked passageway 129 is suspended. Thus, the rotational velocity of the ball 111 receiving no air pressure drops gradually. The ball 111 whose centrifugal force is lowered in accordance with the velocity keeps on drawing a circular orbit while moving inward from the banked passageway 129 along the inclination of the slope 128 gradually. Finally, the ball 111 rolls down on the slope 128 and toward the inner side, and reaches the rotary disc 122 which is rotating (see the arrow 174).

The ball 111 rolling toward the rotary disc 122 passes over one number indication plate 124 on the outer side of the rotary disc 122 rotating, and is received in one of the ball reception grooves 123. The number (one of "0", "00" and "1" to "36") printed on the number indication plate 124 corresponding to the ball reception groove 123 where the ball 111 is received is a winning number.

Figure 32:
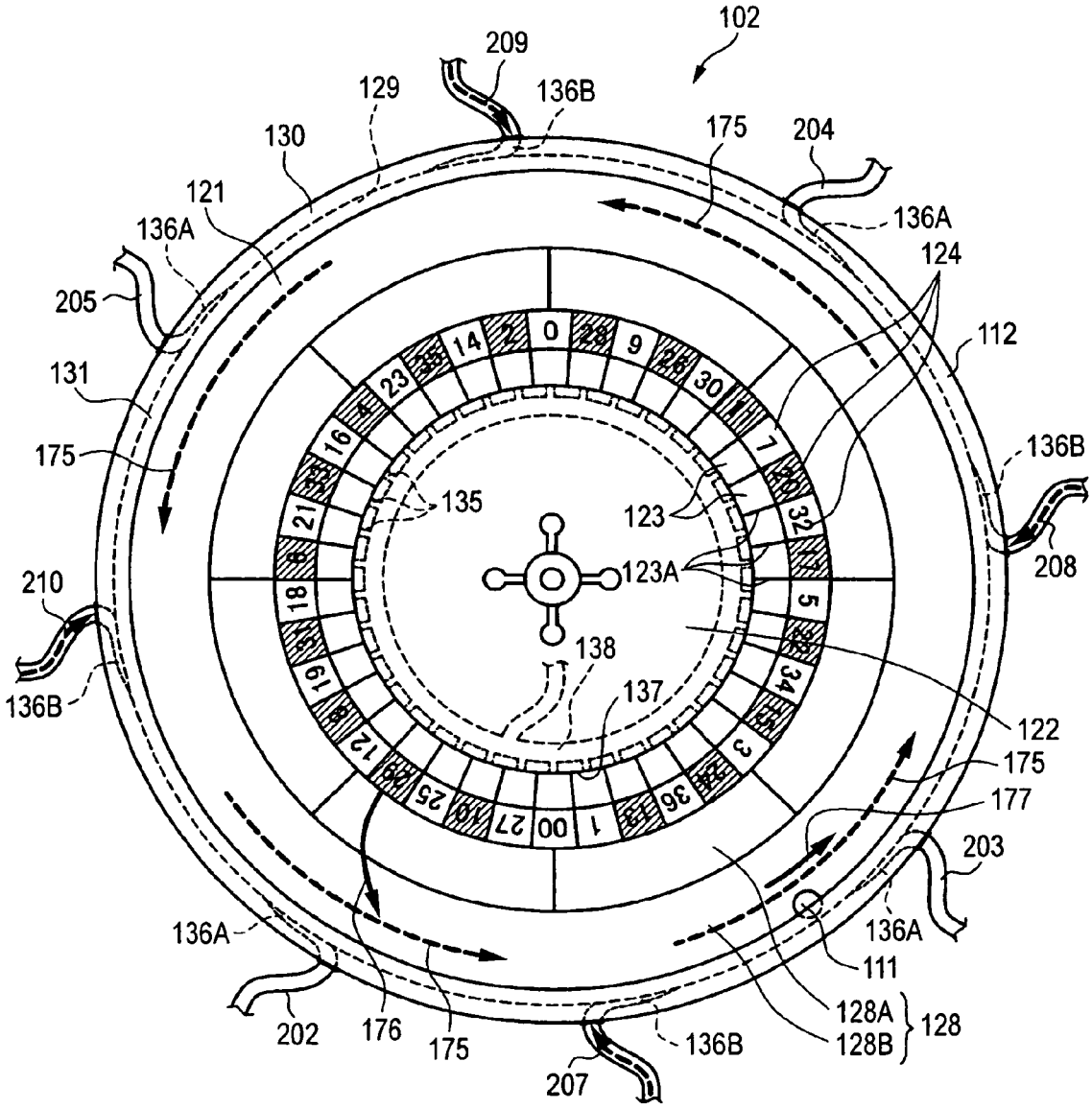
FIG. 32 is a schematic view showing a rolling state of the ball of the roulette apparatus in Step 31.

On the other hand, when the value of N is not "odd" (S26: NO), that is, when the current game is one of the second, fourth, six, eighth, tenth, . . . , the main control CPU 180 proceeds the process to S31 and opens the third on-off valve 120. Here, the third on-off valve 120 is provided in the air tube 117 for conveying the air compressed by the compressor 114 to the third discharge nozzles 136B as described previously, so that the third on-off valve 120 adjusts the air pressure of the air passing through the air tube 117. When the third on-off valve 120 is opened, the compressed air begins to be discharged from the third discharge nozzles 136B formed in the periphery of the banked passageway 129 through the air tubes 207-210. Thus, a layer of the air flowing counterclockwise along the banked passageway 129 is generated so that the ball 111 rolled onto the banked passageway 129 in S22 begins to roll in a circular orbit in accordance with the discharged air pressure. FIG. 32 is a schematic view showing the rolling state of the ball of the roulette apparatus in Step 31.

As shown in FIG. 32, when the third on-off valve 120 is opened in S31, a flow of the air flowing counterclockwise (in the arrow 175 direction) along the banked passageway 129 is formed on the roulette wheel 112 due to the air discharged from the third discharge nozzles 136B provided in the banked passageway 129. The rolling direction of the ball 111 rolled toward the banked passageway 129 due to the air pressure from the first discharge nozzles 135 is changed to the circumferential direction of the roulette wheel 112 due to the air pressure from the third discharge nozzles 136B (see the arrow 176). Further, the ball 111 applied with the air pressure from the third discharge nozzles 136B is rolled toward the outer circumferential edge of the roulette wheel 112 gradually due to the centrifugal force. Thus, the ball 111 begins to roll along the banked passageway 129 (see the arrow 177). Here, the banked passageway 129 guides the ball 111 against the centrifugal force of the ball 111 rolling on the roulette wheel 112 so as to roll the ball 111 in a circular orbit. Further, due to the wall portion 131 formed contiguously to the banked passageway 129 in the upper end corresponding to the outer circumferential portion of the banked passageway 129, the ball 111 having a rotary motion on the banked passageway 129 is prevented from jumping out of the roulette wheel 112.

Next, the timer 184 begins to measure time in S32, and the main control CPU 180 determines whether a predetermined time (15 seconds in the second embodiment) has passed or not since the third on-off valve 120 was opened (S33). When a measured value t3 since the third on-off valve 120 was opened is smaller than 15 seconds (S33: NO), the third on-off valve 120 is opened continuously.

On the other hand, when the measured time t3 since the third on-off valve 120 was opened is not smaller than 15 seconds (S33: YES), the main control CPU 180 proceeds the process to S34.

In S34, the main control CPU 180 closes the third on-off valve 120 so as to suspend the discharge of the air from the third discharge nozzles 136B. Further, the main control CPU 180 turns off the power of the compressor 114 in S35 so as to suspend the air compression of the compressor 114. Then, the main control CPU 180 terminates the air discharge process and returns to S8.

When the discharge of the air from the third discharge nozzles 136B is suspended, the ball 111 rolling along the banked passageway 129 receives no air pressure from the third discharge nozzles 136B. Thus, the rotational velocity of the ball 111 drops gradually so that the centrifugal force is lowered. Finally the ball 111 rolls down on the slope 128 and toward the inner side of the roulette wheel 112, and reaches the rotary disc 122 which is rotating. The details of this state are similar to those in the aforementioned case where the second on-off valve 119 is closed in S30, and description thereof will be omitted here.

In the roulette gaming machine 101 according to the second embodiment, as described above, the first discharge nozzles 135 for discharging the air compressed by the compressor 114 are provided in the ball reception grooves 123 of the roulette wheel 112 in the roulette apparatus 102, so that the ball 111 received in one of the ball reception grooves 123 is rolled toward the banked passageway 129 due to the air pressure of the air discharged from the first discharge nozzles 135 (S22). In addition, discharge nozzles for discharging the air compressed by the compressor 114 likewise in the circumferential direction of the banked passageway 129 are changed over between the second discharge nozzles 136A and the third discharge nozzles 136B for every game. Thus, the ball 111 rolled onto the banked passageway 129 is rolled circumferentially along the banked passageway 129 due to the air pressure of the air discharged from the second discharge nozzles 136A or the third discharge nozzles 136B (S27 or S31). Thus, rolling the ball 111 on the roulette wheel 112 and receiving the ball 111 in one of the ball reception grooves 123 is performed repeatedly without recovering the ball 111 from the roulette wheel 112. Accordingly, it is not necessary to provide a complicated mechanism such as a movable portion for recovering the ball or a launcher for launching the ball. Accordingly, the maintenance work is made easy and the equipment cost can be reduced. In addition, necessary depth of each ball reception groove 123 and necessary height of the roulette wheel 112 can be reduced. Accordingly, the visual field angle with which each player confirms the position of the ball 111 is widened even when the ball 111 is received in any one of the ball reception grooves 123. Thus, the work to confirm the ball becomes so easy that the enjoyability of gaming is enhanced.

In addition, the place where the ball 111 begins to roll differs from game to game in accordance with the place where the ball 111 is received in the last game. Further, the rotation direction in which the ball 111 rotates along the banked passageway 129 when the ball 111 rolls on the roulette wheel 112 is changed over in every game. Accordingly, the rolling state of the ball 111 is changed variously in every game. Thus, when players play games continuously, the games can be prevented from being unvaried, so that the players can be prevented from being bored.

The present invention is not limited to the aforementioned second embodiment. Not to say, various improvements and modifications can be made on the invention without departing from the spirit and scope thereof.

For example, in the embodiment, as shown in FIG. 26, each of the on-off valves 118-120 for adjusting the discharge of the air from the first discharge nozzles 135, the second discharge nozzles 136A and the third discharge nozzles 136B respectively is brought into either the state where it is opened fully or the state where it is closed perfectly. However, a flow control valve may be provided separately for each on-off valve 118-120 so that the air pressure (flow rate) can be further changed when each on-off valve 118-120 is opened.

Figure 33:
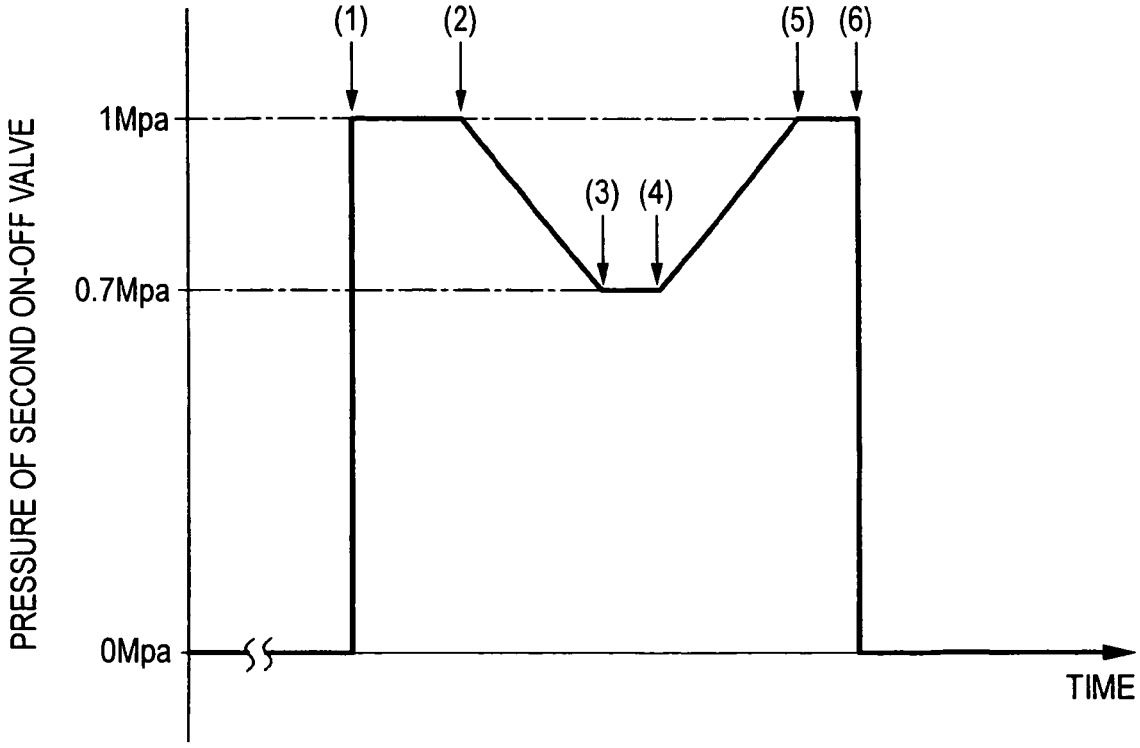
FIG. 33 is an explanatory diagram showing a modification of the second embodiment in which the air pressure is changed by a flow control valve when the second on-off valve is open.

With reference to FIG. 33, description will be made below about a modification in which the air pressure is changed by a flow control valve when particularly the second on-off valve 119 of the on-off valves is opened.

Here, in this modification, the second on-off valve 119 is connected to the main control CPU 180, and the main control CPU 180 controls the on/off time and the flow rate in accordance with a program stored in the ROM 181 in advance.

At timing (1) in FIG. 33, the second on-off valve 119 is opened fully so as to deliver the air compressed to 1 MPa to the second discharge nozzles 136A through the air tubes 202-205. Thus, the ball 111 begins to roll circumferentially along the banked passageway 129 (see FIG. 30).

At timing (2), the flow rate of the second on-off valve 119 is adjusted by the flow control valve so as to lower the air pressure gradually. As a result, the air pressure of the air discharged from the second discharge nozzles 136A is also lowered so that the velocity of the ball 111 rolling along the banked passageway 129 is slowed down gradually.

At timing (3), the flow rate of the second on-off valve 119 is adjusted by the flow control valve so as to lower the air pressure to 0.7 MPa (70% of the air pressure at the time of full open). As a result, the air pressure of the air discharged from the second discharge nozzles 136A is also lowered to 70% so that the velocity of the ball 111 rolling along the banked passageway 129 is slowed down though the ball 11 does not roll down on the slope 128.

At timing (4), the flow rate of the second on-off valve 119 is adjusted by the flow control valve so as to increase the air pressure gradually. As a result, the air pressure of the air discharged from the second discharge nozzles 136A is also increased so that the once-slowed-down velocity of the ball 111 rolling along the banked passageway 29 is increased gradually.

At timing (5), the second on-off valve 119 is opened fully again so as to deliver the air compressed to 1 MPa to the second discharge nozzles 36A through the air tubes 202-205. Thus, the ball 11 rotates the fastest circumferentially along the banked passageway 129.

At timing (6), the second on-off valve 119 is closed to suspend the discharge of the air from the second discharge nozzles 136A. As a result, no air pressure from the second discharge nozzles 136A is applied to the ball 111 rolling along the banked passageway 129. Thus, the rotational velocity of the ball 111 drops down gradually so that the centrifugal force is lowered. Finally the ball 111 rolls down on the slope 128 and toward the inner side of the roulette wheel 112, and reaches the rotary disc 122 rotating (see FIG. 31).

As described above, in this modification in which the air pressure is changed by the flow control valve when the second on-off valve 119 is open, the rotational velocity of the ball 111 may be adjusted in analogue. Accordingly, a wide variety of motions of the ball 111 which cannot be obtained in the related art can be obtained so that the players can be prevented from being bored.

In the second embodiment, the ball 111 rolling toward the banked passageway 129 due to the air pressure from the first discharge nozzles 135 is rolled in a circular orbit along the banked passageway 129 due to the air pressure from the second discharge nozzles 136A. However, the frame 121 may be rotated without providing the second discharge nozzles 136A. When the frame 121 is rotated, the ball 111 on the frame 121 begins to rotate circumferentially in accordance with the rotation of the frame 121. Thus, the ball 111 rolls along the banked passageway 129 due to the centrifugal force caused by the rotation. When the rotation direction of the frame 121 is changed over for every game, the rolling state of the ball can be changed variously.

In the second embodiment, discharge nozzles to discharge the air are changed over between the second discharge nozzles 136A and the third discharge nozzles 136B for every game, so as to change the rolling direction of the ball 111. However, the discharge nozzles may be, for example, changed over for every third games or every fifth games.

Further, the discharge nozzles may be changed over based on a result of determination by lot using a random number as soon as the bet time is terminated. In such a manner, the rolling direction of the ball 111 is changed at random timing having no regularity. Thus, the players can be prevented from being bored.

In the second embodiment, the air is charged concurrently from all the ball reception grooves 123 through the launching air pipe 138. However, which ball reception groove 123 receives the ball 111 may be determined by the light emitter 132 and the light receiver 133, so that the air is discharged from only the first discharge nozzle 135 provided in the reception groove in question.

As described above, a roulette apparatus (for example, a roulette apparatus 102) according to the second embodiment includes: a roulette wheel (for example, a roulette wheel 112) in which a plurality of symbols are disposed; a ball (for example, a ball 111) to roll on the roulette wheel; a plurality of ball reception members (for example, ball reception grooves 123) which are formed in a circumferential direction of the roulette wheel correspondingly to the plurality of symbols, and in one of which the ball will be received; a banked passageway (for example, a banked passageway 129) which is provided to be endless circumferentially on an outer circumferential edge side of the roulette wheel with respect to the ball reception members, and on which the ball rolls in a circular orbit; a compressor (for example, a compressor 114) for compressing the air; launching discharge nozzles (for example, first discharge nozzles 135) provided in the ball reception members and for discharging the air compressed by the compressor toward the banked passageway; rotating discharge nozzles (for example, second discharge nozzles 136A and third discharge nozzles 136B) provided in the banked passageway and for discharging the air compressed by the compressor in circumferential directions of the banked passageway, the rotating discharge nozzles including first rotating discharge nozzles (for example, the second discharge nozzles 136A) for discharging the air in one circumferential direction of the banked passageway and second rotating discharge nozzles (for example, third discharge nozzles 136B) for discharging the air in the other circumferential direction of the banked passageway; and discharge switching unit (for example, a CPU 180, S27 and S31) for changing over the rotating discharge nozzles between the first rotating discharge nozzles and the second rotating discharge nozzles.

In the roulette apparatus according to the configuration described above, the launching discharge nozzles for discharging the air compressed by the compressor toward the banked passageway are provided in the ball reception members for receiving the ball rolling on the roulette wheel where a plurality of symbols are disposed, while the rotating discharge nozzles for discharging the air compressed by the compressor in circumferential directions of the banked passageway are provided, and the rotating discharge nozzles are changed over between the first rotating discharge nozzles and the second rotating discharge nozzles. Accordingly, the ball is rolled along the banked passageway repeatedly without being recovered from the roulette wheel. Thus, any complicated mechanism such as a movable portion for recovering the ball or a launcher for launching the ball is not required. As a result, the maintenance work becomes easy, and the equipment cost can be reduced. In addition, the required depth of each ball reception member and the required height of the roulette wheel can be reduced. Accordingly, ball confirmation by each player becomes easy. Thus, the enjoyability of gaming is enhanced.

In addition, the place where the ball begins to roll differs from game to game in accordance with the place where the ball is received in the last game. Further, the rotation direction in which the ball rotates along the banked passageway when the ball rolls on the roulette wheel is changed over. Accordingly, the rolling state of the ball can be changed variously. Thus, even when players play games for a long time, the games can be prevented from being unvaried, so that the players can be prevented from being bored.

In the roulette apparatus (for example, the roulette apparatus 102) according to the configuration described above, there is provided a game providing unit (for example, the main control CPU 180) that provides to a user a roulette game in which one game is performed by allowing the ball (for example, the ball 111) to be received in one of the reception portions (for example, the ball reception grooves 123) after rolling the ball on the roulette wheel (for example, the roulette wheel 112) for a predetermined time period, and the game is repeatedly performed, and the discharge switching unit (for example, the CPU 180, S27 and S31) changes over the rotating discharge nozzles (for example, between the second discharge nozzles 136A and the third discharge nozzles 136B) in accordance with the number of the games performed by the roulette apparatus.

In the roulette apparatus according to the configuration above, the rotating discharge nozzles are changed over in accordance with the number of the games performed by the roulette apparatus. Accordingly, the rotation direction in which the ball rotates along the banked passageway when the ball rolls on the roulette wheel is changed over in every game. Accordingly, the rolling state of the ball can be changed variously in every game. Thus, even when players play games for a long time, the games can be prevented from being unvaried, so that the players can be prevented from being bored.

In the roulette apparatus (for example, the roulette apparatus 102) according to the first or second configuration, an operation to roll the ball (for example, the ball 111) on the roulette wheel (for example, the roulette wheel 112) and allow the rolling ball to be received in one of the ball reception members (for example, the ball reception grooves 123) after a predetermined time is regarded as a game, and such games are repeated continuously; and the roulette apparatus further includes: air pressure controlling units (for example, a second on-off valve 119 and a third on-off valve 120) for adjusting air pressure of the air discharged from the first rotating discharge nozzles (for example, the second discharge nozzles 136A) and the second rotating discharge nozzles (for example, the third discharge nozzles 136B) respectively; and a control unit (for example, the CPU 180) for controlling the air pressure controlling units during the games.

In the roulette apparatus according to the configuration described above, the air pressure controlling units for adjusting the air pressure of the air discharged from the first rotating discharge nozzles and the second rotating discharge nozzles respectively is provided, and the air pressure controlling units are controlled during games. Thus, the rotational velocity of the ball may be adjusted in analogue. Accordingly, a wide variety of motions of the ball that could not be obtained in the related art can be obtained so that the players can be prevented from being bored.

Third Embodiment

A roulette gaming machine 501 having a roulette apparatus according to the invention will be described below in detail and with reference to the drawings based on an embodiment bringing the invention into shape.

The roulette gaming machine 501 is a game machine configured as follows. That is, a player guesses a number or the like which will be decided by a roulette apparatus 502, and bets the player's own game media such as medals on the guessed number or the like. When the bet number or the like is hit, the player receives payout of a predetermined number of medals.

Figure 34:
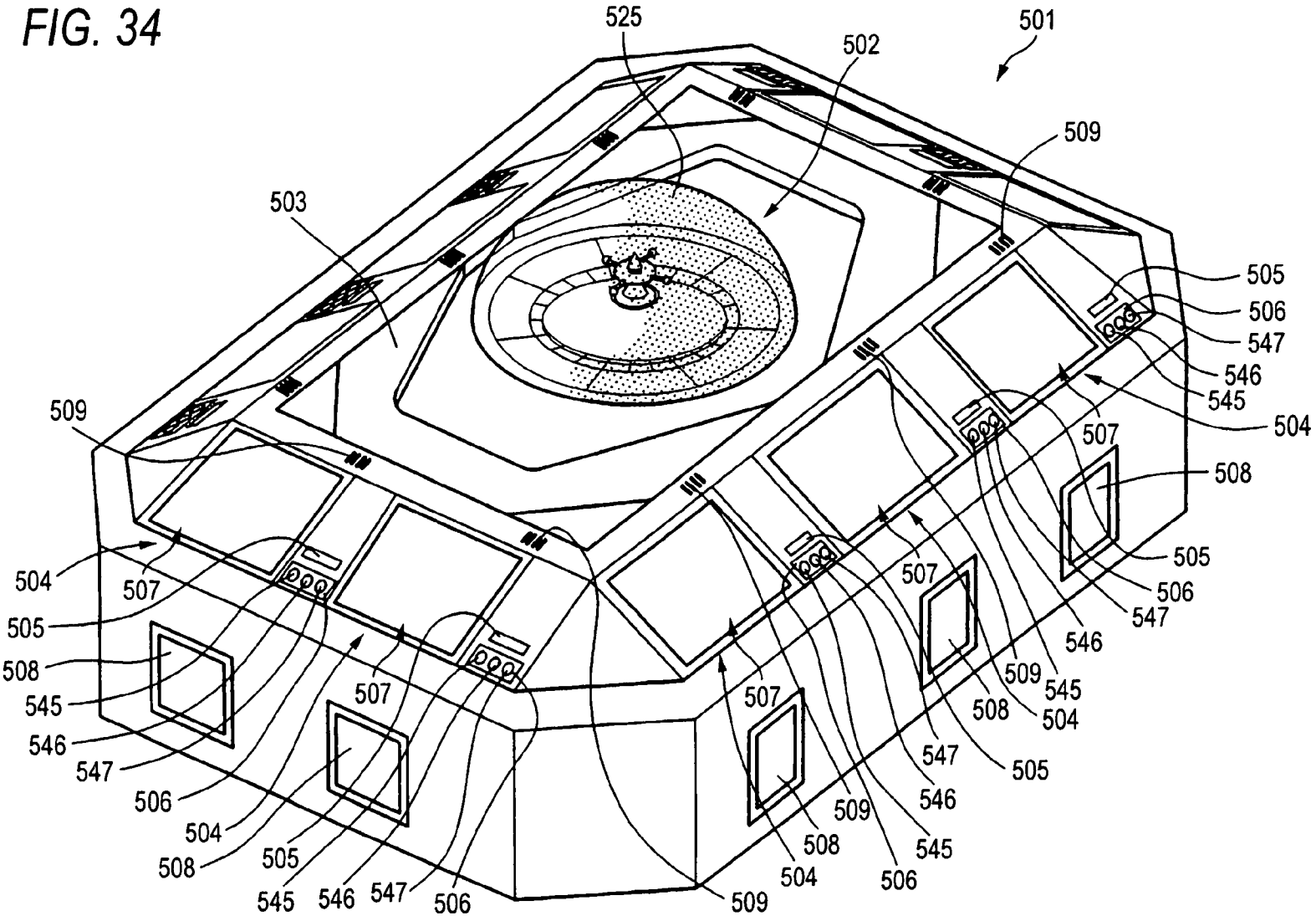
FIG. 34 is an outside perspective view showing the schematic configuration of a roulette gaming machine according to a third embodiment.

First, description will be made about the schematic configuration of the roulette gaming machine 501 according to this embodiment with reference to FIG. 34. FIG. 34 is an outside perspective view showing the schematic configuration of the roulette gaming machine according to the third embodiment.

As shown in FIG. 34, the roulette gaming machine 501 is provided with a cabinet 503 serving as a body portion, a roulette apparatus 502 provided in an approximately central portion of the top of the cabinet 503, and a plurality (ten in the third embodiment) of satellites 504 placed around the roulette apparatus 502 so as to surround the roulette apparatus 502.

Here, each satellite 504 is a game region including at least a medal insertion slot 505, a control portion 506 and an image display device 507. Game media such as coins or medals to be used in games are inserted into the medal insertion slot 505. The control portion 506 is provided with a plurality of control buttons through which a player inputs predetermined instructions. Images concerned with games are displayed on the image display device 507. The player operates the control portion 506 or the like while viewing the images displayed on the image display device 507. Thus, the player makes progress with the games to be developed.

Medal payout openings 508 are provided in the side surfaces of the cabinet 503 where the satellites 504 are placed, respectively. Further, a speaker 509 for playing music, sound effects, etc. is provided on the upper right of the image display device 507 of each satellite 504.

A medal sensor (not shown) is provided inside each medal insertion slot 505 so as to identify game media such as medals inserted through the medal insertion slot 505 and count the inserted medals. On the other hand, a hopper (not shown) is provided inside each medal payout opening 508 so as to pay out a predetermined number of medals from the medal payout opening 508.

Further, LED lamps for illuminating the roulette wheel 512 of the roulette apparatus 502 with a plurality of colors (three colors of red, yellow and blue in the third embodiment) in a below-mentioned manner are provided inside the roulette apparatus 502 (see FIGS. 36 and 37). The LED lamps change the colors of emitted light in accordance with the state of progress of a game in the roulette gaming machine 501 as will be described later. Thus, various stage effects can be obtained. In addition, due to the change in the colors of emitted light, persons even in the distance can be informed of the current state of progress of a game in the roulette gaming machine in a way easy to understand. The LED lamps will be described in details later.

Figure 35:
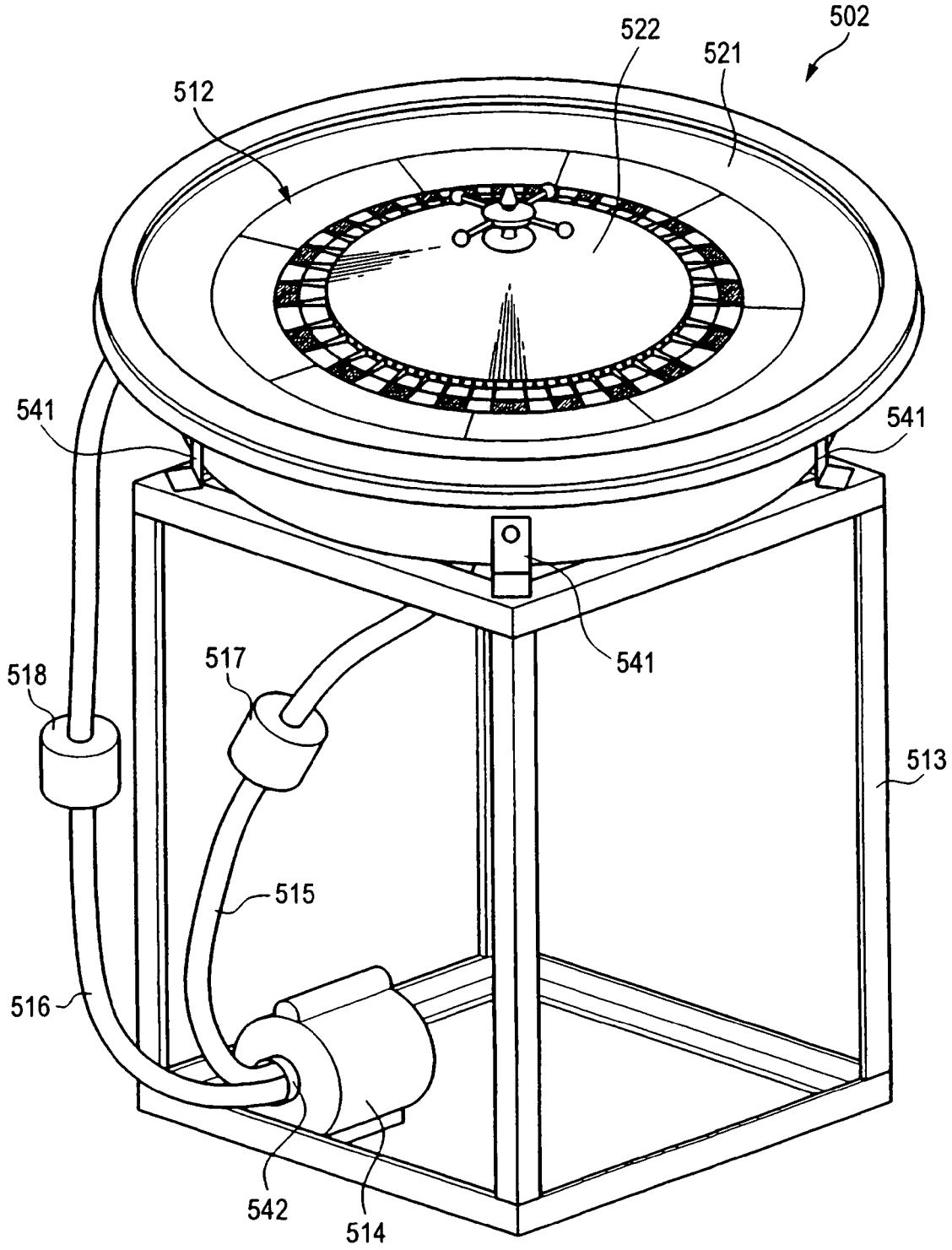
FIG. 35 is a perspective view showing a roulette apparatus according to the third embodiment.
Figure 38:
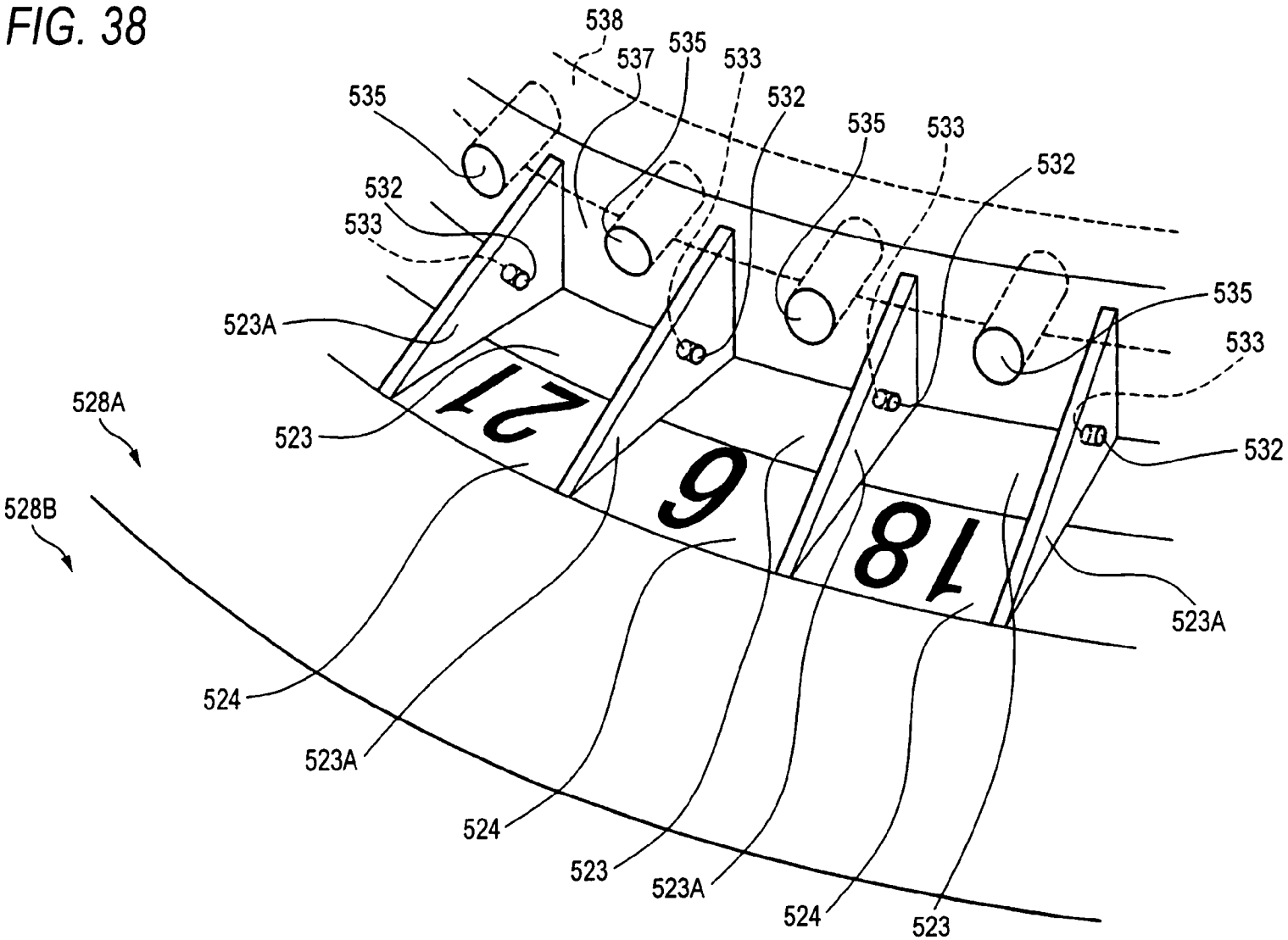
FIG. 38 is an enlarged perspective view showing the vicinity of a ball reception groove of the roulette apparatus according to the third embodiment.
Figure 39:
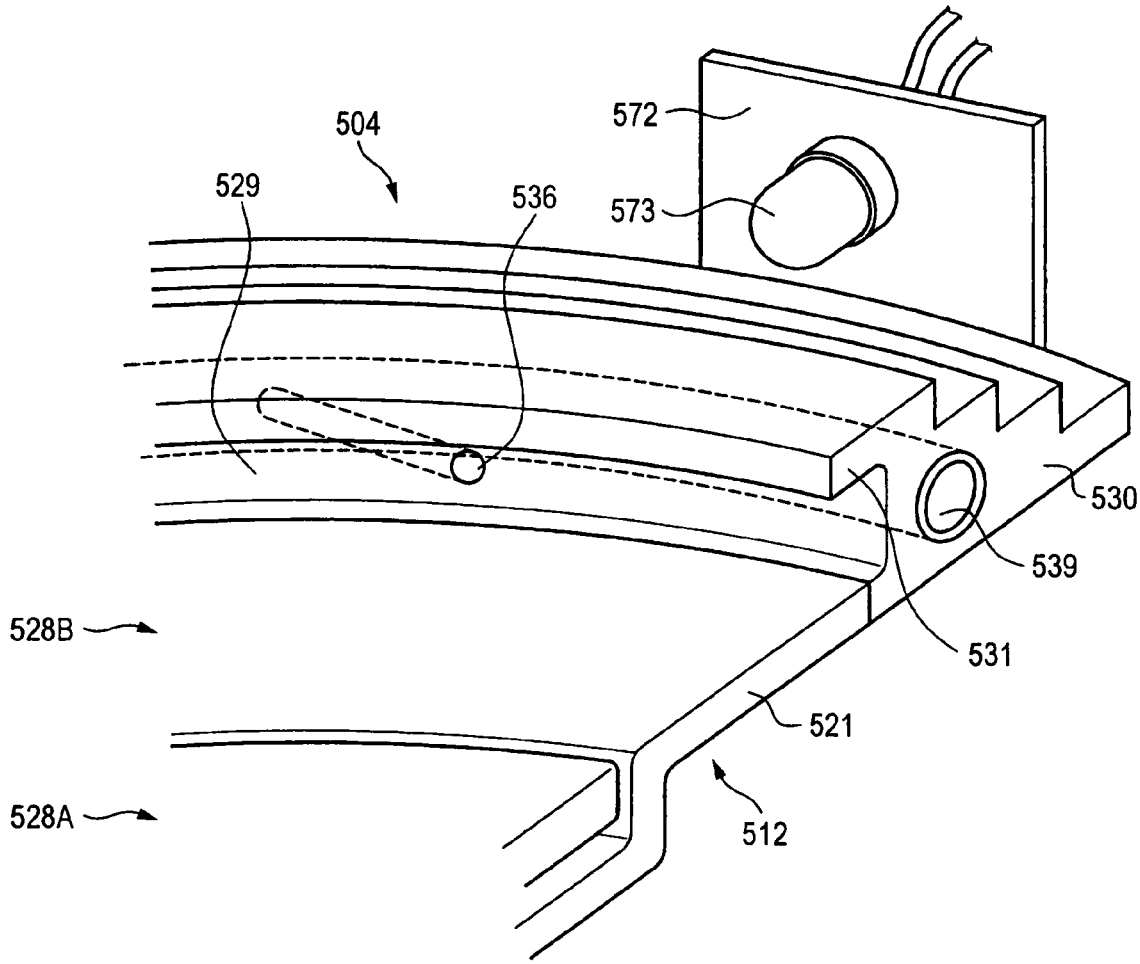
FIG. 39 is an enlarged perspective view showing the vicinity of a banked passageway of the roulette apparatus according to the third embodiment.

Next, the configuration of the roulette apparatus 502 according to the third embodiment will be described with reference to FIGS. 35 to 39. FIG. 35 is a perspective view showing the roulette apparatus according to the third embodiment. FIG. 36 is a plan view showing the roulette apparatus according to the third embodiment. FIG. 37 is a sectional view of the roulette apparatus taken on line XXXVII-XXXVI in FIG. 36. FIG. 38 is an enlarged perspective view showing the vicinity of a ball reception groove of the roulette apparatus according to the third embodiment. FIG. 39 is an enlarged perspective view showing the vicinity of a banked passageway of the roulette apparatus according to the third embodiment.

As shown in FIG. 35, the roulette apparatus 502 is provided with a roulette wheel 512, a support table 513, a compressor 514, air tubes 515 and 516, a first on-off valve 517 and a second on-off valve 518. The roulette wheel 512 has a rolling region where a ball 511 rolls during a game. The support table 513 supports the roulette wheel 512 inside the roulette gaming machine 501. The compressor 514 takes in the ambient air and compresses the air into predetermined pressure. The air compressed by the compressor 514 is sent through the air tubes 515 and 516. The first and second on-off valves 517 and 518 are provided in halfway points of the air tubes 515 and 516 for adjusting the pressure of the air flowing in the air tubes 515 and 516 respectively.

The compressor 514 is disposed in an internal space formed by the support table 513. The compressor 514 is a device for taking in the ambient air and compressing the air into predetermined pressure (1 MPa in the third embodiment). The compressor 514 according to the third embodiment has two discharge nozzles 542 for discharging the compressed air. The air tubes 515 and 516 are connected to the discharge nozzles 542 respectively.

The compressor 514 is disposed in an internal space formed by the support table 513. The compressor 514 is a device for taking in the ambient air and compressing the air into predetermined pressure (1 MPa in the third embodiment). The compressor 514 according to the third embodiment has two discharge nozzles 542 for discharging the compressed air. The air tubes 515 and 516 are connected to the discharge nozzles 542 respectively.

The air tubes 515 and 516 are tubes through which the air compressed by the compressor 514 is conveyed to below-mentioned first and second discharge nozzles 535 and 536 formed in the roulette wheel 512 respectively. The first on-off valve 517 and the second on-off valve 518 are provided in the halfway points of the air tubes 515 and 516 respectively.

Here, the first on-off valve 517 and the second on-off valve 518 are electromagnetic valves each having a structure by which the valve opening time is adjusted. The first on-off valve 517 and the second on-off valve 518 are connected to a main control CPU 580 (see FIG. 45). The main control CPU 580 controls the on/off times of the first and second on-off valves 517 and 518 in accordance with a program stored in a ROM 581 in advance as will be described later. Thus, the air pressures discharged from the first and second on-off valves 517 and 518 are adjusted to perform a series of operations to roll the ball 511 on the roulette wheel 512 and receive the ball 511 in one of the ball reception grooves 523 after a predetermined time has passed.

When the roulette apparatus 502 is installed in the roulette gaming machine 501, the roulette wheel 512 is wholly covered with a hemispheric glass cover member 525 from above (see FIG. 34). Thus, the ball 511 rolling on the roulette wheel 512 during a game can be held not to jump out from the roulette wheel 512. In addition, foreign matters are prevented from entering the roulette wheel 512 in order to prevent dishonesty etc. Further, when the roulette wheel 512 is illuminated by the LEDs provided in the roulette wheel 512, emitted light is scattered through the glass. Thus, the roulette apparatus 502 as a whole can be illuminated more beautifully so that the stage effects of the light can be enhanced.

Subsequently the roulette wheel 512 according to the third embodiment will be described. The roulette wheel 512 is provided with a frame 521 fixed to the support table 513, and a rotary disc 522 rotatably received and supported inside the frame 521. A large number (38 in the third embodiment) of concave ball reception grooves 523 are provided circumferentially on the top of the rotary disc 522.

The ball reception grooves 523 are reception portions to receive the rolling ball 511. The ball reception grooves 523 are partitioned from one another by partition walls 523A (see FIG. 38) each having an approximately triangular shape. Further, a number indication plate 524 where one of numbers "0", "00" and "1" to "36" is indicated as a graphic character corresponding to each ball reception groove 523 is provided on the top of the rotary disc 522 in the outside direction of the ball reception groove 523.

The ball reception grooves 523 are reception portions to receive the rolling ball 511. The ball reception grooves 523 are partitioned from one another by partition walls 523A (see FIG. 38) each having an approximately triangular shape. Further, a number indication plate 524 where one of numbers "0", "00" and "1" to "36" is indicated as a graphic character corresponding to each ball reception groove 523 is provided on the top of the rotary disc 522 in the outside direction of the ball reception groove 523.

Figure 36:
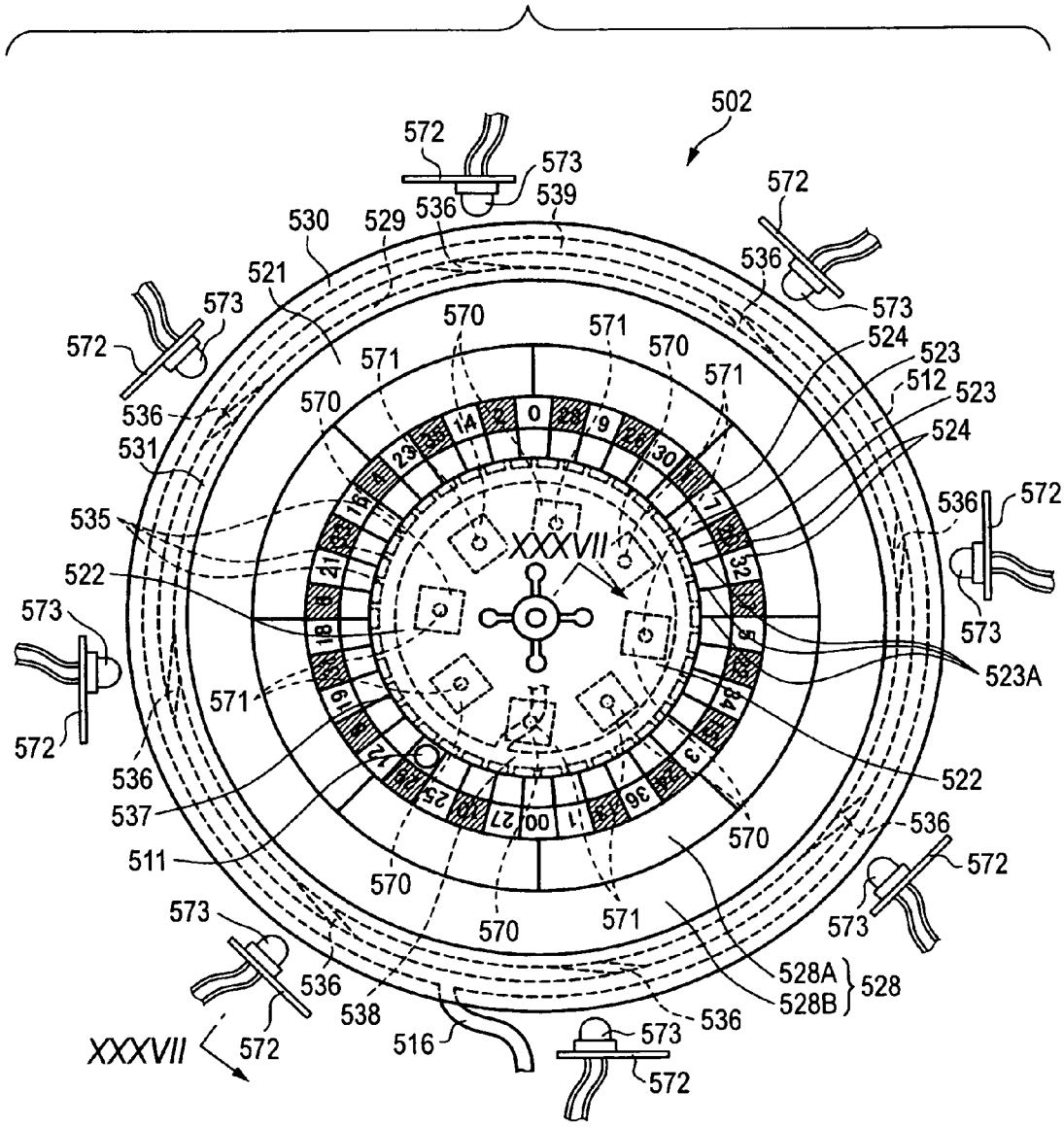
FIG. 36 is a plan view showing the roulette apparatus according to the third embodiment.
Figure 37:
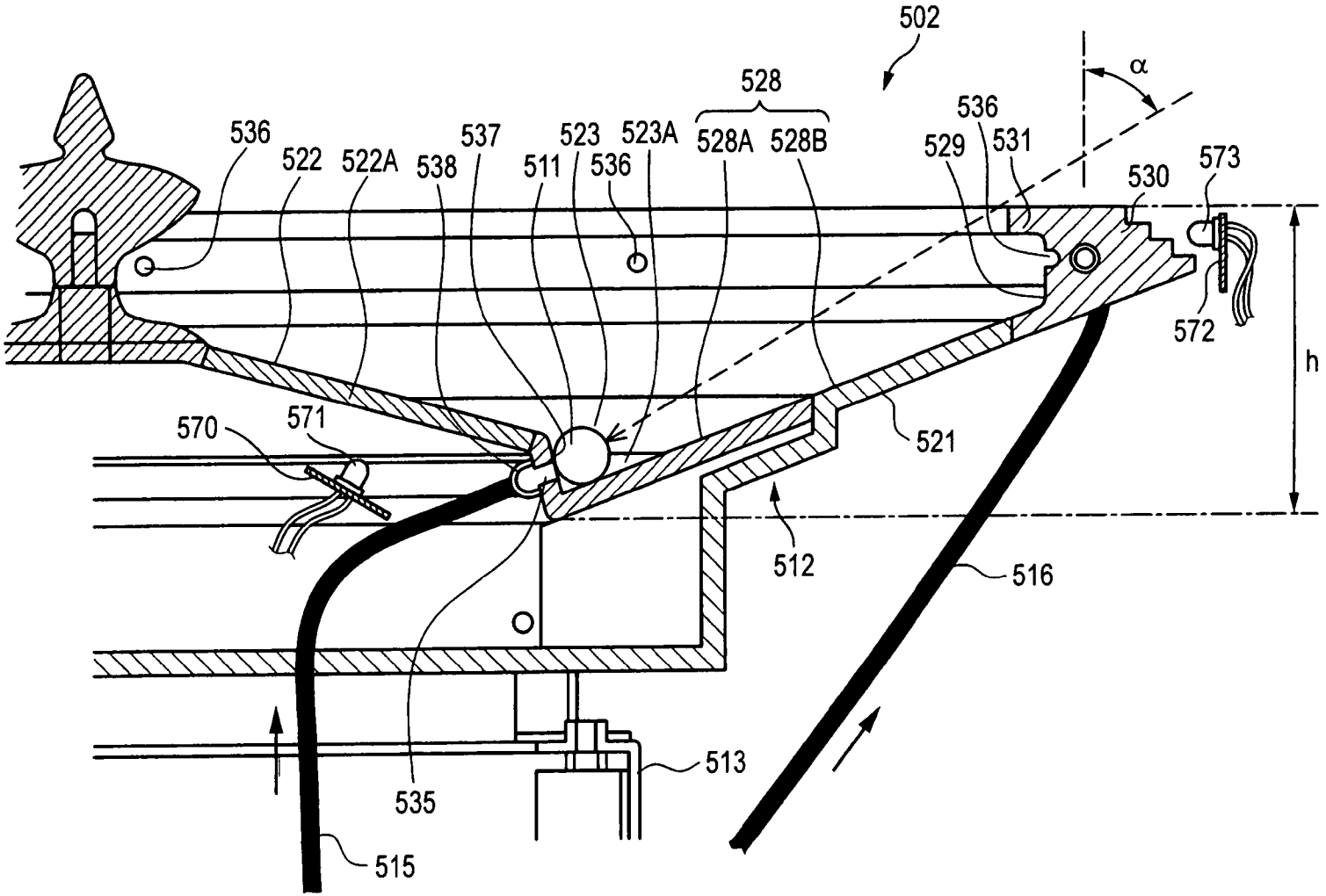
FIG. 37 is a sectional view of the roulette apparatus taken on line XXXVII-XXXVI in FIG. 36.

As shown in FIGS. 36 and 37, LED boards 570 are provided inside the rotary disc 522. A bottom LED 571 is disposed on each LED board 570. Each bottom LED 571 is a full-color LED which emits light in a plurality of colors, and which is connected to an external power supply through wiring.

A part of the rotary disc 522 located above each bottom LED 571 is formed out of a bottom transparent portion 522A. Here, each bottom transparent portion 522A is molded out of a transparent member (for example, transparent resin) which transmits light. Each LED board 570 is fixed to the roulette wheel 512 so that the bottom LED 571 is disposed to face the bottom transparent portion 522A at a predetermined distance.

The light emission color of each bottom LED 571 is changed over among three colors of "red", "yellow" and "blue" under the control of the main control CPU 580 which will be described later. The bottom LED 571 illuminates the roulette wheel 512 with the aforementioned light emission color ("red", "yellow" or "blue") from the bottom side thereof through the bottom transparent portion 522A made of the transparent member. In that event, the roulette wheel 512 is illuminated through the transparent member. Therefore, any bottom LED 571 is not exposed directly to the outside, but the appearance of the roulette apparatus 502 is improved. Further, the light is scattered due to the transparent member so that the roulette wheel 512 is illuminated more beautifully. Thus, the stage effects of the light emission are enhanced.

Figure 40:
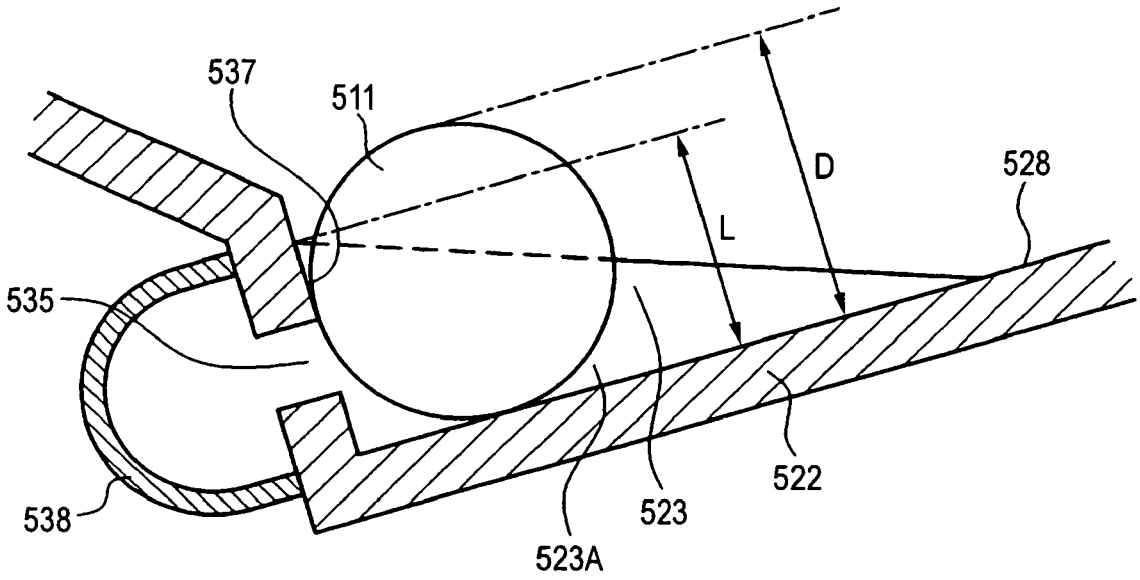
FIG. 40 is a sectional view of a roulette wheel, in which particularly the vicinity of a ball reception groove is enlarged.

Each ball reception groove 523 is formed so that depth L of the ball reception groove 523 with respect to the slope 528 is smaller than the diameter D of the ball 511. FIG. 40 is a schematic view showing a ball reception groove according to the third embodiment.

As described previously, the ball reception grooves 523 are a total of 38 reception portions partitioned circumferentially by the partition walls 523A and for receiving the ball 511. Since the depth L of each ball reception groove 523 is designed to be smaller than the diameter D of the ball 511, there is no fear that the ball 511 sinks in the ball reception groove 523 when the ball 511 is received in the ball reception groove 523, as shown in FIG. 40. Thus, the players easily confirms the position of the ball 511 received in the ball reception groove 523 during each game. Accordingly, the enjoyability of the game can be enhanced.

In the roulette apparatus 502 according to the third embodiment, as described previously, the compressed air discharged to the ball 511 allows the ball to roll repeatedly without recovering the ball from the roulette wheel 512. Thus, any complicated mechanism such as a movable portion for recovering the ball 511 or a launcher for launching the ball 511 is not required. In addition, the depth L of each ball reception groove 523 can be made smaller than the diameter D of the ball 511 (see FIG. 40). Thus, as shown in FIG. 38, height h of the roulette wheel 512 can be reduced. Accordingly, a visual field angle $\alpha$ of the roulette apparatus 502 for confirming the ball 511 can be widened so that ball confirmation by the players becomes easy. Thus, the enjoyability of gaming is enhanced.

Further, the ball reception grooves 523 and the banked passageway 529 are formed contiguously through one slope 528 rising from the ball reception grooves 523 toward the banked passageway 529 at a predetermined inclination angle. Accordingly, each player easily confirms the ball 511 received in one of the ball reception grooves 523.

As shown in FIGS. 36 and 37, LED boards 572 are provided in the outer periphery of the guide wall 530. A side LED 573 is disposed on each LED board 572. Each side LED 573 is a full-color LED which emits light in a plurality of colors in the same manner as each bottom LED 571. Each side LED 573 is connected to an external power supply through wiring.

A part of the guide wall 530 corresponding to a part of the rotary disc 522 is molded out of a transparent member (for example, transparent resin) which transmits light. Each LED board 574 is fixed to the inside of the cabinet 503 so that the side LED 573 is disposed to face the guide wall 530 at a predetermined distance.

Here, the light emission color of each side LED 573 is changed over among three colors of "red", "yellow" and "blue" under the control of the main control CPU 580 which will be described later. The side LED 573 illuminates the roulette wheel 512 with the aforementioned light emission color ("red", "yellow" or "blue") from the side surface thereof through the guide wall 530 made of the transparent member. In that event, the roulette wheel 512 is illuminated through the transparent member. Therefore, any side LED 573 is not exposed directly to the outside, but the appearance of the roulette apparatus 502 is improved. Further, the light is scattered due to the transparent member so that the roulette wheel 512 can be illuminated more beautifully. Thus, the stage effects of the light emission are enhanced.

Here, the bottom LEDs 571 and the side LEDs 573 changes their light emission color in accordance with the current state of progress of a game in the roulette gaming machine 501 and the roulette apparatus 502 as will be described later. Thus, the roulette wheel 512 is illuminated with a specific color (one of "red", "yellow" and "blue"). In addition, the bottom LEDs 571 and the side LEDs 573 are turned on and off repeatedly so as to blink the roulette wheel 512 in a specific color (see FIG. 49). Accordingly, it is possible to exhibit novel stage effects based on the illumination state of the roulette wheel 512, which effects have never been provided in the related art. Thus, players' feeling of expectation or players' feeling of tension with a result of a lottery in the roulette apparatus 502 can be enhanced. In addition, persons even in the distance can be informed of the state of progress of the current game. Accordingly, a new player who wants to take part in gaming can easily determines whether each satellite 504 of the roulette gaming machine 501 can accept betting currently or terminates acceptance of betting. Thus, the convenience of gaming can be improved. In addition, in the third embodiment, the LEDs are provided in the bottom and outer periphery of the roulette wheel. Accordingly, the roulette wheel is illuminated from a plurality of directions so that the roulette wheel as a whole is illuminated. Thus, the stage effects of the illumination can be more enhanced.

In the third embodiment, a full-color LED capable of emitting light in a plurality of colors is used as each of the bottom LEDs 571 and the side LEDs 573. However, a plurality of LEDs emitting light in different colors may be provided together. In this case, when LEDs to emit light are controlled, the roulette wheel 512 is illuminated in a plurality of colors.

On the other hand, the ball 511 accelerated by the air discharged from the first and second discharge nozzles 535 and 536 provided in the roulette wheel 512 increases gradually in velocity and rotates along the banked passageway 529. When the discharge of the air from the second discharge nozzles 536 is stopped, the rotational velocity of the ball 511 becomes so weak that the ball 511 loses the centrifugal force. Thus, the ball 511 rolls down on the slope 528 toward the inner side of the roulette wheel 512, and reaches the rotary disc 522 which is rotating.

The ball 511 rolling onto the rotary disc 522 passes over one of the number indication plates 524 of the rotating rotary disc 522 and is received in one of the ball reception grooves 523. Thus, the number indicated in the number indication plate 524 corresponding to the ball reception groove 523 where the ball 511 has been received becomes a winning number.

The partition walls 523A forming the ball reception grooves 523 are partially notched, and a light emitter 532 and a light receiver 533 are provided in each partition wall 523A (see FIG. 38). Light emitted from the light emitter 532 of one of the partition walls 523A forming one ball reception groove 523 reaches the light receiver 533 of the other partition wall 523A. When the ball 511 enters the ball reception groove 523, the light is blocked by the ball 511. Thus, the existence of the ball 511 can be detected. Therefore, when the ball 511 enters one ball reception groove 523, the existence of the ball 511 is detected by a light sensor provided with a light emitter 532 and a light receiver 533, and a detection signal is transmitted to the below-mentioned main control CPU 580 (see FIG. 45). Based on the result of the detection, the main control CPU 580 determinates a winning number.

Each ball reception groove 523 is formed so that depth L of the ball reception groove 523 with respect to the slope 528 is smaller than the diameter D of the ball 511. FIG. 40 is a schematic view showing a ball reception groove according to the third embodiment.

As described previously, the ball reception grooves 523 are a total of 38 reception portions partitioned circumferentially by the partition walls 523A and for receiving the ball 511. Since the depth L of each ball reception groove 523 is designed to be smaller than the diameter D of the ball 511, there is no fear that the ball 511 sinks in the ball reception groove 523 when the ball 511 is received in the ball reception groove 523, as shown in FIG. 40. Thus, the players easily confirms the position of the ball 511 received in the ball reception groove 523 during each game. Accordingly, the enjoyability of the game can be enhanced.

In the roulette apparatus 502 according to the third embodiment, as described previously, the compressed air discharged to the ball 511 allows the ball to roll repeatedly without recovering the ball from the roulette wheel 512. Thus, any complicated mechanism such as a movable portion for recovering the ball 511 or a launcher for launching the ball 511 is not required. In addition, the depth L of each ball reception groove 523 are made smaller than the diameter D of the ball 511 (see FIG. 40). Thus, as shown in FIG. 38, height h of the roulette wheel 512 can be reduced. Accordingly, a visual field angle $\alpha$ of the roulette apparatus 502 for confirming the ball 511 can be widened so that ball confirmation by the players becomes easy. Thus, the enjoyability of gaming is enhanced.

Further, the ball reception grooves 523 and the banked passageway 529 are formed contiguously through one slope 528 rising from the ball reception grooves 523 toward the banked passageway 529 at a predetermined inclination angle. Accordingly, each player easily confirms the ball 511 received in one of the ball reception grooves 523.

Next, the first discharge nozzles 535 and the second discharge nozzle 536 provided in the roulette wheel 512 will be described with reference to FIGS. 38 and 39. Here, the roulette apparatus 502 according to the third embodiment uses the air pressure of the compressed air as its power source for rolling the ball 511 on the roulette wheel 512. Specifically, the ambient air is taken in and compressed to a predetermined pressure (e.g. 1 MPa) by the compressor 514 (see FIG. 35) provided under the roulette apparatus 502. The compressed air is conveyed to the roulette wheel 512 through the air tubes 515 and 516. The air is discharged from the first, second and third discharge nozzles 535 and 536 so as to apply a force based on the air pressure to the ball 511 in the roulette wheel 512.

As shown in FIG. 38, the first discharge nozzles 535 are formed in an inner side wall 537 of the rotary disc 522 correspondingly to the ball reception grooves 523 respectively. The inner side wall 537 forms the ball reception grooves 523 in cooperation with the partition walls 523A. In this embodiment, 38 ball reception grooves 523 corresponding to the numbers "0", "00" and "1" to "36" are formed. Therefore, the first discharge nozzles 535 are formed at 38 places. Each first discharge nozzle 535 is formed from the center of the roulette wheel 512 toward the periphery thereof. The air discharged from each first discharge nozzle 535 is discharged toward the banked passageway 529 provided in the outer circumferential edge portion of the roulette wheel 512.

On the other hand, an annular launching air pipe 538 is placed in the back side surface of the inner wall 537 side where the first discharge nozzles 535 are formed. The launching air pipe 538 is connected to the air tube 515, and the first discharge nozzles 535 are formed at a total of 38 places on the outer periphery of the launching air pipe 538. Accordingly, the air conveyed through the air tube 515 once flows into the launching air pipe 538. After that, the air is discharged into the reception grooves 523 all at once through the first discharge nozzles 535 provided at 38 places. Due to the air pressure of the discharged air, the ball 511 having been received in one of the reception grooves 523 begins to roll toward the banked passageway 529 against the inclination of the slope 528.

The second discharge nozzles 536 are formed at predetermined intervals (at intervals of 45 degrees in the third embodiment) in the guide wall 530 forming the banked passageway 529 as shown in FIGS. 36 and 39. The second discharge nozzles 536 are formed to look in the circumferential direction of the banked passageway, that is, in the tangential direction of the roulette wheel. The second discharge nozzles 536 discharge the air clockwise along the banked passageway 529.

When the air is discharged from the second discharge nozzles 536, a layer of the air flowing clockwise along the banked passageway 529 of the roulette wheel 512 is formed to roll the ball 511 clockwise along the banked passageway 529.

On the other hand, an annular rotating air pipe 539 is placed in the back side surface of the guide wall 530 where the second discharge nozzles 536 are formed. The rotating air pipe 539 is connected to the air tube 516. The air conveyed through the air tube 516 flows into the rotating air pipe 539. The air is discharged all at once through the second discharge nozzles 536 provided at 8 places. As a result, the ball 511 having been rolled toward the banked passageway 529 by the air discharged from the first discharge nozzles 535 begins to roll clockwise due to an annular layer of the air flowing along the banked passageway 529.

When the discharge of the air from the second discharge nozzles 536 is stopped, the layer of the air having flowed along the banked passageway 529 disappears. Thus, the rotational velocity of the ball 511 is weakened gradually so that the ball 511 loses the centrifugal force. After that, the ball 511 rolls down to the inner side of the roulette wheel 512 along the inclination of the slope 528, and reaches the rotary disc 522 which is rotating. Then, the ball 511 is received in one of the ball reception grooves 523 formed in the rotary disc 522. Thus, a winning number is decided by the roulette apparatus 502, and the roulette gaming machine 501 pays out medals based on the decided number and the bet information as to which number each player has bet on. Then, the game is terminated.

Further, when the air is discharged from the first discharge nozzles 535 after that, the ball 511 received in the ball reception groove 523 begins to roll again. Thus, the next game can be played continuously.

In such a manner, a force is applied to the ball 511 due to the air pressure of the air discharged from the first and second discharge nozzles 535 and 536 so that rolling the ball 511 and receiving the ball 511 in one of the ball reception grooves 523 is performed repeatedly without recovering the ball 511 from the roulette wheel 512. Accordingly, it is not necessary to provide any complicated mechanism such as a movable portion for recovering the ball 511 or a launcher for launching the ball 511, but the maintenance work can be made easy and the equipment cost can be reduced.

Next, description will be made about the configurations of the control portion 506 and the image display device 507 according to the third embodiment.

The control portion 506 is provided in a side portion of the image display device 507 as shown in FIG. 34. Buttons to be operated by a player are disposed in the control portion 506. Specifically, a BET decision button 545, a payout (CASH-OUT) button 546, a help (HELP) button 547 are disposed in order from the left side in view from a position opposed to the satellite 504.

The BET decision button 545 is a button to be pushed down for deciding a bet after the bet operation using the image display device 507 which will be described later. When a player decides a bet and places the bet on the number indicated in the number indication plate 524 corresponding to the ball reception groove 523 in which the ball 511 is received in the roulette apparatus 502 in a game, the player wins the game. When the player wins the game, credits corresponding to the number of bet chips are added to credits currently possessed by the player. The bet operation will be described in detail later.

The payout button 546 is typically a button to be pushed down when a game is terminated. When the payout button 546 is pushed down, medals corresponding to the credits acquired by games or the like and currently possessed by the player (typically one medal for one credit) are paid out from the medal payout opening 508.

The help button 547 is a button to be pushed down when the player does not know how to operate a game or the like. As soon as the help button 547 is pushed down, a help screen showing various kinds of operation information is displayed on the image display device 507.

Figure 41:
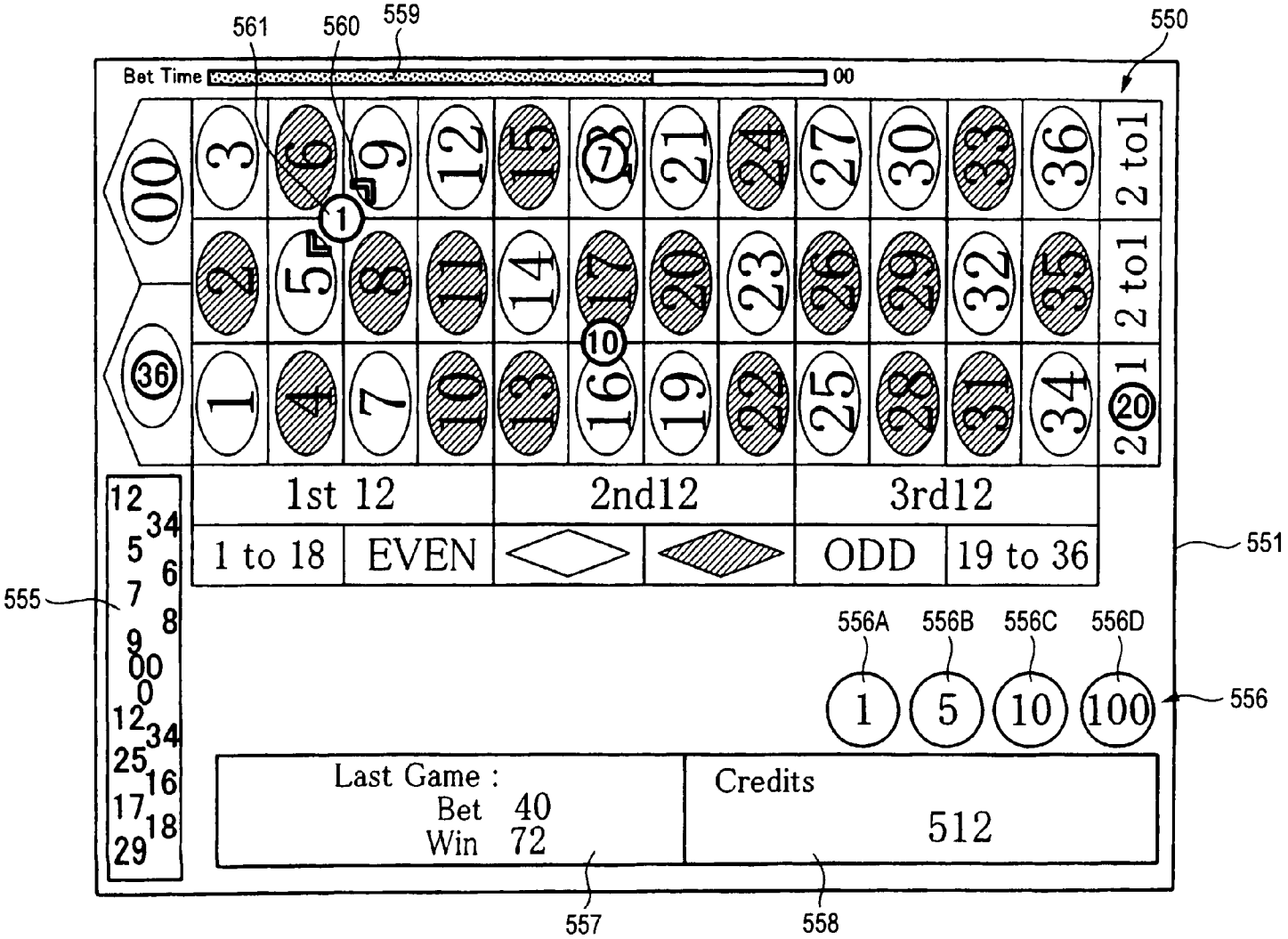
FIG. 41 is a view showing a BET screen to be displayed on an image display device.
Figure 42:
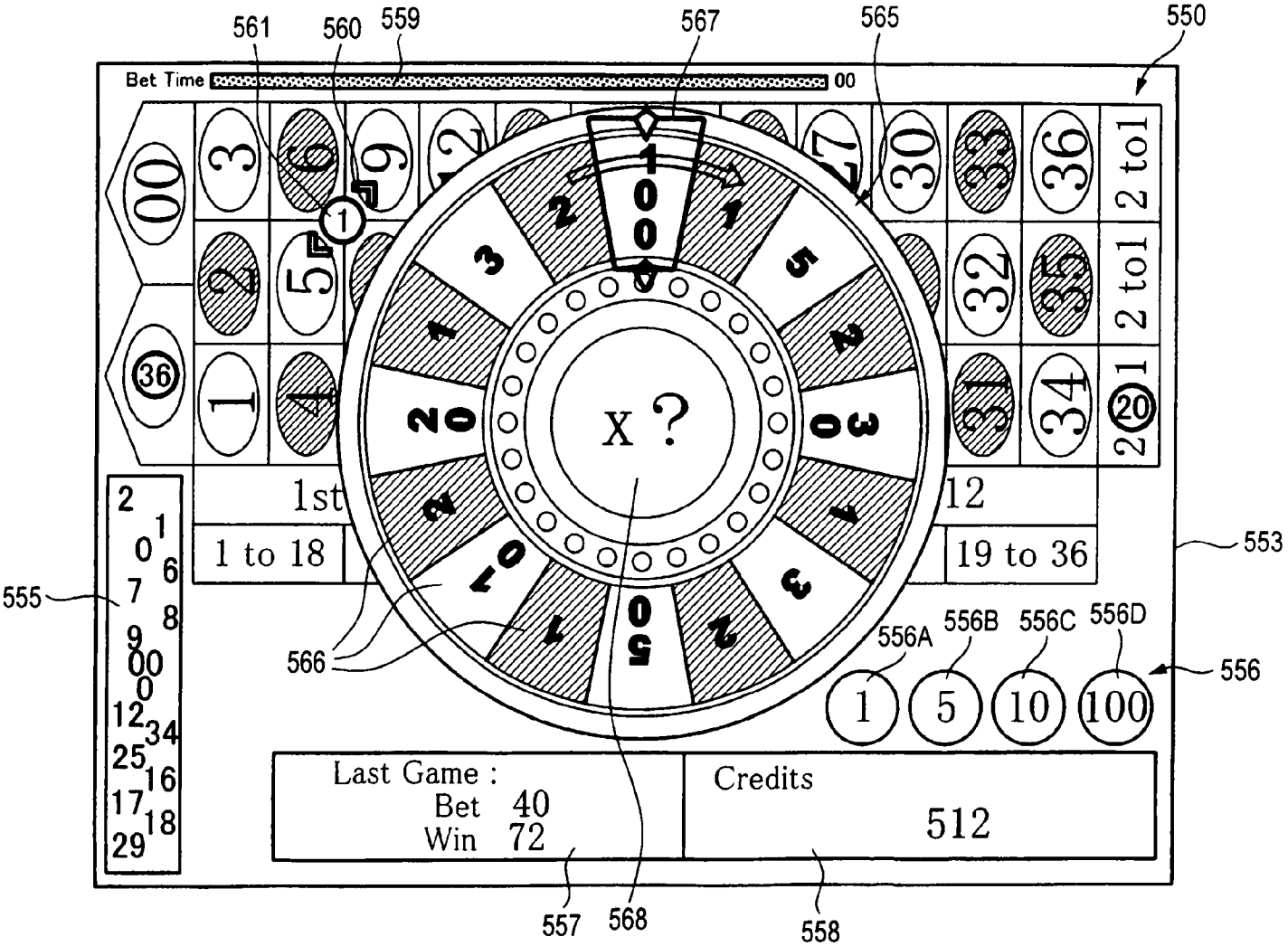
FIG. 42 is a view showing a bonus lottery screen to be displayed on the image display device.
Figure 43:
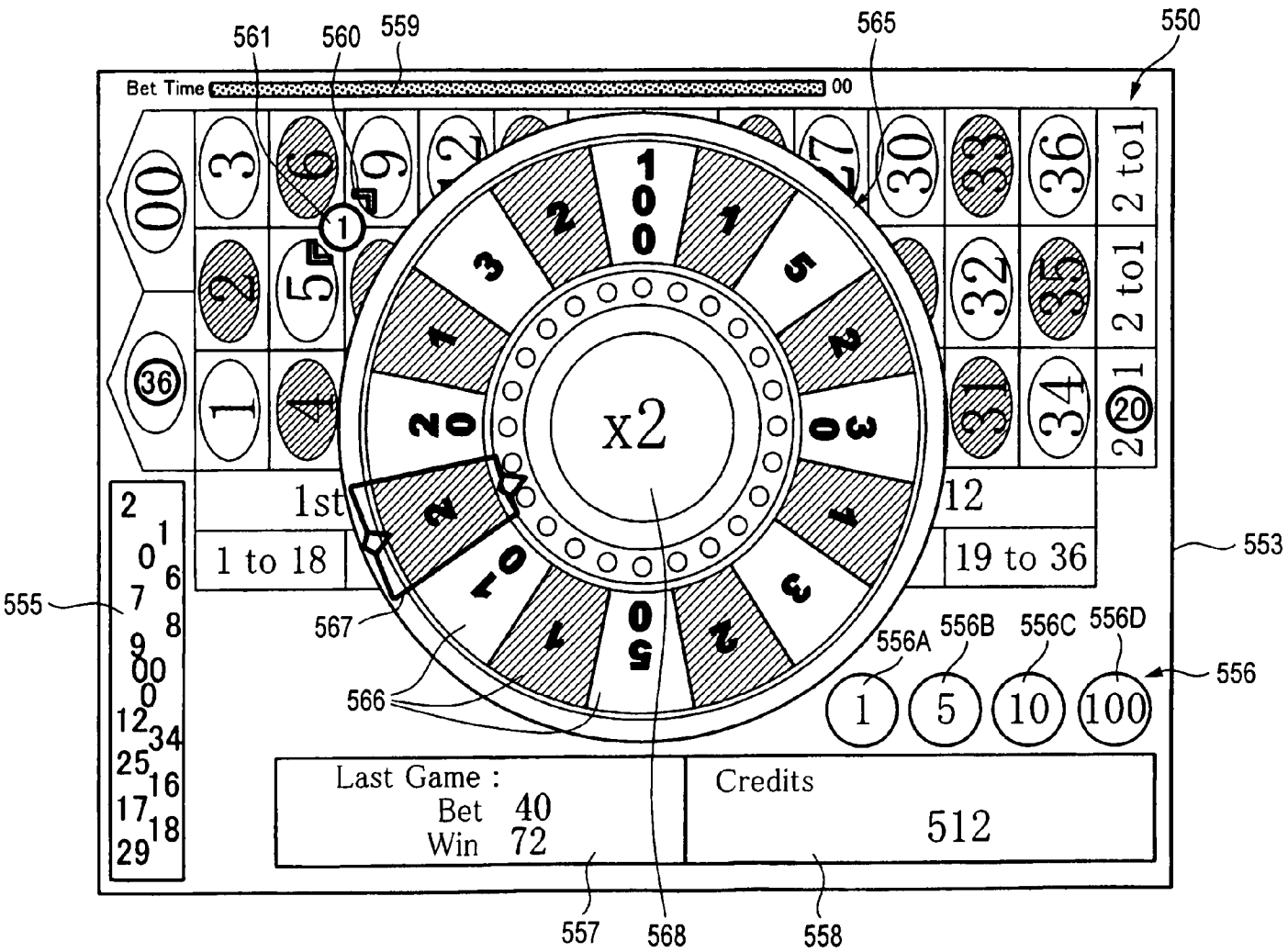
FIG. 43 is a view showing the bonus lottery screen to be displayed on the image display device.

On the other hand, the image display device 507 is a so-called touch-panel liquid crystal display in which a touch panel 548 is attached to the front surface. When an icon displayed on the liquid crystal screen is pressed by a finger or the like, the icon can be selected. FIGS. 41-43 are views showing an example of a display screen to be displayed on the image display device during a game.

As shown in FIGS. 41-43, a total of two kinds of screens are displayed on the image display device 507 during a game in the roulette gaming machine 501. One is a BET screen 551 having a table type betting board 550 on which a player bets chips on the player's expected winning numbers. The other is a bonus lottery screen 553 on which a lottery is directed for determining whether there occurs or not a bonus gaming state (hereinafter referred to as "bonus state") for giving a player advantageous conditions after a bet time for the player to bet chips is terminated.

Using the BET screen 551, the player bets chips using the player's own credits. When a specific result is obtained on the bonus lottery screen 553 as will be described later, and the chips bet on the BET screen 551 are successful, the player acquires a larger number of credits than usual in the game.

The BET screen 551 will be described below with reference to FIG. 41. Numbers the same as the numbers "0", "00" and "1" to "36" indicated on the number indication plates 524 are arrayed and displayed like boxes in the table type betting board 550 displayed on the BET screen 551. In the same manner, special bet areas for identifying "odd numbers", "even numbers", "kinds of color of number indication plates (red or black)", "predetermined number ranges (e.g. "1" to "12" and the like) and betting chips thereon are arrayed like boxes.

Under the table type betting board 550, a result history display portion 555, unit BET buttons 556, a payout result display portion 557 and a credit number display portion 558 are displayed in order from the left of the screen.

The result history display portion 555 shows a list of results of winning numbers in games till the last game (here, one game means a series of operations in which each player bets in each satellite 504, the ball 511 falls in one of the ball reception grooves 523, and credits are paid out based on a winning number). In that event, whenever one game is terminated, a new winning number is added from top and displayed. Thus, the player can confirm the history of winning numbers of up to 16 games.

Each unit BET button 556 is a button for betting a BET area (on a box of a number or a symbol, or on a line forming boxes) specified by the player. The unit BET buttons are provided with four kinds, that is, a 1-BET button 556A, a 5-BET button 556B, a 10-BET button 556C and a 100-BET button 556D.

First, when the player pushes a BET area to bet on the screen directly with the player's finger or the like, the BET area is specified by a cursor 560 which will be described later. Whenever the player pushes down the 1-BET button 556A in that state, the player bets one chip (the number of bet chips increases to "1", "2", "3", . . . one by one whenever the 1-BET button 556A is pushed by finger or the like). Whenever the player pushes down the 10-BET button 556C, the player bets 10 chips (the number of bet chips increases to "10", "20", "30", . . . ten by ten whenever the 10-BET button 556C is pushed by finger or the like). The 5-BET button 556B and the 100-BET button 556D are operated similarly. Accordingly, when a large number of chips are to be bet, the operation of the betting can be simplified.

The payout result display portion 557 displays the number of bet chips placed by the player in the last game and the number of payout credits paid out to the player in the last game. Here, the number obtained by subtracting the number of bet chips from the number of payout credits is the number of credits newly acquired by the player in the last game.

Further, the credit number display portion 558 displays the number of credits possessed by the current player. When chips are bet, the number of credits is reduced in accordance with the number of bet chips (one credit per one chip). When the number on which chips are bet is hit and credits are paid out, the number of credits increases by the number of paid credits. When the number of credits possessed by the player is 0, the player's gaming is terminated.

A BET timer graph 559 is provided above the table type betting board 550. The BET timer graph 559 is a graph showing the remaining time in which the player bets. A red graph begins to extend to right gradually as soon as a game starts. When the red graph reaches the right end, the time in which the player bets in the current game is terminated. As soon as the bet time of each player in each satellite 504 is terminated, that is, as soon as the BET timer graph 559 reaches the right end, the air is discharged from the first discharge nozzles 535 so as to initiate rolling of the ball 511 received in one of the ball reception grooves 523.

A cursor 560 indicating a BET area currently selected by the player is displayed on the table type betting board 550. In addition, chip symbols 561 each indicating the number of chips and a BET area bet till now are displayed. The number displayed on each chip symbol 561 indicates the number of bet chips. For example, as shown in FIG. 41, the chip symbol 561 with "7" placed on the box "18" indicates that seven chips have been bet on the number "18". The manner to bet on only one number like this is a bet manner called "straight up".

The chip symbol 561 with "1" placed at the intersection point of the boxes "5", "6", "8" and "9" indicates that one chip has been bet to cover the four numbers "5", "6", "8" and "9". The manner to bet to cover four numbers like this is a bet manner called "corner bet".

Other bet manners include "split bet" to place a chip on a line between two numbers so as to bet to cover two numbers, "street bet" to place a chip on an end of a row of numbers (one lengthwise line in FIG. 41) so as to bet to cover three numbers (for example, "13", "14" and "15"), "five bet" to place a chip on the line between the numbers "00" and "3" so as to bet to cover the five numbers "0", "00", "1", "2" and "3", "line bet" to place a chip on the boundary between two rows of numbers (two lengthwise lines in FIG. 8) so as to bet to cover six numbers (for example, "13", "14", "15", "16", "17" and "18"), "column bet" to place a chip on a box labeled "2 to 1" so as to bet to cover 12 numbers, and "dozen bet" to place a chip on a box labeled "1st 12", "2nd 12" or "3rd 12" so as to bet to cover 12 numbers. Further, there is a bet manner using one of six boxes provided in the lowest stage of the table type betting board 550 so as to bet to cover 18 numbers in accordance with which color to choose as the color of the number indication plates ("red" or "black"), which numbers to choose, odd or even, or which numbers to choose, numbers equal to or smaller than 18 or numbers equal to or larger than 19.

When the player is to bet on the BET screen 551 configured thus, first the player specifies and presses a BET area (on a box of a number or a symbol, or on a line forming boxes) to bet, directly on the screen by finger. As a result, the cursor 560 moves to the specified BET area.

After that, whenever any unit button (1-BET button 556A, 5-BET button 556B, 10-BET button 556C, or 100-BET button 556D) of the unit BET buttons 556 is pushed down, medals corresponding to the unit of the pushed unit button are bet on the specified BET area. For example, when the 10-BET button 556C is pushed four times, the 5-BET button 556B is pushed once, and the 1-BET button 556A is pushed three times, a total of 48 medals can be bet.

Next, the bonus lottery screen 553 will be described with reference to FIGS. 42 and 43. Here, after the bet time is terminated on the BET screen 551, that is, when the BET timer graph 559 reaches the right end, the BET screen 551 gives way to the bonus lottery screen 553 in a predetermined probability. Specifically, a random number lottery is perform for each satellite 504 based on a bonus lottery pattern table 569 (see FIG. 44) stored in the ROM 581 using a random number value sampled by a random number sampling circuit 578 (see FIG. 45) at suitable timing after the bet time is terminated. When a bonus state (which is a state where award odds of credits are higher than that in a base gaming state) occurs in one of the satellites 504 where players are gaming, the BET screens 551 in all the satellites 504 give way to the bonus lottery screens 53.

As shown in FIGS. 42 and 43, the bonus lottery screen 553 is arranged by a roulette display portion 565 displayed to be superimposed on the BET screen 551. In the roulette display portion 565, nine kinds of numbers "1", "2", "3", "5", "10", "20", "30", "50" and "100" are displayed in scale display portions 566 provided circumferentially at a total of 16 places. A lottery cursor 567 is displayed on one of the scale display portions 566 so as to point one of the numbers displayed in the scale display portions 566.

Here, the lottery cursor 567 moves rotating clockwise over the scale display portions 566 immediately after the BET screen 551 gives way to the bonus lottery screen 553. For example, in FIG. 42, the lottery cursor 567 moves to "100", "1", "5", "2", "30", . . . in that order.

As soon as a predetermined time (10 seconds in the third embodiment) has passed, the lottery cursor 567 stops on a specific number. The number where the lottery cursor 567 stops at that time is decided based on a result of a lottery performed for each satellite 504 by the main control portion 583 after the bet time is terminated. The lottery method will be described later. FIG. 42 shows a state of the bonus lottery screen particularly in which the lottery cursor is moving. FIG. 43 shows a state of the bonus lottery screen particularly in which the lottery cursor has stopped.

In addition, a lottery result display portion 568 is provided in an approximately central portion of the roulette display portion 565. After the lottery cursor 567 has stopped, a scale factor corresponding to the number of the scale display portion 566 where the lottery cursor 567 has stopped is displayed on the lottery result display portion 568. For example, a scale factor "×2" is displayed when the lottery cursor 567 stops on the number "2" of the scale display portion 566 (see FIG. 43). On the other hand, "×?" is displayed on the lottery result display portion 568 when the lottery cursor 567 is moving (see FIG. 42).

The award odds (the number of credits to be paid out for one winning chip) when a chip bet on the BET screen 551 is successful varies in accordance with the scale factor (corresponding to the number where the lottery cursor 567 has stopped) displayed on the lottery result display portion 568. For example, when "×2" is displayed, credits are paid out in accordance with the odds twice as high as ordinary award odds. When "×3" is displayed, credits are paid out in accordance with the odds three times as high as ordinary award odds. When "×5" is displayed, credits are paid out in accordance with the odds five times as high as ordinary award odds. When "×10" is displayed, credits are paid out in accordance with the odds ten times as high as ordinary award odds. When "×20" is displayed, credits are paid out in accordance with the odds twenty times as high as ordinary award odds. When "×30" is displayed, credits are paid out in accordance with the odds thirty times as high as ordinary award odds. When "×50" is displayed, credits are paid out in accordance with the odds fifty times as high as ordinary award odds. When "×100" is displayed, credits are paid out in accordance with the odds one hundred times as high as ordinary award odds.

On the other hand, when "×1" is displayed, credits are paid out in accordance with the odds as high as ordinary award odds.

Here, there is a difference in ordinary award odds among the plurality of betting manners using the BET screen 551 described previously. For example, for a win by a betting manner based on "straight up", credits 36 times as large as bet chips are paid out. For a win by a betting manner based on "corner bet", credits 8 times as large as bet chips are paid out.

Assume that the BET screen 551 gives way to the bonus lottery screen 553, and "×2" is displayed on the lottery result display portion 568. In this case, when chips bet on the BET screen 551 win by "straight up", credits 72 times as large as the bet chips are paid out to the player.

Next, with reference to FIG. 44, description will be made about the bonus lottery pattern table 569 to be used for a lottery in the bonus state after the bet time is terminated. FIG. 44 is an explanatory diagram showing the bonus lottery pattern table.

In FIG. 44, a random number value to be used in the bonus lottery pattern table 569 ranges from 0 to 335. As for the random number value, a numerical value corresponding to each satellite 504 is sampled by the random number sampling circuit 578 when the bet time is terminated.

When the sampled random number value is in a range of from 200 to 249, the bonus winning scale factor hits on "×2". Accordingly, the lottery cursor 567 stops on the number "2" of the scale display portion 566 on the bonus lottery screen 553. When the sampled random number value is in a range of from 250 to 279, the bonus winning scale factor hits on "×3". Accordingly, the lottery cursor 567 stops on the number "3" of the scale display portion 566 on the bonus lottery screen 553. When the sampled random number value is in a range of from 280 to 299, the bonus winning scale factor hits on "×5". Accordingly, the lottery cursor 567 stops on the number "5" of the scale display portion 566 on the bonus lottery screen 553. When the sampled random number value is in a range of from 300 to 314, the bonus winning scale factor hits on "×10". Accordingly, the lottery cursor 567 stops on the number "10" of the scale display portion 566 on the bonus lottery screen 553. When the sampled random number value is in a range of from 315 to 324, the bonus winning scale factor hits on "×20". Accordingly, the lottery cursor 567 stops on the number "20" of the scale display portion 566 on the bonus lottery screen 553. When the sampled random number value is in a range of from 325 to 329, the bonus winning scale factor hits on "×30". Accordingly, the lottery cursor 567 stops on the number "30" of the scale display portion 566 on the bonus lottery screen 553. When the sampled random number value is in a range of from 330 to 333, the bonus winning scale factor hits on "×50". Accordingly, the lottery cursor 567 stops on the number "50" of the scale display portion 566 on the bonus lottery screen 553. When the sampled random number value is in a range of from 334 to 335, the bonus winning scale factor hits on "×100". Accordingly, the lottery cursor 567 stops on the number "100" of the scale display portion 566 on the bonus lottery screen 553. When the sampled random number value is in a range of from 0 to 199, the bonus winning scale factor hits on "×1" indicating failure. Accordingly, the lottery cursor 567 stops on the number "1" of the scale display portion 566 on the bonus lottery screen 553. Further, when all the satellites 504 which are gaming prove a failure, the BET screen 551 does not give way to the bonus lottery screen 553.

In such a manner, a lottery to decide whether to produce the bonus state to increase award credits (odds) for winning bet chips should be made larger than ordinarily or not, is performed after the bet time is terminated in each satellite 504. When the bonus state appears in one satellite 504 of the satellites 504 which is gaming, the BET screen 551 gives way to the bonus lottery screen 553 in all the satellites 504. Accordingly, the player's feeling of expectations with the shift to the bonus state increases, while the enjoyability of gaming can be diversified so that the player can be prevented from being bored.

The bottom LEDs 571 and the side LEDs 573 for illuminating the roulette wheel 512 emit light in blue in the ordinary bet time using the BET screen 551, that is, between the time when the BET screen 551 is displayed and the time when the BET timer graph 559 reaches the right end. Thus, the roulette wheel 512 is illuminated in blue. When the ball 511 begins to roll on the roulette wheel 512 without shifting to the bonus lottery screen 553, the light emission color of each LED is changed over from blue to yellow.

On the other hand, when the BET screen 551 gives way to the bonus lottery screen 553 after the bet time is terminated, the light emission color of each LED is changed over from blue to red. Here, red has an effect of making an observer feel high as compared with any other color. Accordingly, the stage effects of the emission of red light enhance the stage effects of the scale factor lottery on the bonus lottery screen 553 and players' feeling of expectation with the number lottery in the roulette apparatus 502. Thus, the players are not bored therewith.

Figure 45:
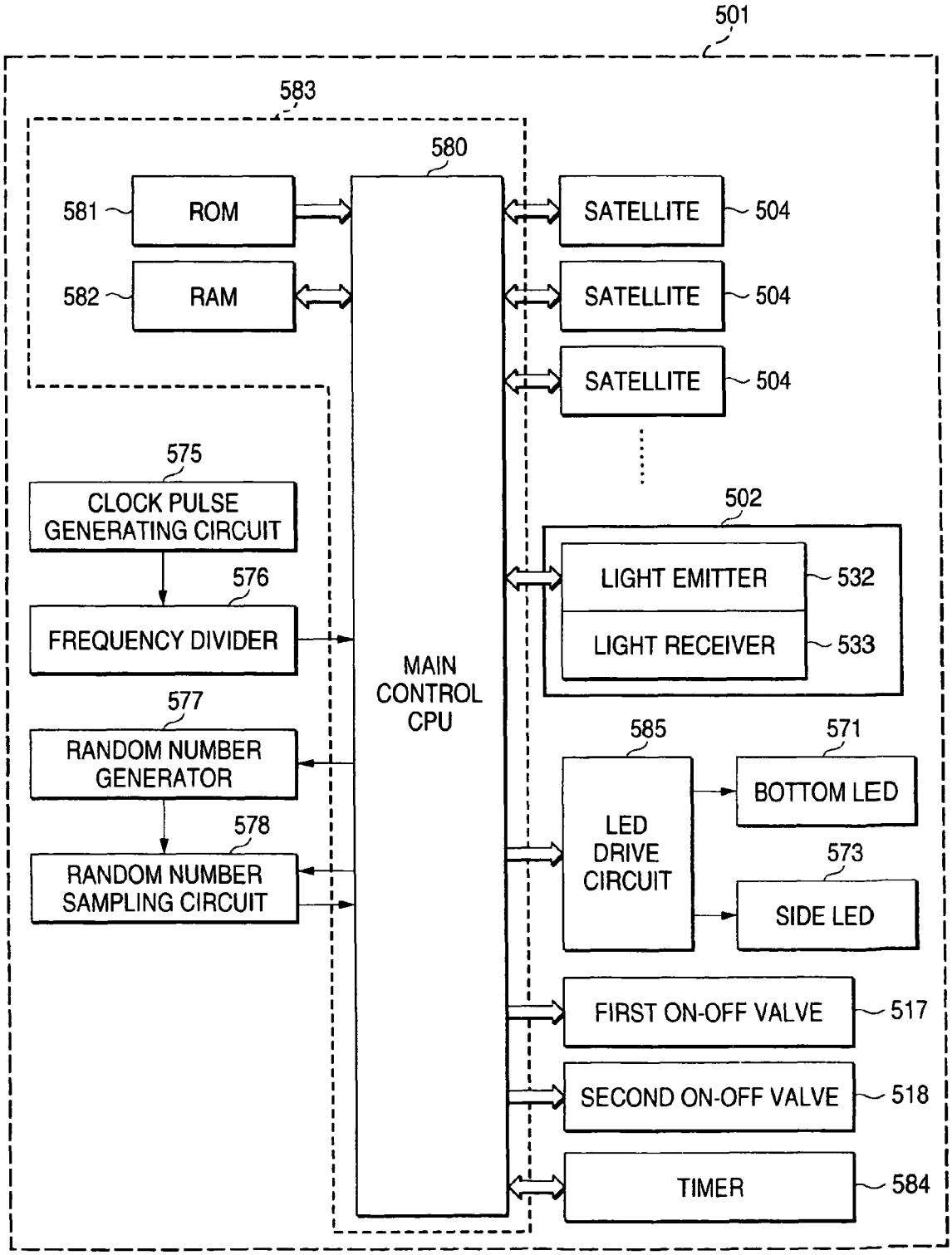
FIG. 45 is a block diagram schematically showing a control system of the roulette gaming machine according to the third embodiment.

Next, the configuration concerning the control system of the roulette gaming machine 501 will be described with reference to FIG. 45. FIG. 45 is a block diagram schematically showing the control system of the roulette gaming machine.

As shown in FIG. 45, the roulette gaming machine 501 is provided with a main control portion 583, the roulette apparatus 502, 10 satellites 504, an LED drive circuit 585, the bottom LEDs 571, the side LEDs 573, the first on-off valve 517 and the second on-off valve 518. The main control portion 583 includes a main control CPU 580, a ROM 581 and a RAM 582. The roulette apparatus 502 and the 10 satellites 504 (see FIG. 34) are connected to the main control portion 583. The bottom LEDs 571 and the side LEDs 573 are connected to the LED drive circuit 585. The control system of each satellite 504 will be described in detail later.

The main control CPU 580 performs various processes based on input signals and so on supplied from the satellites 504, and data or programs stored in the ROM 581 and the RAM 582. Based on results of the performed processes, the main control CPU 580 transmits command signals to the satellites 504 so as to control the satellites 504 initiatively and make progress on games. Further, the main control CPU 580 controls the light emitters 532 and the light receivers 533 (see FIG. 38) provided in the roulette apparatus 502 so as to determine a winning number of the ball reception groove 523 where the ball 511 has fallen. Based on the obtained winning number and the bet information transmitted from each satellite 504, the main control CPU 580 determines whether the bet chips are successful or not, and calculates the number of credits to be paid out in the satellite 504. When there occurs a bonus state, the number of credits to be paid out is increased in accordance with the winning scale factor ("×2" to "×100") in the bonus state.

The ROM 581 is, for example, comprised of a semiconductor memory or the like, storing a program for implementing the fundamental functions of the roulette gaming machine 501, a program for controlling each device in the roulette apparatus 502, the first on-off valve 517 and the second on-off valve 518, a program for initiatively controlling a light emission pattern of the bottom LEDs 571 and the side LEDs 573, odds (the number of credits to be paid out for one winning chip) in a roulette game using the BET screen 551, a bonus lottery pattern table for determining whether to shift to the bonus gaming state or not, each satellite 504, and so on.

On the other hand, the RAM 582 temporarily stores bet chip information supplied from each satellite 504, a winning number of the roulette apparatus 502 determined by the light emitters 532 and the light receivers 533, data about the results of processes executed by the main control CPU 580, and so on.

The first and second on-off valves 517 and 518 for adjusting the air pressure in the air tubes 515 and 516 respectively are also connected to the main control CPU 580. When the first on-off valve 517 is opened, the air compressed by the compressor 514 (see FIG. 35) is discharged from the first discharge nozzles 535 provided in the ball reception grooves 523. When the second on-off valve 518 is opened, the air compressed by the compressor 514 is discharged from the second discharge nozzles 536 provided in the banked passageway 529.

As soon as the bet time of each player is terminated in each satellite 504, that is, as soon as the BET timer graph 559 on the BET screen 551 reaches the right end, or as soon as the base gaming state gives way to the bonus gaming state, the lottery cursor 567 stops, and the scale factor as a result of the lottery is displayed on the lottery result display portion 568. After that, the first on-off valve 517 is opened for a predetermined time (2 seconds in the third embodiment). As a result, the ball 511 received in one of the ball reception grooves 523 at the time of termination of the last game is rolled toward the banked passageway 529 due to the air pressure.

Successively, the second on-off valve 518 is opened to produce a layer of the air flowing along the banked passageway 529 of the roulette wheel 512. Then, the ball 511 rolling toward the banked passageway 529 due to the air pressure from the first discharge nozzles 535 rotates clockwise along the banked passageway 529 in accordance with the flow of the air layer.

After that, the second on-off valve 518 is closed as soon as a predetermined time (15 seconds in the third embodiment) has passed. Thus, the flow of the air discharged from the second discharge nozzles 536 is suspended. As a result, the rotational velocity of the ball 511 is weakened gradually so that the ball 511 loses the centrifugal force. Thus, the ball 511 rolls down on the slope 528 and is received in one of the ball reception grooves 523.

The light emitters 532 and the light receivers 533 provided in the roulette apparatus 502 are connected to the main control CPU 580. A pair of a light emitter 532 and a light receiver 533 are provided in each ball reception groove 523 as described previously. When the ball 511 enters the ball reception groove 523, the ball 511 blocks the light so that the existence of the ball 511 is detected. Accordingly, when the ball 511 enters one ball reception groove 523, the existence of the ball 511 is detected by a light sensor comprised of a light emitter 532 and a light receiver 533, a detection signal is transmitted to the main control CPU 580. Based on the result of the detection, the main control CPU 580 determines a winning number.

Further, the bottom LEDs 571 and the side LEDs 573 are connected to the main control CPU 580 through the LED drive circuit 585. The LED drive circuit 585 controls the bottom LEDs 571 and the side LEDs 573 based on a control command from the main control CPU 580. Specifically, light emission is performed with the light emission color being changed over to one of a plurality of colors (three colors of "blue", "yellow" and "red" in the third embodiment) in accordance with the current state of progress of a game in the roulette gaming machine 501 and the LED light emission pattern stored in the ROM 581. In addition, the LEDs are turned on and off repeatedly in the current light emission color.

A timer 584 for measuring time is also connected to the main control CPU 580. Time information of the timer 584 is transmitted to the main control CPU 580. Based on the time information of the timer 584, the main control CPU 580 opens/closes the first on-off valve 517 and the second on-off valve 518.

Further, a clock pulse generating circuit 575 for generating a reference clock pulse and a frequency divider 576 are connected to the main control CPU 580. Furthermore, a random number generator 577 for generating random numbers and a random number sampling circuit 578 are connected. A random number sampled by the random number sampling circuit 578 is used for a lottery as to whether to produce a bonus state or not. Specifically, after the bet time is terminated, a lottery as to whether to give way to the bonus state or not is performed based on a random number value sampled by the sampling circuit 578 and the bonus lottery pattern table 569. A result of the lottery is transmitted to each satellite.

Figure 47:
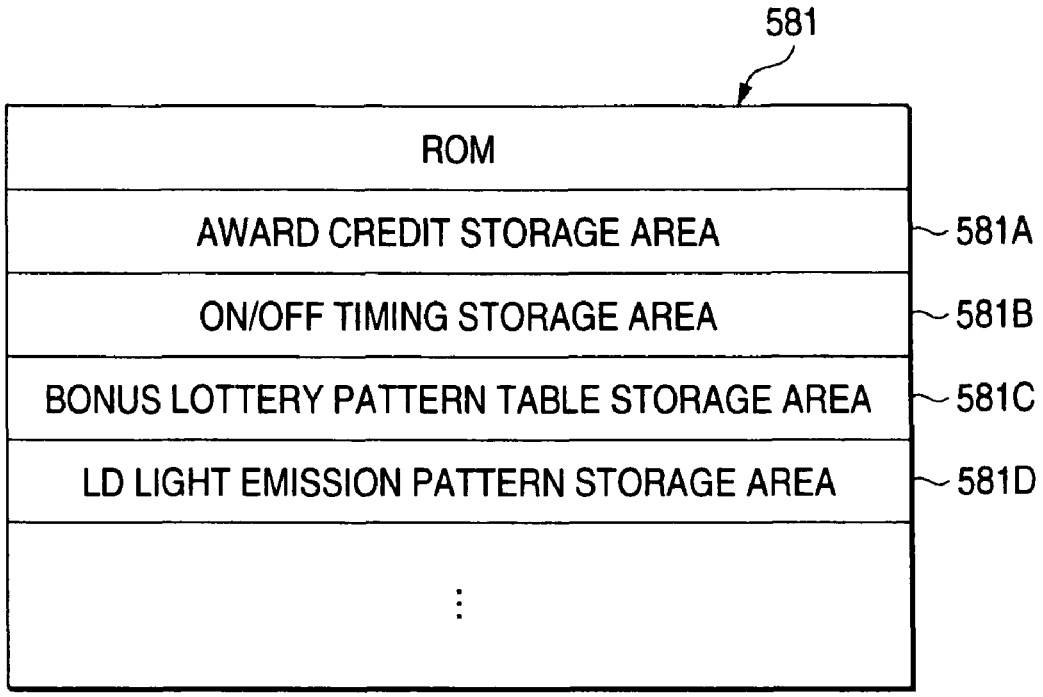
FIG. 47 is a schematic diagram showing storage areas of a ROM of the roulette gaming machine according to the third embodiment.

As shown in FIG. 47, the ROM 581 is provided with an award credit storage area 581A, an on/off timing storage area 581B, a bonus lottery pattern table storage area 581C and an LED light emission pattern storage area 581D. The award credit storage area 581A stores odds about roulette games using the BET screen 551. The on/off timing storage area 581B stores on/off timings of the first on-off valve 517 and the second on-off valve 518. The bonus lottery pattern table storage area 581C stores the bonus lottery pattern table 569 for giving way to the bonus state after the bet time is terminated. The LED light emission pattern storage area 581D stores a light emission pattern of the bottom LEDs 571 and the side LEDs 573 in accordance with the current state of progress of a game. Odds for respective BET areas on the BET screen 551 are stored in the award credit storage area 581A, ranging from "×2" to "×36" in accordance with their betting manners ("straight up", "corner bet", "split bet", etc.).

Figure 48:
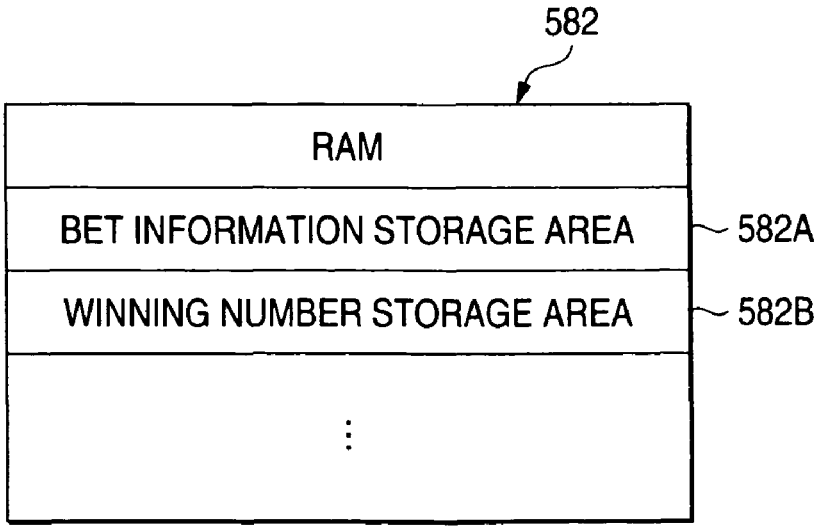
FIG. 48 is a schematic diagram showing storage areas of a RAM of the roulette gaming machine according to the third embodiment.

As shown in FIG. 48, the RAM 582 is provided with a bet information storage area 582A, a winning number storage area 582B, and a game number storage area 582C. The bet information storage area 582A stores bet information of each player gaming currently. The winning number storage area 582B stores a winning number of the roulette wheel 512 determined by the light emitter 532 and the light receiver 533. The game number storage area 582C counts the number of games which have been performed till now. Specifically the bet information includes BET areas specified on the BET screen 551, and the number of chips bet in each BET area.

Figure 49:
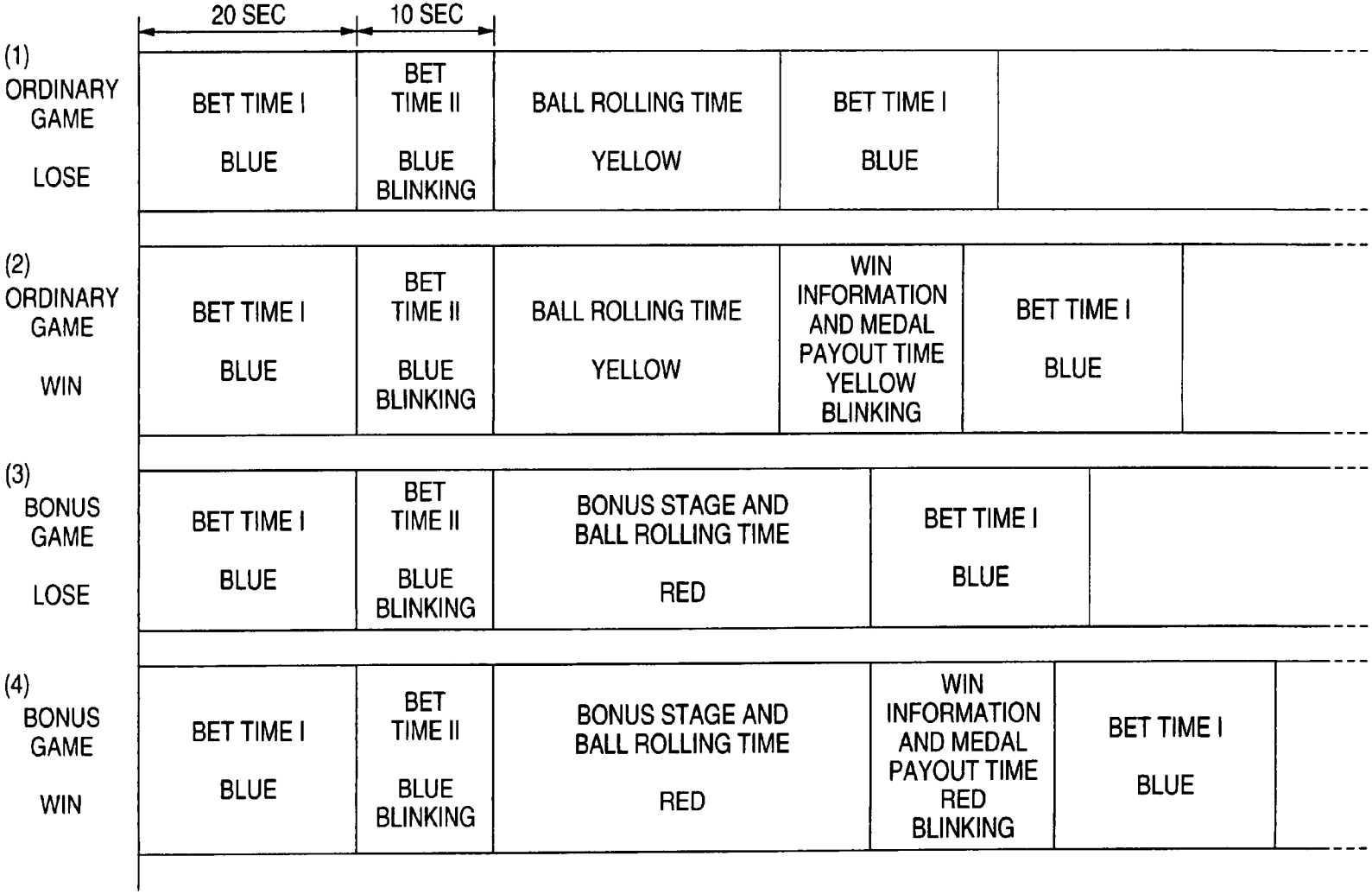
FIG. 49 is an explanatory diagram showing a light emission pattern of bottom LEDs and side LEDs.

Next, the light emission pattern of the bottom LEDs 571 and the side LEDs 573 stored in the LED light emission pattern storage area 581D of the ROM 581 will be described with reference to FIG. 49. FIG. 49 is an explanatory diagram showing on/off timings of the bottom LEDs 571 and the side LEDs 573.

As shown in FIG. 49, in the roulette gaming machine 501 according to the third embodiment, modes of progress of a game are classified into four modes. An LED light emission pattern is set for each mode of progress of a game in advance.

Here, each mode of progress will be described. First, there is (1) a mode where chips bet in any satellite 504 end in failure in a game (hereinafter referred to as a "ordinary game") performed when the base gaming state does not give way to the bonus state, that is, in the state where "×1" is hit in all the satellites 504 as a result of a lottery for each satellite 504 as to whether to shift to the bonus state or not based on the bonus lottery pattern table 569.

There is (2) a mode where chips bet in one of the satellites 504 are successful in an ordinary game.

There is (3) a mode where chips bet in any satellite 504 end in failure in a game (hereinafter referred to as a "bonus game") performed when the base gaming state gives way to the bonus state, that is, in the state where "×2" or higher is hit in one of the satellites 504 as a result of a lottery for each satellite 504 as to whether to shift to the bonus state or not.

Further, there is (4) a mode where chips bet in one of the satellites 504 are successful in a bonus game.

Next, the light emission patterns in the respective modes of progress will be described in turn specifically.

In the mode (1) where chips bet in any satellite 504 end in failure in an ordinary game, first the light emission color of the bottom LEDs 571 and the side LEDs 573 is changed over to blue so as to illuminate the roulette wheel 512 in blue (bet time I) as soon as the bet time (30 seconds in the third embodiment) for each player to bet chips in each satellite 504 is started. When the remaining time of the bet time is under 10 seconds, the LEDs are turned on and off repeatedly in the current emission color so as to blink the roulette wheel 512 in blue (bet time II). Further, when the bet time is terminated (the BET timer graph 559 on the BET screen 551 reaches the right end), the light emission color of the bottom LEDs 571 and the side LEDs 573 is changed over to yellow so as to illuminate the roulette wheel 512 in yellow (ball rolling time). After that, when a winning number is determined and the bet time of the next game is started, the light emission color is changed over from yellow to blue again.

In the mode (2) where chips bet in one of the satellites 504 is successful in an ordinary game, first the light emission color of the bottom LEDs 571 and the side LEDs 573 is changed over to blue so as to illuminate the roulette wheel 512 in blue (bet time I) as soon as the bet time (30 seconds in the third embodiment) for each player to bet chips in each satellite 504 is started. When the remaining time of the bet time is under 10 seconds, the LEDs are turned on and off repeatedly in the current emission color so as to blink the roulette wheel 512 in blue (bet time II). Further, when the bet time is terminated (the BET timer graph 559 on the BET screen 551 reaches the right end), the light emission color of the bottom LEDs 571 and the side LEDs 573 is changed over to yellow so as to illuminate the roulette wheel 512 in yellow (ball rolling time). After that, when a winning number is determined and medals begin to be paid out to players in winning satellites 504, the LEDs are turned on and off repeatedly in the current emission color so as to blink the roulette wheel 512 in yellow (win information and medal payout time). When the bet time of the next game is started, the light emission color is changed over from yellow to blue again.

In the mode (3) where chips bet in any satellite 504 end in failure in a bonus game, first the light emission color of the bottom LEDs 571 and the side LEDs 573 is changed over to blue so as to illuminate the roulette wheel 512 in blue (bet time I) as soon as the bet time (30 seconds in the third embodiment) for each player to bet chips in each satellite 504 is started. When the remaining time of the bet time is under 10 seconds, the LEDs are turned on and off repeatedly in the current emission color so as to blink the roulette wheel 512 in blue (bet time II). Further, when the bet time is terminated (the BET timer graph 559 on the BET screen 551 reaches the right end), the light emission color of the bottom LEDs 571 and the side LEDs 573 is changed over to red so as to illuminate the roulette wheel 512 in red (bonus stage and ball rolling time). After that, the bonus stage on the bonus lottery screen 553 (see FIGS. 42 and 43) is terminated and a winning number is determined. When the bet time of the next game is started, the light emission color is changed over from red to blue again.

In the mode (4) where chips bet in one of the satellites 504 is successful in a bonus game, first the light emission color of the bottom LEDs 571 and the side LEDs 573 is changed over to blue so as to illuminate the roulette wheel 512 in blue (bet time I) as soon as the bet time (30 seconds in the third embodiment) for each player to bet chips in each satellite 504 is started. When the remaining time of the bet time is under 10 seconds, the LEDs are turned on and off repeatedly in the current emission color so as to blink the roulette wheel 512 in blue (bet time II). Further, when the bet time is terminated (the BET timer graph 559 on the BET screen 551 reaches the right end), the light emission color of the bottom LEDs 571 and the side LEDs 573 is changed over to red so as to illuminate the roulette wheel 512 in red (ball rolling time). After that, when a winning number is determined and medals begin to be paid out to players in winning satellites 504, the LEDs are turned on and off repeatedly in the current emission color so as to blink the roulette wheel 512 in red (win information and medal payout time). When the bet time of the next game is started, the light emission color is changed over from red to blue again.

Here, blue has an effect of calming observers as compared with any other color. Accordingly, the roulette wheel 512 is illuminated in blue in the bet time I in which chips are bet, so that players can bet calmly without feeling pressed.

In the bet time II in which the remaining time of the bet time is under 10 seconds, the illumination is blinked so that persons even in the distance can grasp the remaining time of the bet time. Accordingly, a new player who wants to take part in gaming in the roulette gaming machine 501 easily understands the timing to join therein. Thus, the convenience of players is improved.

Yellow has an effect of giving the feeling of expectation or the feeling of happiness to observers as compared with any other color. Accordingly, the roulette wheel 512 is illuminated in yellow in the ball rolling time in an ordinary game so that players can enjoy observing the rolling of the ball 511 on the roulette wheel 512 with the feeling of expectation.

Red has an effect of making observers feel high as compared with any other color. Accordingly, due to the stage effects of the illumination, players' feeling of expectation is enhanced in the stage of a lottery of a scale factor on the bonus lottery screen 553 and a lottery of a winning number in the roulette apparatus 502 after the scale factor lottery. Thus, the players can be prevented from being bored.

Further, when any one of the players wins, the roulette wheel 512 is blinked in red or yellow. Accordingly, the winning player or other players can be informed of the win effectively.

Figure 46:
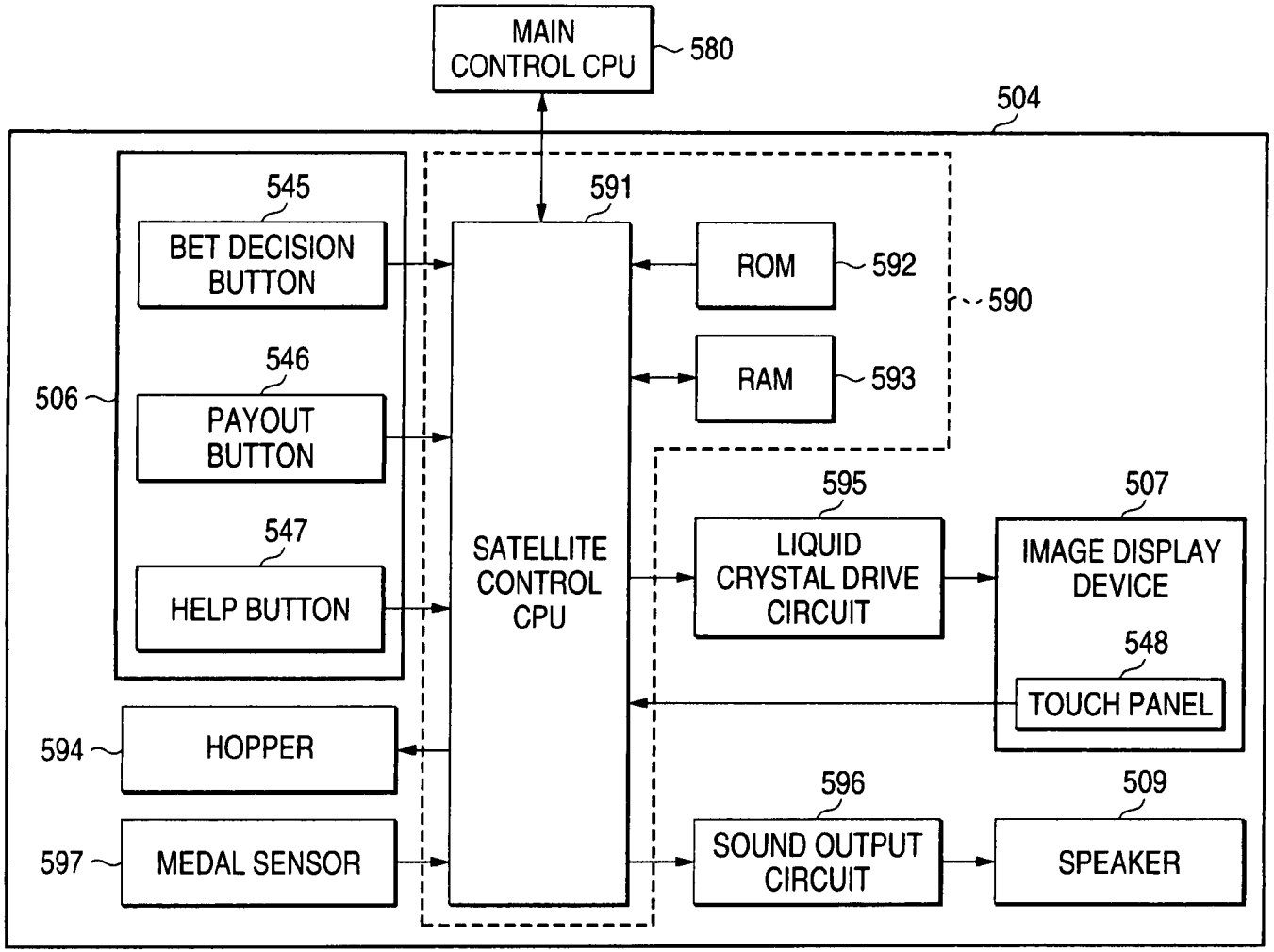
FIG. 46 is a block diagram schematically showing a control system of a satellite according to the third embodiment.

Next, the configuration concerning the control system of each satellite 504 connected to the CPU 580 of the main control portion 583 will be described with reference to FIG. 46. FIG. 46 is a block diagram schematically showing the control system of the satellite according to the third embodiment. The ten satellites 504 have fundamentally one and the same configuration, and one of the satellites 504 will be described below by way of example.

As shown in FIG. 46, the satellite 504 is provided with a satellite control portion 590 and some peripheral devices/instruments. The satellite control portion 590 is provided with a satellite control CPU 591, a ROM 592 and a RAM 593. The ROM 592 is, for example, comprised of a semiconductor memory or the like, storing a program for implementing the fundamental functions of the satellite 504, various other programs required for controlling the satellite 504, data tables, etc. On the other hand, the RAM 593 is a memory for temporarily storing various data calculated by the satellite control CPU 591, the number of credits currently possessed by the player, the state of chips bet by the player, etc.

The BET decision button 545, the payout button 546 and the help button 547 provided in the control portion 506 (see FIG. 34) are connected to the satellite control CPU 591 individually. Based on operation signals output in response to pushing down or the like on the respective buttons, the satellite control CPU 591 controls to execute various operations corresponding to the operation signals. Specifically, the satellite control CPU 591 executes various processes based on input signals supplied from the control portion 506 in response to operations input by the player, and data or programs stored in the ROM 592 and the RAM 593. The satellite control CPU 591 transmits the results of the various processes to the aforementioned main control CPU 580 of the main control portion 583.

On the other hand, the satellite control CPU 591 receives command signals from the main control CPU 580 and controls the peripheral devices constituting the satellite 504 so as to make progress on roulette games in the satellite 504. Alternatively, for the contents of some processes, the satellite control CPU 591 executes various processes based on input signals supplied from the control portion 506 in response to operations input by the player, and data or programs stored in the ROM 592 and the RAM 593. Based on the results of the various processes, the satellite control CPU 591 controls the peripheral devices constituting the satellite 504 so as to make progress on roulette games in the satellite 504. Which method is used to perform a process is set individually in accordance with the contents of the process. For example, a process to pay out medals for the winning number is executed by the former method, while a process for the player to bet on the BET screen 551 is executed by the latter method.

A hopper 594 is also connected to the satellite control CPU 591. In accordance with a command signal from the satellite control CPU 591, the hopper 594 pays out a given number of medals from the medal payout opening 508 (see FIG. 34).

Further, the image display device 507 is connected to the satellite control CPU 591 through a liquid crystal drive circuit 595. In terms of this point, the liquid crystal drive circuit 595 is provided with a program ROM, an image ROM, an image control CPU, a work RAM, a VDP (Video Display Processor), a video RAM, etc. The program ROM stores an image control program and various selection tables concerned with display on the image display device 507. The image ROM, for example, stores dot data for forming images to be displayed on the image display device 507. The image control CPU decides, of the dot data stored in the image ROM in advance, an image to be displayed on the image display device 507 based on parameters set in the satellite control CPU 591 and in accordance with the image control program stored in the program ROM in advance. The work RAM is arranged as a temporary storage for executing the image control program in the image control CPU. The VDP serves to form an image corresponding to the display contents decided by the image control CPU, and output the decided image to the image display device 507. The video RAM is arranged as a temporary storage for forming an image in the VDP.

The touch panel 548 is attached to the front surface of the image display device 507 as described previously. Operation information of the touch panel 548 is transmitted to the satellite control CPU 591. In the touch panel 548, an operation for the player to bet chips is performed on the BET screen 551. Specifically, the touch panel 548 is operated for selection of a BET area, operation on each unit BET button 556, etc. The information of the operations is transmitted to the satellite control CPU 591. Based on the transmitted information, bet information (BET areas specified on the BET screen 551, and the number of chips bet in each BET area) of the current player is stored in the RAM 593 in accordance with necessity. Further, the bet information is transmitted to the main control CPU 580, and stored in the bet information storage area 582A of the RAM 582.

Further, a sound output circuit 596 and the speaker 509 are connected to the satellite control CPU 591. The speaker 509 generates various sound effects for providing various presentations based on output signals from the sound output circuit 596.

A medal sensor 597 is also connected to the satellite control CPU 591. The medal sensor 597 detects medals inserted into the medal insertion slot 505 (FIG. 34), calculates the inserted medals and transmits the result of the calculation to the satellite control CPU 591. Based on the transmitted signal, the satellite control CPU 591 increases the number of credits of the player stored in the RAM 593.

Figure 50:
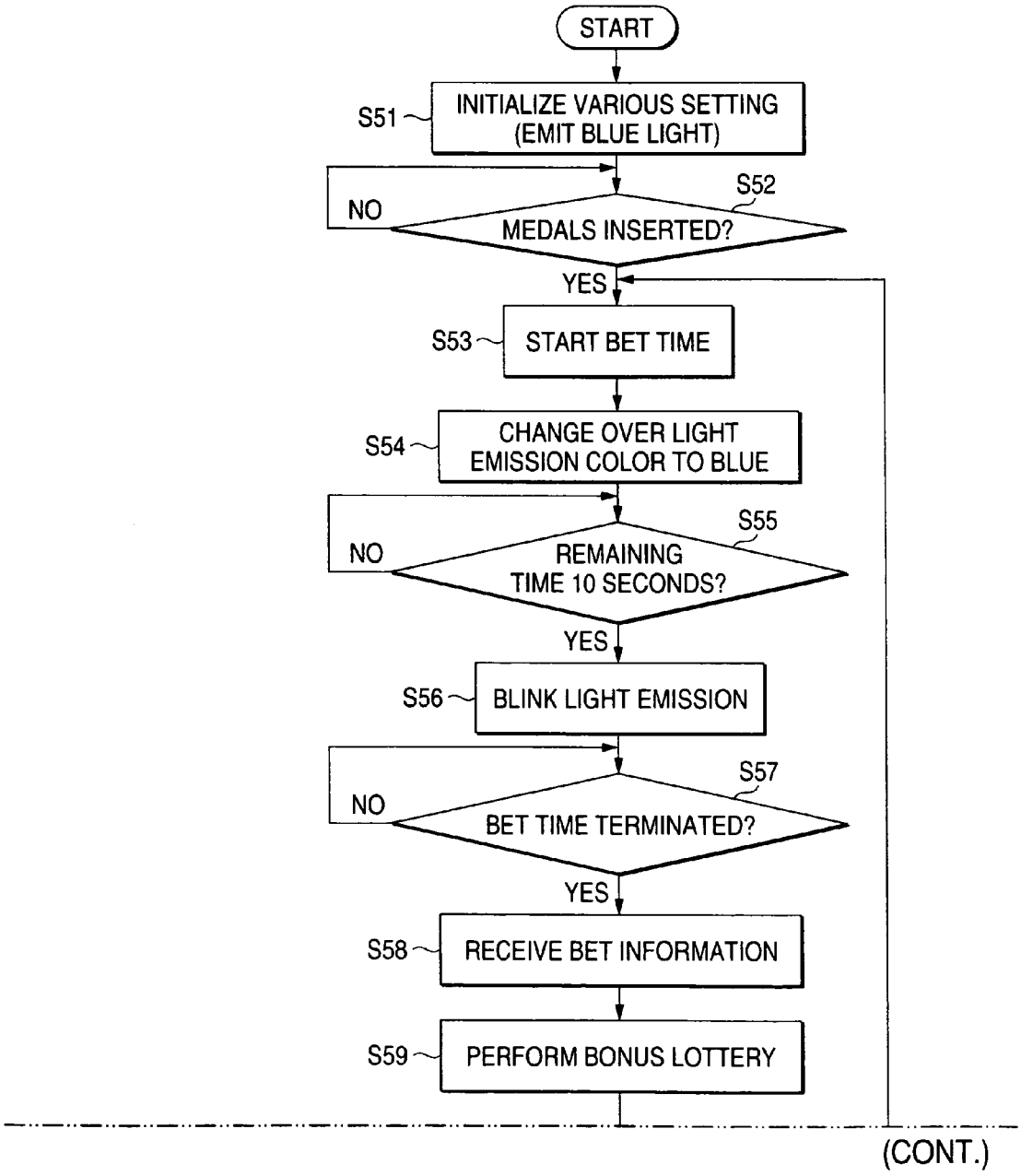
FIG. 50 is a flowchart of a roulette game processing program according to the third embodiment.

Subsequently, a game processing program in the roulette gaming machine 501 will be described with reference to FIG. 50. FIG. 50 is a flow chart of the roulette game processing program in the roulette gaming machine according to the third embodiment. Each program shown in the flow chart of FIG. 50 is stored in the ROM 581 or the RAM 582 belonging to the roulette gaming machine 501, and executed by the main control CPU 580.

Figure 51:
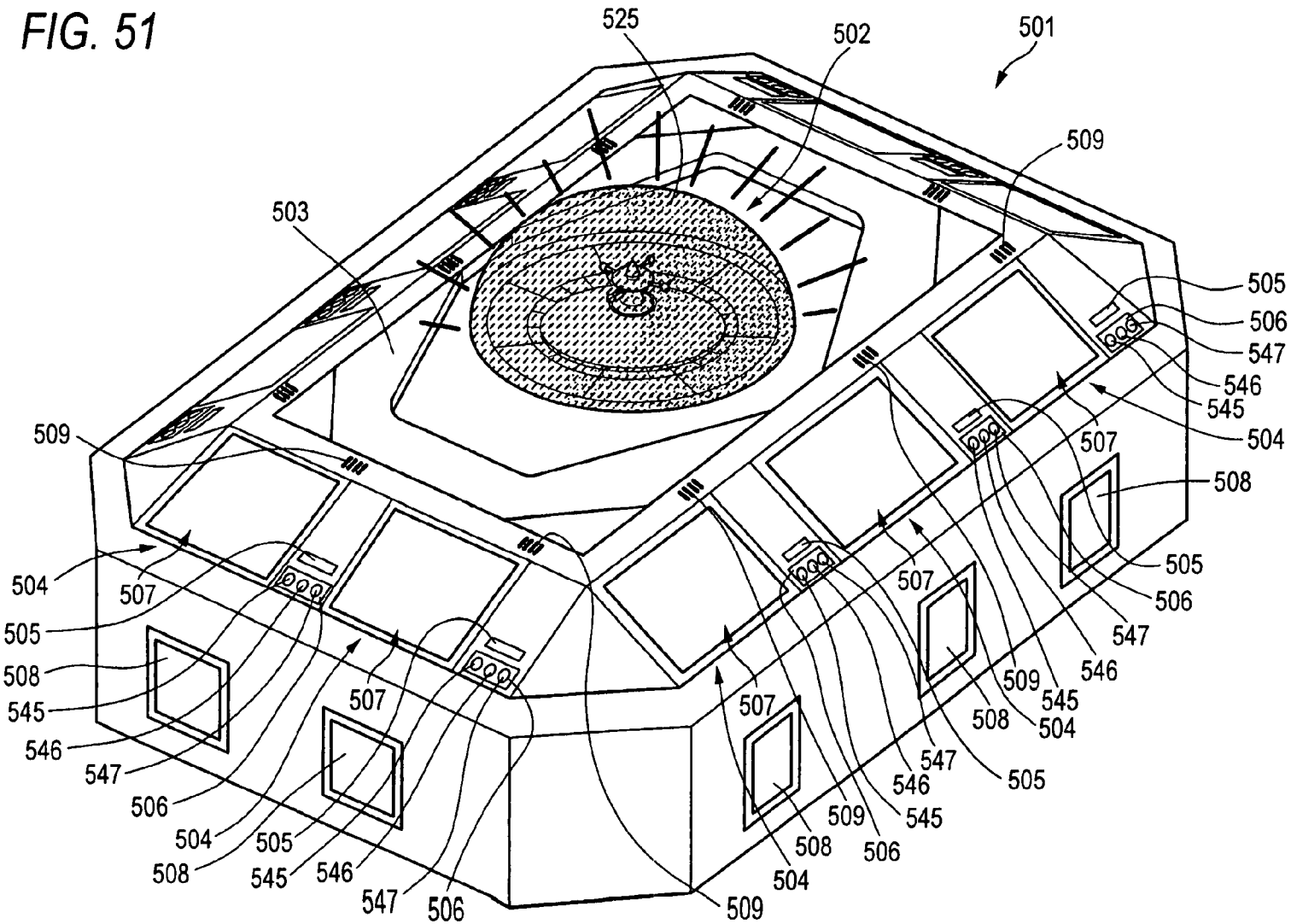
FIG. 51 is a perspective view showing the roulette gaming machine when the bottom LEDs and the side LEDs are emitting light.

First, in Step (hereinafter abbreviated to "S") 51, the main control CPU 580 initializes each storage area of the RAM 582 and stores a default value therein. At that time, the bottom LEDs 571 and the side LEDs 573 begin to emit light in blue. FIG. 51 is a perspective view showing the roulette gaming machine in which the bottom LEDs 571 and the side LEDs 573 are emitting light.

As described previously, the bottom LEDs 571 are provided inside the rotary disc 522 so as to illuminate the roulette wheel 512 from its bottom through the bottom transparent portions 522A. On the other hand, the side LEDs 573 are provided in the outer periphery of the guide wall 530 so as to illuminate the roulette wheel 512 from its side through the guide wall 530. Further, to illuminate the roulette wheel 512, the emitted light is scattered by the cover member 525 made of glass, so that the roulette apparatus 502 as a whole is illuminated more beautifully. Thus, the stage effects of the roulette apparatus 502 are improved.

Subsequently, the main control CPU 580 determines whether medals or coins are inserted by a player or not (S52). In the roulette gaming machine 501 according to the third embodiment, when medals or coins are inserted into the medal insertion slot 505 of any one of the satellites 504, the insertion is detected and transmitted to the satellite control CPU 591 by the corresponding medal sensor 597. After that, a medal insertion signal is further transmitted from the satellite 504 to the main control portion 583. Thus, the main control CPU 580 determines whether medals or coins are inserted by the player or not. When medals or coins are not inserted (S52: NO), the main control CPU 580 waits till medals or coins are inserted. When medals or coins are inserted (S52: YES), the main control CPU 580 proceeds the process to S53. When medals or coins are inserted, data of credits corresponding to the number of the inserted medals or coins is recorded in the RAM 593 of the corresponding satellite control portion 590.

The BET screen 551 shown in FIG. 41 is displayed on the image display device 507 of the satellite 504 used by the player so that the player bets chips. Other players may take part in the middle of the game. In the roulette gaming machine 501 according to the third embodiment, up to 10 players can play.

A bet time as an acceptable time in which players bets is started at the time when the first player to take part in the game inserts medals or coins (S53). At the same time, the main control CPU 580 changes over the light emission color of the bottom LEDs 571 and the side LEDs 573 to blue (S54). Incidentally, when the bet time is started for the first time, the light emission color is already changed over to blue in S51. Thus, in this case, the light emission color does not have to be changed over.

When the game in question is to be performed continuously to the last game, the bet time is started as soon as the last game is terminated. Each player taking part in the game can operate the touch panel 548 during the bet time so as to bet the player's own chips on BET areas corresponding to numbers the player expects (see FIG. 41). The specific bet manners using the BET screen 551 have been already described, and description thereof will be omitted here.

Next, in S55, it is determined whether the remaining time of the bet time has reached 10 seconds or not. The bet time is 30 seconds in the third embodiment. The bet time is indicated by the BET timer graph 559 in each satellite 504.

When the remaining time of the bet time has not reached 10 seconds yet (S55: NO), betting is accepted continuously. When remaining time of the bet time has reached 10 seconds (S55: YES), the main control CPU 580 turns the bottom LEDs 571 and the side LEDs 573 on and off alternately so as to blink the roulette wheel 512 in blue (S56).

After that, in S57, it is determined whether the bet time is terminated or not. Here, the bet time is terminated as soon as the BET timer graph 559 reaches the right end.

Before the termination of the bet time (S57: NO), betting is accepted continuously. When the bet time is terminated (S57: YES), a bet termination signal is output to the satellite control portion 590 of each satellite 504. On the liquid crystal screen of each satellite 504, an image showing the termination of betting is displayed, and any bet operation on the touch panel 548 is prohibited. Bet information (specified BET areas, and the number of chips bet on each specified BET area) of each player in each satellite 504 is received (S58), and stored in the bet information storage area 582A of the RAM 582.

Next, in S59, the main control CPU 580 acquires a random number value from the random number sampling circuit 578, and performs a lottery as to whether to produce a bonus state or not for each satellite 504 based on the bonus lottery pattern table 569 stored in the bonus lottery pattern table storage area 581C.

Further, in S60, it is determined whether one of the satellites 504 should be shifted to the bonus state or not. Here, whether to shift to the bonus state is determined based on whether a scale factor of "×2" or higher has been hit in at least one satellite 504 or not. When at least one satellite 504 is to be shifted to the bonus state (S60: YES), the main control CPU 580 changes over the light emission color of the bottom LEDs 571 and the side LEDs 573 to red (S61). After that, a stage process about a bonus lottery is executed in all the satellites 504 in S63. Incidentally, the stage effects in the bonus lottery in each satellite 504 have been described with reference to FIGS. 42 and 43, and the details thereof will be omitted here.

On the other hand, when any satellite 504 is not shifted to the bonus state (when "×1" is hit in the result of the lottery) (S60: NO), the main control CPU 580 changes over the light emission color of the bottom LEDs 571 and the side LEDs 573 to yellow (S62), and moves to S64.

Next, the main control CPU 580 executes an air discharge process by the roulette apparatus 502 in accordance with a game execution program in S64. The air discharge process is a process to open/close the first and second on-off valves 517 and 518 to thereby discharge the air compressed by the compressor 514 from the first and second discharge nozzles 535 and 536, roll the ball 511 on the roulette wheel 512 or receive the ball 511 in one of the ball reception grooves 523, and draw a winning number.

After the ball 511 is received in one of the ball reception grooves 523 on the rotary disc 522 due to the air discharge process, which ball reception groove 523 the ball 511 has dropped into is detected by a pair of the light emitter 532 and the light receiver 533, and the main control CPU 580 determines a winning number (one of "0", "00" and "1" to "36") (S5).

Further, the main control CPU 580 determines whether chips bet in each satellite 504 are hit or not, based on the bet information of each satellite 504 received in S8 and the winning number determined in S65 (S66).

Based on the determination of winning in S66, it is determined whether chips bet in at least one satellite 504 are hit or not (S67). When it is concluded that chips are hit (S67: YES), the main control CPU 580 turns the bottom LEDs 571 and the side LEDs 573 on and off alternately so as to blink the roulette wheel 512 in red or yellow (S68).

After that, the main control CPU 580 executes an award calculation process (S69). In the award calculation process, winning chips are recognized for each satellite 504, and the total amount of awards of credits to be paid out to the satellite 504 is calculated using odds (the number of credits to be paid out per chip) for BET areas stored in the award credit storage area 581A of the ROM 581. Then, the main control CPU 580 proceeds the process to S70.

On the other hand, when it is concluded that there is no winning chip in any satellite 504 (S67: NO), the main control CPU 580 proceeds the process to S71.

In S70, a payout process to pay out credits based on the award calculation process in S69 is executed. When credits are to be paid out to each satellite 504, credit data corresponding to awards are output to the satellite control portion 590 of each winning satellite 504 from the main control portion 583. The credit data are added to the RAM 593 of the corresponding satellite 504.

In S71, it is determined whether gaming will be performed continuously in at least one satellite 504 or not. Any player usually pushes down the payout button 546 when the player terminates gaming. When the payout button 546 is pushed down, medals (typically one medal per credit) corresponding to credits acquired by games or the like and currently possessed by the player are paid back from the medal payout opening 508 by the hopper 594.

When gaming is performed continuously in any one of the satellites 504 (S71: NO), the main control CPU 580 returns to S53, where the bet time is started again, and the next game is advanced.

On the other hand, when gaming is terminated in any satellite 504 (S71: YES), the roulette game process is terminated.

As described above, in the roulette gaming machine 501 according to the third embodiment, the bottom LEDs 571 are provided inside the rotary disc 522 of the roulette apparatus 502, while the side LEDs 573 are disposed in the outer periphery of the guide wall 530. In an ordinary game, the roulette wheel 512 is illuminated in blue and yellow through the bottom transparent portions 522A and the guide wall 530 in the bet time and the ball rolling time respectively. On the other hand, in a bonus game, the roulette wheel 512 is illuminated in blue and red in the bet time and the bonus stage and ball rolling time respectively. Thus, it is possible to exhibit novel stage effects based on the illumination state (change in color or blinking) of the roulette wheel 512, which stage effects could not be obtained in the related art. Accordingly, players' feeling of expectation and players' feeling of tension with a result of a lottery in the roulette apparatus 502 can be enhanced so that the players can be prevented from being bored. In addition, persons even in the distance can be informed of the current state of progress of a game in a way easy to understand. Accordingly, a new player who wants to take part in gaming can easily determine whether each satellite 504 of the roulette gaming machine 501 can accept betting currently or terminates acceptance of betting. Thus, the convenience of gaming can be improved.

In addition, when the remaining time of the bet time is within 10 seconds, the LEDs are turned on and off repeatedly so as to blink the roulette wheel 512 in blue. Thus, persons even in the distance can grasp the remaining time of the bet time easily. Accordingly, a new player who wants to take part in gaming in the roulette gaming machine 501 easily understands the timing to join therein. Thus, the convenience of players is improved.

Further, when the roulette wheel 512 is illuminated, emitted light is scattered through the cover member 525 made of glass. Accordingly, the roulette apparatus 502 as a whole is illuminated more beautifully so that the stage effects of the illumination can be enhanced.

The present invention is not limited to the aforementioned embodiment. Not to say, various improvements and modifications can be made on the invention without departing from the spirit and scope thereof.

For example, although LEDs are provided on the bottom of the rotary disc 522 of the roulette wheel 512 and the side portion of the guide wall 530 so as to illuminate the roulette wheel 512 in the third embodiment, the places where the LEDs are installed are not limited to the aforementioned positions. For example, LEDs may be provided in the ball reception grooves 523 where the ball 511 will be received.

In the case where LEDs are provided in the ball reception grooves 523, when the ball 511 is received in one of the ball reception grooves 523, the LED in the corresponding reception groove 523 is made to emit light. Thus, players can be informed of a winning number in a way easy to understand.

In the third embodiment, the light emission color of the bottom LEDs 571 and the side LEDs 573 is changed over in accordance with the current state of progress of a game in the roulette gaming machine 501, while the LEDs are further controlled to blink in the current light emission color in accordance with the remaining time of the bet time or a result of winning. However, the current gaming state may be expressed only by a change in light emission color without blinking the LEDs. Likewise, the current gaming state may be expressed only by a change in an interval or a pattern of blinking without changing over the light emission color.

In the third embodiment, the bottom LEDs 571 and the side LEDs 573 emit light in three colors of red, blue and yellow changed over from one to another in accordance with the current state of progress of a game in the roulette gaming machine 501. However, the light emission color is not limited to the three colors, but the LEDs may be designed to emit light in white or orange.

The image display device 507 in each satellite 504 may be designed to change the color of its screen in accordance with the current emission color of the bottom LEDs 571 and the side LEDs 573.

As described above with reference to the third embodiment, a roulette apparatus (for example, a roulette apparatus 502) according to the third embodiment includes: a roulette wheel (for example, a roulette wheel 512) in which a plurality of symbols are disposed; a ball (for example, a ball 511) to roll on the roulette wheel; and a plurality of ball reception members (for example, ball reception grooves 523) which are formed in a circumferential direction of the roulette wheel correspondingly to the plurality of symbols, and in one of which the ball will be received; wherein: an operation to roll the ball on the roulette wheel and allow the rolling ball to be received in one of the ball reception members after a predetermined time is regarded as a game, and such games are repeated continuously; and the roulette apparatus further includes: an illumination unit (for example, bottom LEDs 571 and side LEDs 573) for illuminating the roulette wheel with a plurality of light emission colors; and an illumination control unit (for example, a main control CPU 580, S54, S56, S61, S62, and S68) for turning on or off the illumination unit or changing over a light emission color of the illumination unit in accordance with progress of the games of the roulette apparatus.

In the roulette apparatus according to the configuration described above, the roulette wheel is illuminated in a plurality of light emission colors using the illumination unit, while the illumination unit is turned on or off and the light emission color thereof is changed over in accordance with the progress of a game in the roulette apparatus. Accordingly, it is possible to exhibit novel stage effects based on the illumination of the roulette wheel 512, which stage effects could not be obtained in the related art. Accordingly, players' feeling of expectation and players' feeling of tension with a result of a lottery in the roulette apparatus can be enhanced. Further, due to a mode of illumination of the roulette wheel, persons even in the distance can be informed of the current state of progress of a game in a way easy to understand. Accordingly, a new player who wants to take part in gaming can easily take part in a game. Thus, the convenience of players can be improved.

In the roulette apparatus (for example, the roulette apparatus 502) according to the configuration described above, at least a part of the roulette wheel (for example, the roulette wheel 512) is molded out of a transparent member (for example, bottom transparent portions 522A and a guide wall 530) which transmits light; and the illumination unit (for example, the bottom LEDs 571 and the side LEDs 573) illuminate the roulette wheel through the transparent member.

In the roulette apparatus according to the configuration described above, at least a part of the roulette wheel is formed out of a transparent member which transmits light, and the illumination unit illuminates the roulette wheel through the transparent member. Accordingly, the illumination unit can be prevented from being exposed directly to the outside, so that the appearance of the roulette apparatus can be improved. Further, due to the light emission transmitted through the transparent member, the roulette wheel can be illuminated more beautifully. The stage effects of the illumination can be enhanced.

In the roulette apparatus (for example, the roulette apparatus 502) according to the second configuration, the transparent member (for example, the bottom transparent portions 522A and the guide wall 530) is provided in a bottom surface and/or an outer periphery of the roulette wheel (for example, the roulette wheel 512).

In the roulette apparatus according to the configuration described above, the transparent member is provided in a bottom surface and/or an outer periphery of the roulette wheel so that the roulette wheel as a whole is illuminated through the transparent member from the bottom surface or the side surfaces of the roulette wheel. Accordingly, not only can the appearance of the roulette apparatus be improved but also the roulette wheel can be illuminated more beautifully so that the stage effects of the illumination can be enhanced.

A roulette gaming machine (for example, a roulette gaming machine 501) according to the third embodiment includes: the roulette apparatus (for example, the roulette apparatus 502) according to any one of the configurations described above; a betting unit (for example, a satellite 504) by which a player bets chips on, of the plurality of ball reception members (for example, the ball reception grooves 523), a ball reception member the player expects to receive the ball at the time of termination of each game; and a chip payout unit (for example, a hopper 594) for paying out chips to the player in accordance with a result of the game; wherein: the game providing unit (for example, main control CPU 580) provides a bonus gaming state in which more advantageous condition than that in a base gaming state for the player under predetermined condition; and the illumination control unit (for example, the main control CPU 580, S54, S56, S61, S62, and S68) controls the illumination unit (for example, the bottom LEDs 571 and the side LEDs 573) to emit light in a mode different from that in the base gaming state when the bonus gaming state occurs.

According to the roulette gaming machine described above, in a bonus gaming state occurring under predetermined condition, the illumination unit is made to emit light in a mode different from that in a base gaming state. Accordingly, the roulette gaming machine can exhibit novel stage effects which could not be obtained in the related art. Accordingly, players' feeling of expectation or players' feeling of tension with a result of a lottery in the roulette apparatus can be enhanced. Further, stage effects of the emission of light enhance the stage effects of the bonus gaming state and players' feeling of expectation with a lottery of a number in the roulette apparatus. Thus, the players are not bored therewith.

The above described roulette gaming machine may be configured as the roulette apparatus provided with necessary components to be configured as the roulette gaming machine, the components such as the betting unit and the chip payout unit.

In the above description, there are described in detail of three independent embodiments of the first, the second and the third embodiments to which the present invention is applied. However, one skilled in the art may arbitrary combine the subject matters included in the three embodiments to thereby provide a roulette apparatus or a roulette gaming machine having the advantages described above with respect to the three embodiments.

The foregoing description of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments was chosen and described in order to explain the principles of the invention and its practical application to enable those skilled in the art to utilize the invention in various embodiments and with various modifications as are suited to the particular use contemplated. It is intended that the scope of the invention be defined by the claims appended hereto, and their equivalents.

What is claimed is:

1. A roulette apparatus comprising:

a roulette wheel having a rolling region where a ball rolls;

a ball reception member provided contiguously to the rolling region to receive the ball and having a plurality of reception portions arranged in a circumferential direction of the roulette wheel and to receive the ball in one of the plurality of reception portions, each of the reception portions being provided with a symbol that identifies each reception portion of the plurality of reception portions from one another;

a game providing unit that provides to a user a roulette game in which one game is performed by allowing the ball to be received in one of the ball reception members after rolling the ball on the roulette wheel for a predetermined time period, and the game is repeatedly performed;

an illumination unit configured to illuminate the roulette wheel with a plurality of light emission colors; and an illumination control unit that controls the illumination unit to turn on and off and to change the light emission colors in accordance with a progression time frame of the game performed by the game providing unit, wherein the progression time frame includes a betting time and a ball rolling time;

wherein the illumination control unit controls the illumination unit in a first mode during the betting time and controls the illumination unit in a second mode during the ball rolling time; the roulette apparatus further comprising:

a betting unit that allows a player to bet a chip on which of the reception portions the ball is received in each game;

a chip payout unit that pays out chips to the player in accordance with a result of the game, wherein the game providing unit selectively provides a bonus gaming state in which a more advantageous condition than that in a base gaming state for the player under predetermined conditions is provided, and wherein the illumination control unit controls the illumination unit to emit light during the ball rolling time in a mode different from that in the base gaming state when the bonus gaming state occurs.

2. The roulette apparatus according to claim 1, wherein the roulette wheel is provided with a transparent member that transmits light, and wherein the illumination unit illuminates the roulette wheel through the transparent member.

3. The roulette apparatus according to claim 2, wherein the transparent member is provided in a bottom surface of the roulette wheel.

4. The roulette apparatus according to claim 2, wherein the transparent member is provided in an outer periphery of the roulette wheel.

5. The roulette apparatus according to claim 1, further comprising a plurality of image display devices, said plurality of image display devices surrounding the roulette wheel, and each being configured to display images concerning the roulette game.

6. The roulette apparatus according to claim 3, wherein the illumination unit is located under the roulette wheel, and wherein the illumination unit illuminates the roulette wheel through the transparent member during the betting time or during the ball rolling time.

7. A roulette gaming machine, comprising:

a roulette wheel having a rolling region where a ball rolls;

a ball reception member provided contiguously to the rolling region to receive the ball and having a plurality of reception portions arranged in a circumferential direction of the roulette wheel and to receive the ball in one of the plurality of reception portions, each of the plurality of reception portions being provided with a symbol that identifies each of the reception portions from one another;

a game providing unit that provides to a user a roulette game in which a game is performed by allowing the ball to be received in one of the ball reception members after rolling the ball on the roulette wheel for a predetermined time period, and the game is repeatedly performed;

an illumination unit that illuminates the roulette wheel with a plurality of light emission colors;

an illumination control unit that controls the illumination unit to turn on and off and to change the light emission colors in accordance with a progress of each game performed by the game providing unit;

a betting unit that allows a player to bet a chip on which of the reception portions the ball is received in each game;

a chip payout unit that pays out chips to the player in accordance with a result of the game, wherein the game providing unit selectively provides a bonus gaming state in which a more advantageous condition than that in a base gaming state for the player under predetermined condition is provided, wherein the illumination control unit controls the illumination unit to emit light in a mode different from that in the base gaming state when the bonus gaming state occurs, and wherein the illumination unit is configured to be located under the roulette wheel and radially outside of the roulette wheel; wherein the illumination control unit controls the illumination unit in a first mode during the betting time and controls the illumination unit in a second mode during the ball rolling time.

8. The roulette apparatus according to claim 7, wherein during the bonus gaming state, the player's odds of being awarded a credit is higher than that in the normal base gaming state, and wherein the betting unit comprises an image display device that displays a bonus lottery screen during the bonus gaming state.

9. The roulette apparatus according to claim 8, wherein the image display device displays a bet screen, and wherein the bonus lottery screen is superimposed on the bet screen during the bonus gaming state.

10. The roulette apparatus according to claim 9, wherein the bonus lottery screen comprises a roulette display portion comprising a scale display portion and a lottery cursor.

11. The roulette apparatus according to claim 10, wherein the lottery cursor is adapted to rotate clockwise over the scale display portion during the bonus game state.

12. The roulette apparatus according to claim 10, wherein the bonus lottery screen further comprises a lottery result display portion at an approximately central portion of the roulette display portion.

13. The roulette apparatus according to claim 12, wherein the lottery result display portion is adapted to display a scale factor corresponding to a number on the scale display portion that the lottery cursor stops on, and wherein an amount of an award is based on the scale factor.

14. A roulette gaming method, comprising:

rolling a ball in a rolling region of a roulette wheel;

receiving a ball at one of a plurality of reception portions after said rolling for a predetermined time period;

illuminating the roulette wheel with a plurality of light emission colors; and controlling said illumination in accordance with a state of a progression of a game;

allowing a player to bet a chip on which of the plurality of reception portions the ball is received in each game; and providing a bonus gaming state with a more advantageous condition than that in a gaming state for the player under a predetermined condition, wherein the state of the progression includes a betting time and a ball rolling time;

the roulette game method further comprising performing a bonus lottery, wherein said providing the bonus game state is dependent on the bonus lottery; wherein the bonus lottery comprises:

generating a random number;

sampling the generated random number; and determining a scale factor based on a value of the sampled random number; determining if the bonus state should be shifted, based on the determined scale factor and performing a lottery state process, if the bonus state is shifted, the process comprising:

providing a bonus lottery screen to superimpose over a bet screen, the bonus lottery screen comprising a roulette display portion, and a lottery result display at an approximately central portion of the roulette display portion.

* * * * *